US009212508B2

(12) United States Patent
Loughlin et al.

(10) Patent No.: US 9,212,508 B2
(45) Date of Patent: Dec. 15, 2015

(54) SECURITY LINK

(75) Inventors: Robert Loughlin, Stanton, NJ (US); John Loughlin, Lebanon, NJ (US)

(73) Assignee: STANTON CONCEPTS, L.L.C., Stanton, NJ (US)

( * ) Notice: Subject to any disclaimer, the term of this patent is extended or adjusted under 35 U.S.C. 154(b) by 1810 days.

(21) Appl. No.: 12/362,185

(22) Filed: Jan. 29, 2009

(65) Prior Publication Data

US 2009/0217713 A1 Sep. 3, 2009

Related U.S. Application Data

(63) Continuation-in-part of application No. 11/351,136, filed on Feb. 9, 2006, which is a continuation-in-part of application No. 11/231,210, filed on Sep. 20, 2005, now Pat. No. 7,543,466.

(60) Provisional application No. 60/611,369, filed on Sep. 20, 2004, provisional application No. 60/651,414, filed on Feb. 9, 2005.

(51) Int. Cl.

| | |
|---|---|
| ***E05B 65/48*** | (2006.01) |
| ***E05B 67/00*** | (2006.01) |
| ***E05B 67/22*** | (2006.01) |
| ***E05B 67/36*** | (2006.01) |
| ***E05B 67/38*** | (2006.01) |
| ***E05C 19/18*** | (2006.01) |
| *E05B 13/00* | (2006.01) |
| *E05B 83/10* | (2014.01) |

(52) U.S. Cl.

CPC ..... *E05B 67/003* (2013.01); *E05B 67/22* (2013.01); *E05B 67/36* (2013.01); *E05B 67/383* (2013.01); *E05C 19/186* (2013.01); *E05B 13/002* (2013.01); *E05B 83/10* (2013.01); *Y10T 70/491* (2015.04)

(58) Field of Classification Search

USPC ..... 70/2, 6–8, 13–14, 15–19, 32–33, 70/51–52, 54–56, 60, DIG. 12, DIG. 32

See application file for complete search history.

(56) References Cited

U.S. PATENT DOCUMENTS

| | | | |
|---|---|---|---|
| 62,636 | A | 5/1867 | Kelly |
| 1,788,396 | A | 1/1931 | Johnson |
| 2,104,981 | A | 1/1938 | Falk |
| 2,825,218 | A | 3/1958 | O'Brien |
| 3,664,164 | A | 5/1972 | Zaidener |
| 3,769,821 | A | 11/1973 | Randel |
| 3,817,064 | A | 6/1974 | Sallee |
| 3,835,675 | A | 9/1974 | Lippisch |

(Continued)

OTHER PUBLICATIONS

Final Office Action in U.S. Appl. No. 11/351,136, dated Jan. 14, 2010, 13 pgs.

(Continued)

*Primary Examiner* — Christopher Boswell
(74) *Attorney, Agent, or Firm* — Graham Curtin, P.A.

(57) ABSTRACT

A device adapted to secure at least one securing member with a security link with a lock having a body and a shackle. The security link comprising a body with a surface and a hasp, the surface having a first and a second opening through the body, the hasp enabled to be captured by the shackle of the lock. The first opening enabled to secure the securing member when the lock is secured in the second opening. The securing member enabled to be removed from the security link when the lock is removed from the second opening. The shackle does not directly hold at least one securing member.

20 Claims, 86 Drawing Sheets

(56) References Cited

U.S. PATENT DOCUMENTS

| | | | | | |
|---|---|---|---|---|---|
| 3,901,058 | A | | 8/1975 | Best | |
| 4,102,162 | A | | 7/1978 | Miller | |
| 4,112,716 | A | * | 9/1978 | Wippich | 70/38 C |
| 4,183,235 | A | | 1/1980 | Coralli et al. | |
| 4,347,720 | A | | 9/1982 | Kenyon | |
| 4,389,862 | A | | 6/1983 | Hastings | |
| 4,704,881 | A | | 11/1987 | Sloop, Sr. | |
| 4,754,626 | A | | 7/1988 | Siegel | |
| 4,998,423 | A | | 3/1991 | Hsu | |
| 5,146,771 | A | | 9/1992 | Loughlin | |
| 5,219,384 | A | * | 6/1993 | Elsfelder et al. | 70/18 |
| 5,284,036 | A | | 2/1994 | Rosenbaum | |
| 5,442,941 | A | | 8/1995 | Kahonen et al. | |
| 5,469,722 | A | | 11/1995 | Ellefsen | |
| 5,956,980 | A | | 9/1999 | Jenkins, Jr. | |
| 6,012,739 | A | | 1/2000 | Weiss et al. | |
| 6,092,402 | A | * | 7/2000 | Porcelli et al. | 70/18 |
| 6,766,671 | B2 | | 7/2004 | Haczynski et al. | |
| 6,997,420 | B2 | * | 2/2006 | Yudis et al. | 70/14 |
| 7,047,774 | B1 | | 5/2006 | Gogel | |
| 7,096,696 | B2 | * | 8/2006 | Devecki | 70/18 |
| 7,272,962 | B2 | * | 9/2007 | Benda et al. | 70/18 |
| 7,520,151 | B1 | * | 4/2009 | Harmon | 70/56 |
| D627,632 | S | * | 11/2010 | Elmer et al. | D8/383 |
| 7,891,219 | B1 | * | 2/2011 | Gogel | 70/56 |
| 2006/0107707 | A1 | * | 5/2006 | Vaughn et al. | 70/18 |
| 2006/0272365 | A1 | * | 12/2006 | Copus | 70/14 |

OTHER PUBLICATIONS

"PCT International Search Report—PCT/US05/33533", (Apr. 28, 2006),2 pgs.

"PCT Written Opinion—PCT/US05/33533", (Apr. 28, 2006),7 pages.

* cited by examiner

SECURITY LINK

STATEMENT OF RELATED CASES

This application is a continuation-in-part of U.S. patent application Ser. No. 11/351,136 filed Feb. 9, 2006, which is a continuation-in-part of U.S. patent application Ser. No. 11/231,210 filed Sep. 20, 2005, which claims the benefit of the filing date of U.S. Provisional Patent Application No. 60/611,369 filed Sep. 20, 2004, and U.S. Provisional Patent Application No. 60/651,414, filed Feb. 9, 2005. The disclosures of each of the foregoing applications are hereby incorporated herein by reference as if fully disclosed herein.

BACKGROUND OF THE INVENTION

The present invention relates in general to padlock enhancement systems. Such systems may be utilized to secure objects that may conventionally be secured by a padlock, but include features to compensate for inherent weaknesses in the conventional padlock design.

The systems included in the present application may be utilized for securing objects such as chain, cable, or other flexible or non-flexible elements, or conventional barn-door style intermodal container or trailer locking systems with shackle padlocks of various configurations. Such attachments may accept links of chain or similar engaging elements to provide relatively great resistance to forced attack while maintaining ease of use, flexibility in application, and cost effectiveness. The attachments also provide provisions for association with conventional barn-door style locking systems for added security.

It is well known that the "weak link" in a chain or cable-lock system is often the lock itself, and therefore the lock is a common attack point. For example, in the most basic system, a U-shackle type padlock may secure a length of chain. Depending on the padlock used, the chain or a cable is often much stronger than the lock itself. Thus, the lock may be attacked either by applying a torque to the shackle, or simply applying a tension force to the shackle by pulling on the chain. The present invention provides means to combat these common attack methods by providing novel attachment means for a lock to attach to a locking system. In accordance with certain aspects of the present invention, and to further provide security, the shackle of the lock may be completely hidden, such that attack upon the shackle is extremely difficult.

In barn-door style locking systems, it is well known that common attack points are the rivets that secure the locking system to the doors, or the rivets that secure the pivoting handle to the vertical rod. In accordance with certain aspects of the present invention, a link system may be employed to protect these vulnerable areas, in addition to protecting the lock itself.

Additionally the present invention permits but is not limited to the exploitation of the following advantages:

(A) Hockey Puck Style Locks: The conventional well known "shackleless" cylindrical padlocks with hidden straight shackles generically referred to as hockey puck locks are in common use today. Hockey puck locks are shown in U.S. Pat. No. 3,901,058 issued to Best, U.S. Pat. No. 3,769,821 issued to Randel, and U.S. Pat. No. 6,766,671 issued to Haczynski et al. These examples each provide a recess within the lock to accept a specific attachment, hasp, or staple of a generic hasp of appropriate dimension to fit and provide for the engagement of the straight shackle which passes through the recess. The resulting assembly provides a hidden shackle and hasp or attachment protected from forced attack by the surrounding body of the padlock.

Heretofore, such hockey puck style locks have typically been employed directly to locking systems of doors, such as doors of cargo vans. Aspects of the present invention provide means for the engagement of chain, cable, or chain like elements by means of a novel attachment device, which engages within the recess of the cylindrical padlock body. The hidden straight shackle of the padlock may then pass through the hole provided in the device to result in the secure assembly of chain, attachment, and padlock. Such an assembly can broaden the use of conventional hockey puck style locks, and can provide for security levels heretofore unachievable by convention locking systems.

Aspects of the present invention may also provide for a shielding element to protect the vulnerable bottom of the hockey puck style padlock. These aspects may include facility for mounting the novel attachment device to an object or structure to provide a system of security including padlock, chain (or other flexible or non-flexible element), item to be secured, and a fixed structure. A security links with a hidden shackle padlocks with a rectangular shape rather than the hockey puck shape are also fully contemplated.

(B) Straight Shackle Style Padlocks: Straight shackle padlocks in which the shackle is not hidden and is readily visible are also in use today. Locks of this type are shown in U.S. Pat. No. 2,104,981 issued to Falk, U.S. Pat. No. 4,183,235 issued to Coralli, or U.S. Pat. No. 5,442,941 issued to Kahonen. These examples also offer a recess to accept the attachment for chain, cable, or chain like flexible elements that would be engaged by the straight shackle to provide the secure assembly of attachment, chain and padlock. Additionally the well-known ring shackle, or circular shackle, padlocks generically referred to as disc padlocks provide features similar to the straight shackle padlocks described above. Locks of this sort are shown in U.S. Pat. No. 62,636 issued to Kelly, U.S. Pat. No. 1,788,396 issued to Johnson, and U.S. Pat. No. 4,998,423 issued to Hsu. These examples also accept attachments contemplated by the present invention.

Aspects of the present invention provide for the engagement of chain, cable, or other flexible or non-flexible elements with a specific attachment device, which engages within the exposed recess of the padlock and provides sufficient structure to protect both the shackle and the elements of the attachment device from forced attack.

(C) The conventional well-known U-shackle padlocks, which are provided with a shield or shroud, are in limited use today. Locks of this sort are shown in U.S. Pat. No. 3,835,675 issued to Guillermo, U.S. Pat. No. 4,102,162 issued to Miller, or U.S. Pat. No. 5,146,771 issued to Loughlin, an inventor herein. These examples also offer a recess to accept the attachment for chain, cable, or chain like elements that would be engaged by a protected U-shackle to provide the secure assembly of attachment, chain and padlock. The most common U-shackle padlocks may also accept the attachment contemplated by the present invention when configured with the appropriate and compatible dimensions.

(D) The well known rotary shackle padlocks such as the Kryptonite 850434. Aspects of the present invention demonstrate taking advantage of the short distance between shackle and body, and apply the rotary shape of the padlock.

Aspects of the present invention provide for the engagement of chain, cable or other flexible or non-flexible elements with a specific attachment device, which engages within the recess of the shrouded padlock or conventional padlock and provides sufficient structure to protect both the shackle and the elements of the attachment, chain and padlock.

These and other aspects of the present invention will be discussed more fully below. However, it is noted that it would be advantageous to provide a chain attachment for shackle padlocks which aids in securing a chain/cable-type lock system in a manner not heretofore envisioned. It would also be advantageous to provide a similar system for use with barn-door style container/trailer doors. Each of these systems provide for security levels heretofore unimagined.

SUMMARY OF THE INVENTION

The chain attachment for shackle padlocks of the present invention is designed to overcome the deficiencies of the prior art. Several objectives and advantages of this invention follow from the novel method by which the attachment mechanism is utilized in conjunction with a chain/cable system.

In general, the security link of the present invention is designed to work in conjunction with a shackle lock, such as a straight shackle lock, hockey puck lock, padlock, or cylinder lock, such that securing elements of the link, typically posts or ears, secure securing members, such as chain, cable, or other flexible or non-flexible securing members, in a manner heretofore unrealized. In this regard, the link is designed to withstand potential forces exerted on the securing member, rather than the lock, as is known.

In other aspects of the invention, the novel link, in conjunction with a strap system, may be added to security systems of the type having a vertical lockrod and hinged handle, typically found on container and truck doors.

More specifically, in accordance with one aspect of the present invention, the invention may include a link for connecting at least one securing member with a locking device having a body and a shackle, the link comprising a base having a through hole adapted to receive the shackle of a locking device, and a first securing element associated with the base, the first securing element being adapted to receive a first securing member, wherein the through hole of the base and the first securing element are arranged so that when the shackle of the locking device is inserted through the through hole of the base, the locking device is arranged to block the first securing member from being separated from the securing element.

The link may further comprise a second securing element associated with the base, the second securing element adapted to receive a second securing member, wherein the through hole of the base and the second securing element are arranged so that when the shackle of the locking device is inserted through the through hole of the base, the locking device is arranged to block the second securing member from being separated from the second securing element.

The securing member may be one of a chain or a cable.

The securing element may be one of an ear or a post.

Where the securing element is an ear, the ear may be one of C-shaped, J-shaped, or U-shaped. The ear may include an end adapted to be located in close proximity to the body of the locking device when the shackle of the locking device is inserted through the through hole to prevent the securing member from being unsecured through a gap created between the securing element and the body of the locking device.

Where the securing element is a post, the locking device may be adapted to rest atop a portion of the post to block the securing member from being unsecured when the shackle of the locking device is inserted through the through hole.

The link may further comprise a channel adapted to receive a second securing member. The first and second securing members may be portions of a single securing member. The channel may include a ratcheting device adapted to permit the second securing member to move through the channel in only one direction.

The link may include additional features, such as an anti-rotation step, apertures to permit mounting thereof, a raised lip partially surrounding the lock, a cutout in lip permitting use of the keyed cylinder of the lock, or a generally circular shape in registration with a lock. In addition, the locking device may be a hockey puck lock.

Where the locking device is not a hockey puck lock, the link may also include a plate adapted to permit use of a shackle lock, such as a padlock, or straight shackle lock. The plate may be thick such as portions of the plate block the securing member from being freed of the link, or may be thin in the case where the plate rests on the securing member, yet may still block the securing member from being freed from the link. The plate may include an aperture through which the post may penetrate. Finally, the plate may also include an anti-rotation step which may be placed in registration with the anti-rotation step of the link. The ears or parts of the link may also be provided with magnets to help temporarily retain ferrous metal securing elements during installation.

In accordance with further aspects of the present invention, there is disclosed a device adapted to connect a first securing member to a second securing member, where the device comprises a body having an aperture and first and second securing elements, the aperture adapted to receive the shackle of a lock and the first and second securing elements adapted to receive the first and second securing members. The first securing element may be inserted through the first securing member, the second securing element may be inserted through the second securing member, and the shackle of the lock may be inserted through the aperture such that the lock inhibits the securing members from being disassociated with the first and second securing elements.

The first securing member may be one of a chain link or the looped end of a cable.

The link may further comprise a second aperture adapted to receive the shackle of a lock, wherein the second aperture permits use of locks with shackles of a size different from the size of the shackle of the lock adapted to be inserted through the first aperture.

The link may include additional features. For example, the link may be generally triangular in shape. In such configuration, an aperture may be configured in one corner with the first and second securing elements in each of the other corners. The securing elements may be C-shaped, J-shaped, or the like. The link may be made from ferrous or non-ferrous metals or alloys, and may be coated for protection, such as from outdoor elements.

In accordance with still further aspects of the invention, a system for securing a locking device having a handle hinged to a vertical lockrod may comprise a strap having a first end and a second end, the first end may be adapted to associate with the vertical lockrod of a locking device such that the strap may rotate around the first end, the second end having an aperture therethrough, a link having a passage therethrough, the link adapted to be slid onto the handle of the locking device such that the handle passes through the passage, the link having a raised portion, the raised portion having a through hole, the raised portion adapted to extend through the aperture of the strap such that a lock may be secured through the through hole of the raised portion to prevent the handle from being manipulated in such a manner as to unlock the locking device.

Where the device further includes a hasp adapted to bind the handle, the strap may further comprise an aperture permitting the hasp to extend therethrough for use.

The device may include additional features. For example, the strap may include features, such as extension features, to cover the rivets securing either or both of the hasp or the hinge. The first end of the strap may comprise at least one hook. The at least one hook may be U-shaped to substantially surround the vertical rod. The strap may be configured in non-planar sections to fit closely with the handle. Finally, the apertures at the second end of the strap may be crescent shaped, to accept the interrupted raised lip of the link.

In accordance with additional aspects of the present invention, a system is disclosed for providing additional protection to a locking device of the type having a handle hinged to a vertical lockrod and a hasp adapted to bind the handle when in a locked position, where the system comprises a strap having a first end adapted to wrap at least partially around the vertical lockrod and a second end adapted to be placed adjacent to the handle when the handle is in the locked position, the second end including a notch, a link comprising a base having an aperture, the aperture adapted to permit entry of the handle and the second end of the strap, the link further comprising a post having a post through hole, the post through hole being adapted to accept the shackle of a lock, a plate configured to fit against the link, the plate comprising a plate with a plate through hole, the plate through hole configured to register with the post through hole, and a pin, the pin adapted to enter the notch when the plate through hole is in registration with the post through hole such that the interference between the pin and the notch prevents the link from being slid and removed from the handle and the strap.

The link may further comprise a spring adapted to bias the plate toward a position wherein the pin is not within the notch.

The system may include additional features. For example, the springs may be permanently attached to the link. The strap may include features, such as extension features, to cover the rivets securing either or both of the hasp or the hinge. The first end of the strap may comprise at least one hook. The at least one hook may be U-shaped to substantially surround the vertical rod. The strap may be configured in non-planar sections to fit closely with the handle.

In accordance with yet an additional aspect of the present invention, a locking device may comprise a link having a first hook and a post extending therefrom, the first hook adapted to be secured around a first object and the post adapted to accept a lock, a second hook having a straight portion with at least one aperture, the second hook adapted to be secured around a second object with the straight portion placed over the post, whereby the post may accept a lock such that the first object and the second object may be secured together.

The at least one aperture may be a plurality of apertures and the length of the locking device may be adjusted by positioning the second hook over the post through different apertures.

The locking device may include additional features, such as being of a thickness to fit between the vertical lockrod and door of a typical container locking system.

In accordance with an additional aspect of the present invention, where a link system for connecting at least one securing member with a locking device having a body and a shackle is disclosed, the link may comprise a base having a post with a through hole adapted to receive the shackle of a locking device, a plate adapted to fit against the base, the plate comprising an aperture through which the post of the base may be inserted, a first securing element associated with the base, the first securing element adapted to receive a first securing member, wherein the base and the plate are constructed and arranged so that the shackle of a lock may be inserted through the through hole of the post after the plate is fitted against the link such that the plate blocks the first securing member from being separated from the securing element and the shackle blocks the plate from being released from against the base.

The link system may therefore be adapted for use with a U-shackle padlock, straight shackle padlock, circular shackle padlock, or the like.

In accordance with additional aspects of the present invention, a device may be adapted to connect a first securing member to a second securing member, the device may comprise a link having a base with an interrupted raised lip forming an internal cavity, the base having a hasp extending into the internal cavity, the hasp having a through hole, and the raised lip having interrupted areas. A first securing element may be associated with the base at a first interrupted area, the first securing element may be adapted to secure a first securing member. A second securing element may be associated with the base at a second interrupted area, the second securing element may be adapted to secure a second securing member. The device may also include a lock having a shackle and a body, the lock may be adapted to be fitted within the internal cavity such that the shackle may be inserted through the through hole of the hasp with the body inhibiting the first and second securing members from being disassociated with the first and second securing elements.

The internal cavity may be circular and the lock may be a hockey puck style lock.

The first securing element may be one of a post or an ear.

The device may further comprise a lock retention component associated with the raised lip, the lock retention component retaining the lock within the internal cavity and arranged such that the lock may move between a first position in which the lock is positioned against the lock retention component and the first and second securing members are free to be associated or disassociated with the first and second securing elements, and a second position in which the lock is positioned against the base such that the body of the lock inhibits the first and second securing members from being associated or disassociated with the first and second securing members.

The lock retention component may be one of a pin or a retaining ring.

The device may further comprise a retaining mechanism for retaining the first securing member to the link when the lock is in the first position. The retaining mechanism may be a set screw.

In accordance with further aspects of the present invention, a link may be adapted to secure an attachment mechanism having a straight segment, the straight segment having an engagement element for engagement with the link, where the link may comprise a base having a raised lip forming an internal cavity, the base having a hasp extending into the internal cavity, the hasp having a through hole, the base also having a shaft extending into the base from the internal cavity and an aperture extending through an external wall of the base, the aperture being in communication with the shaft, and the aperture adapted to receive the straight segment of the attachment mechanism. The device may also comprise a plate having an aperture through which the hasp may be fitted, the plate further comprising a pin adapted to fit within the shaft of the base when the plate is against the base, wherein a lock having a shackle may be positioned within the cavity such that the plate is against the base and the pin is within the shaft the pin associating with the engagement element of the attachment mechanism to prevent translation of the attachment mechanism through the aperture.

The engagement element of the attachment mechanism may be one of a notch or a channel.

The link may further comprise a spring recess adjacent to the shaft and a spring adapted to fit within the spring recess when compressed, the spring may be adapted to lift the plate off the surface of the base when uncompressed.

The straight segment of the attachment mechanism may completely penetrate through the link, the straight segment having an end with a restrictive element preventing the attachment mechanism from being withdrawn completely from within the base. The restrictive element may be removable to permit the attachment mechanism to be withdrawn completely from within the base.

The link may further comprise a mechanism to impair movement of the shackle when the shackle is within the cavity regardless of the position of the pin. The mechanism to impair movement may comprise a channel formed within the base, a spring having two ends positioned within the channel and a displaceable element associated with one end such that the displaceable element may engage the engagement element of the attachment mechanism to impair translation of the attachment mechanism. The displaceable element may be a ball bearing.

In accordance with other aspects of the present invention, a system for securing a spaced-apart door locking device having a pair of vertical lockrods hinged to a pair of handles adapted to rotate the lockrods to unlock a pair of doors, may comprise a strap with a cover and a base, the base having a base main portion with a hasp and a base finger portion with a pair of spaced-apart fingers, the fingers being curved back toward the base main portion, the cover having a cover main portion with an aperture and a cover finger portion with a pair of spaced-apart fingers, the fingers being curved back toward the cover main portion, wherein the fingers of the base may be wrapped at least partially around a first of the vertical lockrods such that the base main portion is adjacent to the doors and the fingers of the cover may be at least partially wrapped around a second of the vertical lockrods such that the cover main portion sandwiches the base main portion between the cover main portion and the door, the hasp penetrating the aperture.

The system may further comprise a third finger associated with the main portion of the base, the third finger adapted to fit within the spaced-apart fingers of the cover to engage the second vertical lockrod.

The system may further comprise a stop-block associated with the finger portion of the base, the stop block adapted to prevent bending of the first vertical lockrod. A straight finger may be associated with the finger portion of the base, the straight finger positioned between the spaced-apart fingers.

The main portion and the finger portion of the base may be separate components, and the overall length of the base may be adjustable. The finger portion of the base may further comprise a grooved segment and the main portion may comprise a corresponding grooved segment, the grooved segment and the corresponding grooved segment capable of association to fix the overall length of the base.

The cover and the base may be non-linear such that portions of the cover and the base are offset toward the door.

The cover may further comprise a protective shroud covering the hasp of the base when associated with the cover. The protective shroud may comprise a generally open end and a generally closed end, the generally open end adapted to permit entry of a lock having a body and a shackle and the generally closed end permitting entry of the shackle. The protective shroud may include a permanently mounted therein.

In accordance with additional aspects of the invention, a system is disclosed for further securing a door locking mechanism having a handle hinged to a vertical lockrod and a hasp connected to the door, where the system may comprise a link having a base with a raised lip forming an internal cavity, the base having an aperture through which the door hasp may extend, an extension member associated with the base, the extension member having an oversized aperture adapted to permit passing of the handle, wherein the handle may be passed through the aperture and a lock may be inserted into the internal cavity and engaged with the hasp to secure the handle. The link may include a groove-within which the hasp of the door may fit to permit the base to be flush with the door.

More specifically, in accordance with one aspect of the present invention, the invention may include a link for connecting at least one securing member with a locking device having a body and a shackle, the link comprising a base having a through hole adapted to receive the shackle of a locking device, and a first securing element associated with the base, the first securing In accordance with a further aspect of the present invention a security link is provided for securing a component of a securing member with a blocking element not being a shackle, comprising a body with a surface having a first opening and a second opening that are connected, wherein the first opening is adapted not to pass the component of the securing member and the second opening is adapted to receive the blocking element for blocking access by the securing member from the first opening to the second opening.

In accordance with yet a further aspect of the present invention a security link is provided, wherein the securing member can be removed from the first opening when the blocking member is not in the second opening.

In accordance with yet a further aspect of the present invention a security link is provided, further comprising a hasp being able to receive a shackle of a lock to secure the blocking element in the second opening of the security link.

In accordance with yet a further aspect of the present invention a security link is provided, wherein the component of the securing member is not directly captured by a shackle of a lock.

In accordance with yet a further aspect of the present invention a security link is provided, wherein the blocking element is a hidden shackle padlock.

In accordance with yet a further aspect of the present invention a security link is provided, wherein the blocking element is a security link adaptor.

In accordance with yet a further aspect of the present invention a security link is provided, wherein the component of the securing member has to be moved through the second opening before it can enter the first opening.

In accordance with yet a further aspect of the present invention a security link is provided, wherein a dimension of the second opening is based on a dimension of a lock.

In accordance with yet a further aspect of the present invention a security link is provided, wherein the securing member is a chain.

In accordance with yet a further aspect of the present invention a security link is provided, further comprising one or more additional openings, each of the additional one or more openings being enabled to receive a component of a securing member, the component of the securing member in each of the additional one or more openings being secured when the lock is secured in the second opening.

In accordance with yet a further aspect of the present invention a security link is provided, further comprising a third opening, connecting with the second opening forming an arm by the body of the security link and the first, the second and the third opening, wherein the arm is enabled to receive the component wherein the component forms a loop, and wherein the blocking element blocks access by the securing member from the third opening to the second opening.

In accordance with yet a further aspect of the present invention a security link is provided, wherein the security link is part of a kit including also at least one element of the group consisting of the elements of packaging, mounting hardware, a securing member, a lock, a security link adaptor, a user manual and an installation manual.

In accordance with yet another aspect of the present invention a security link is provided with a lock, the lock having a body and a shackle, the security link comprising a tubular body with a surface, the surface including a first and a second opening, the first and second opening being connected, wherein the first opening is adapted to secure a blocking body to block the securing member from being removed from the second opening, the securing member can be removed from the second opening when the blocking body is not in the first opening, and the securing member is not directly captured by a shackle of a lock.

In accordance with yet another aspect of the present invention a security link is provided with a lock, the lock having a body and a shackle, further comprising a hasp being able to be captured by the shackle of the lock to secure the blocking body in the first opening.

In accordance with yet another aspect of the present invention a security link is provided with a lock, the lock having a body and a shackle, wherein the blocking body is a hidden shackle padlock.

In accordance with yet another aspect of the present invention a security link is provided with a lock, the lock having a body and a shackle, wherein the securing member is a chain.

In accordance with yet another aspect of the present invention a security link is provided with a lock, the lock having a body and a shackle, further comprising one or more additional openings through the body of the security link, each of the one or more additional openings being connected to the second opening and able to secure a component of a securing member when the blocking element is secured in the first opening.

In accordance with yet another aspect of the present invention a security link is provided with a lock, the lock having a body and a shackle, wherein the blocking body is a security link adaptor that can be secured in the first opening by the lock.

In accordance with yet another aspect of the present invention a security link is provided with a lock, the lock having a body and a shackle, wherein the lock is a u-shackle padlock.

In accordance with yet another aspect of the present invention a security link is provided with a lock, the lock having a body and a shackle, wherein the security link is part of a kit that also includes at least one element of the group consisting of packaging, a blocking member, mounting hardware, a security member, the lock, a security link adaptor, a user manual and an installation manual.

In each of these aspects, various features have been disclosed. It will be appreciated that many of the features are interchangeable between the various aspects, and that they may be utilized in various combinations to achieve the inventive results. Accordingly, various combinations of disclosed features may be included in the above aspects of the invention, or additional aspects not specifically described herein, but which are included in this disclosure.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

It is intended that an element in a figure that is identified by a numeral that is used in a previous figure, represents the same element as in the previous figure.

The subject matter regarded as the invention is particularly pointed out and distinctly claimed in the concluding portion of the specification. The invention, however, both as to organization and method of operation, together with features, objects, and advantages thereof will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

Figure 1:
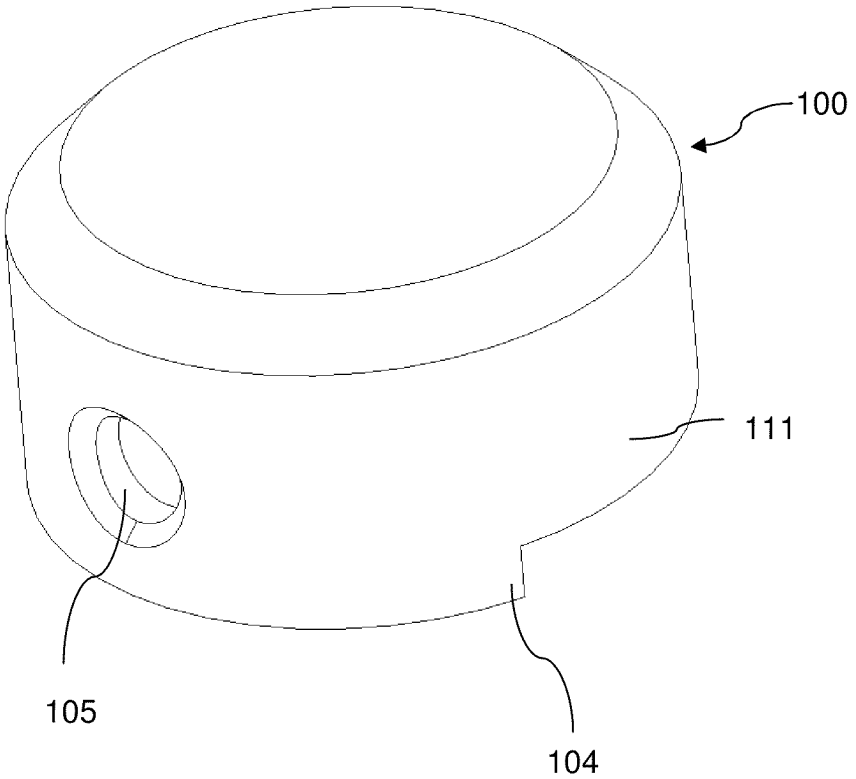
FIG. 1 (prior art)
Figure 2:
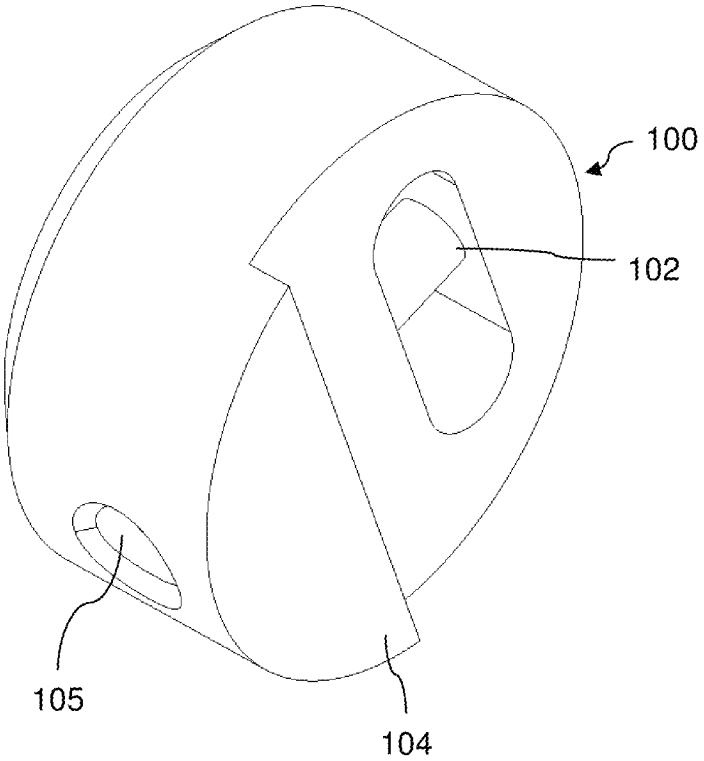
FIG. 2 (prior art)
Figure 3:
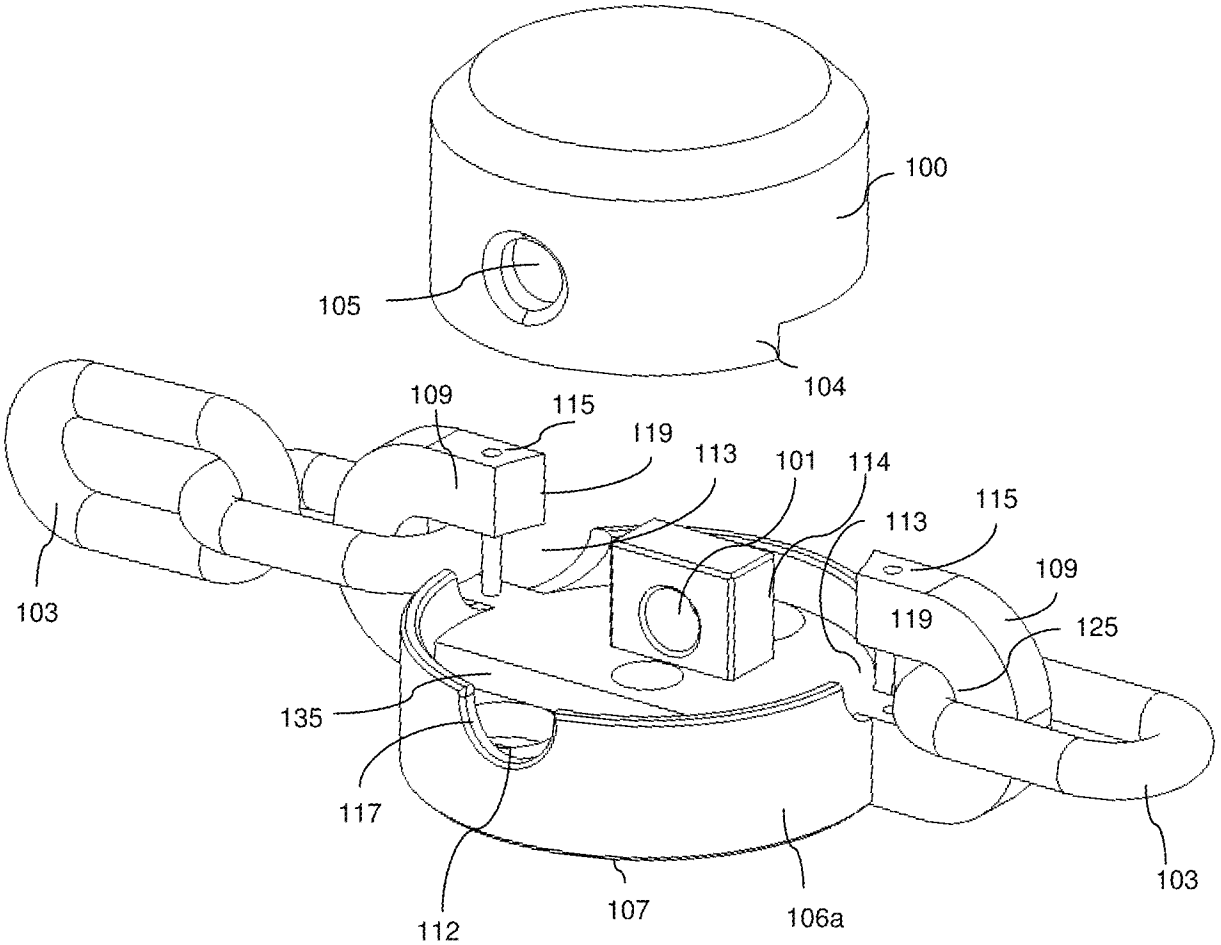
Figure 4:
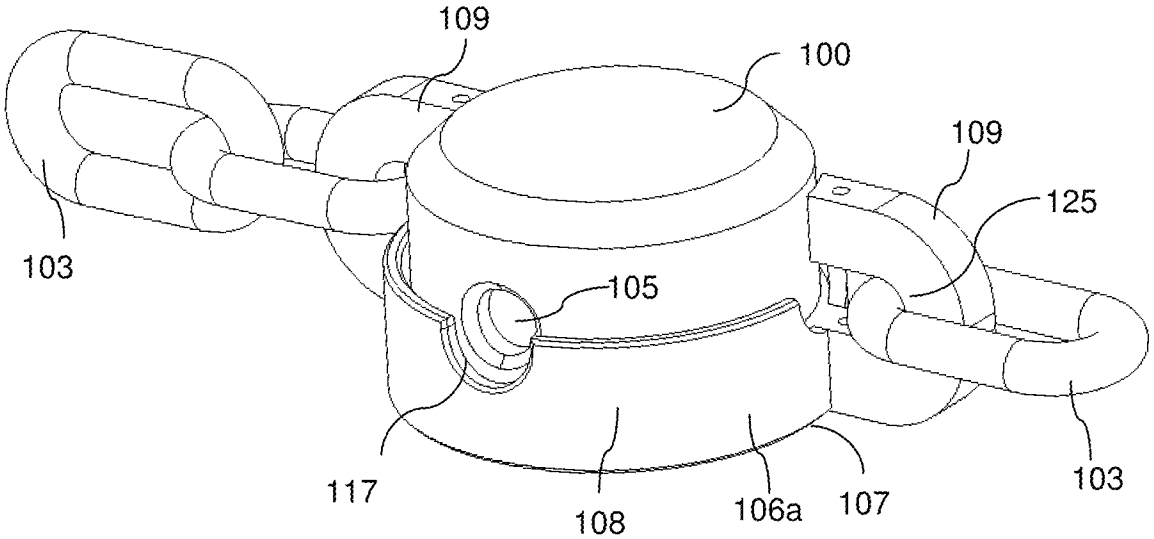
Figure 5:
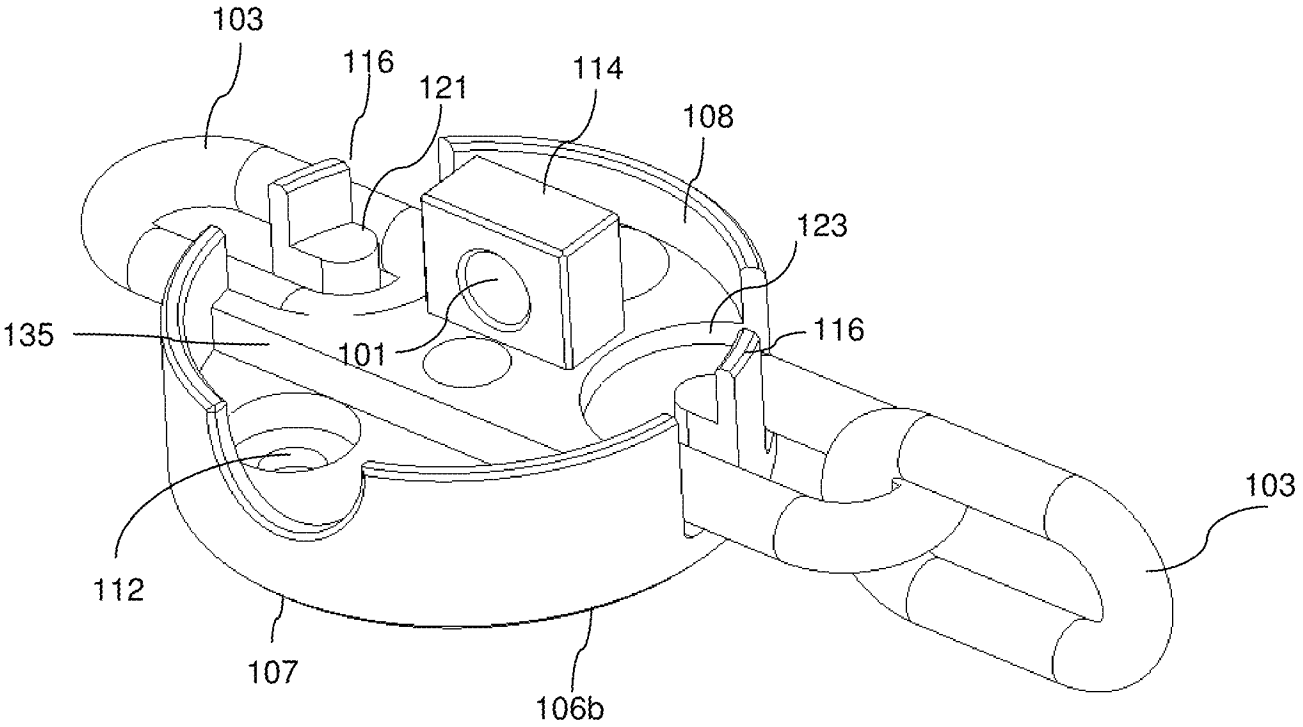
Figure 6:
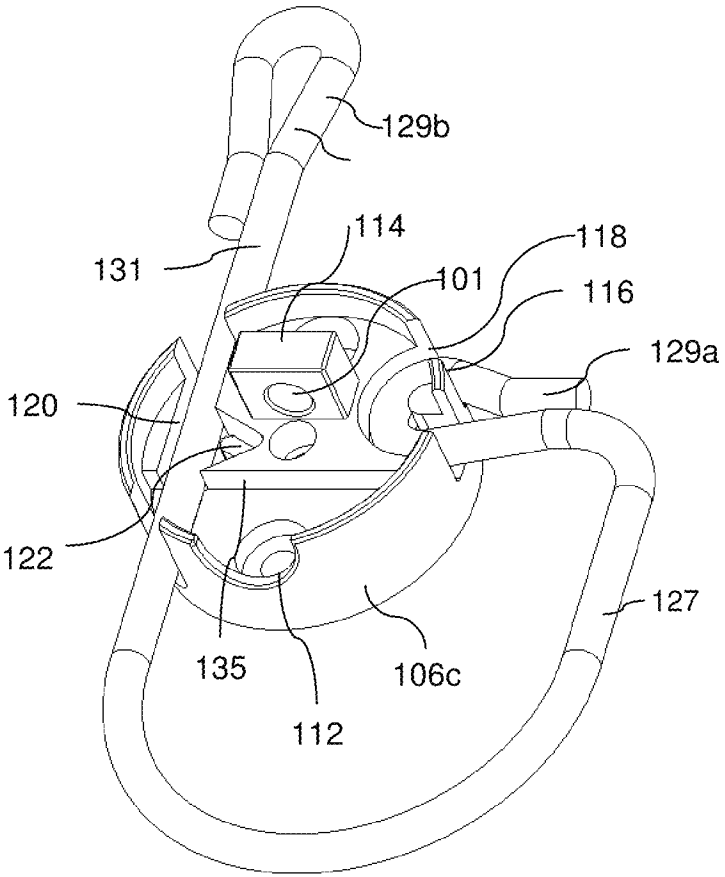
Figure 7:
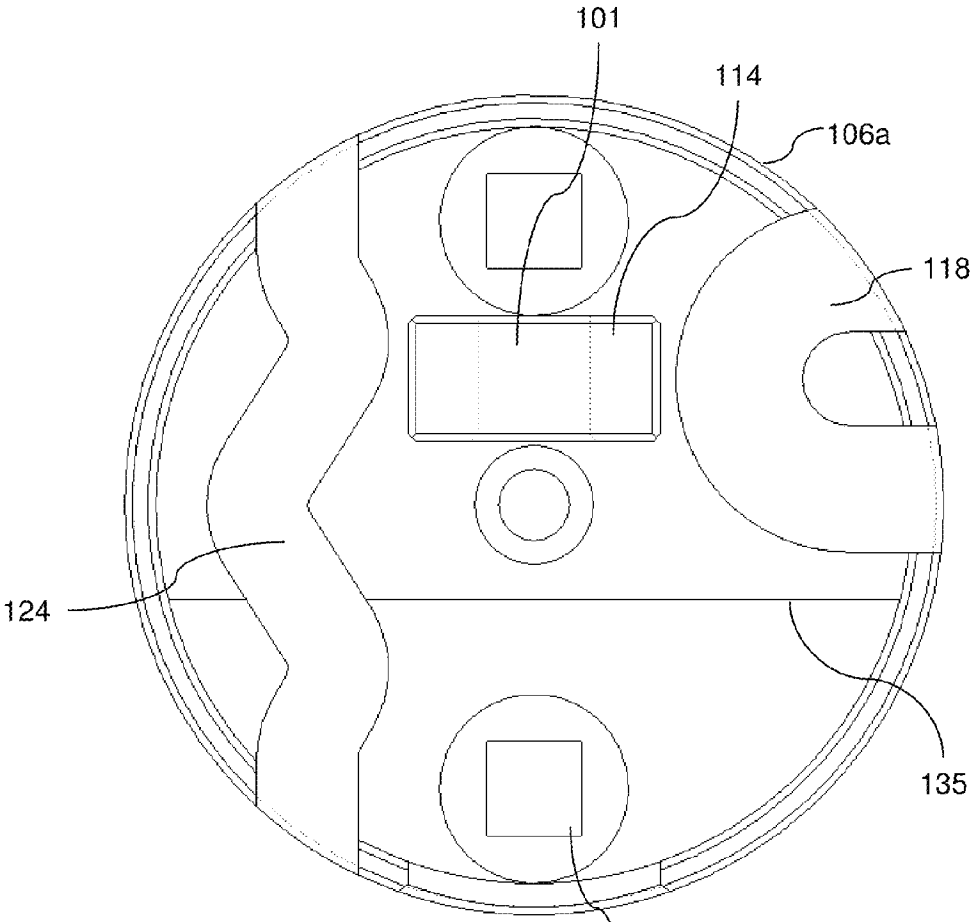
Figure 8:
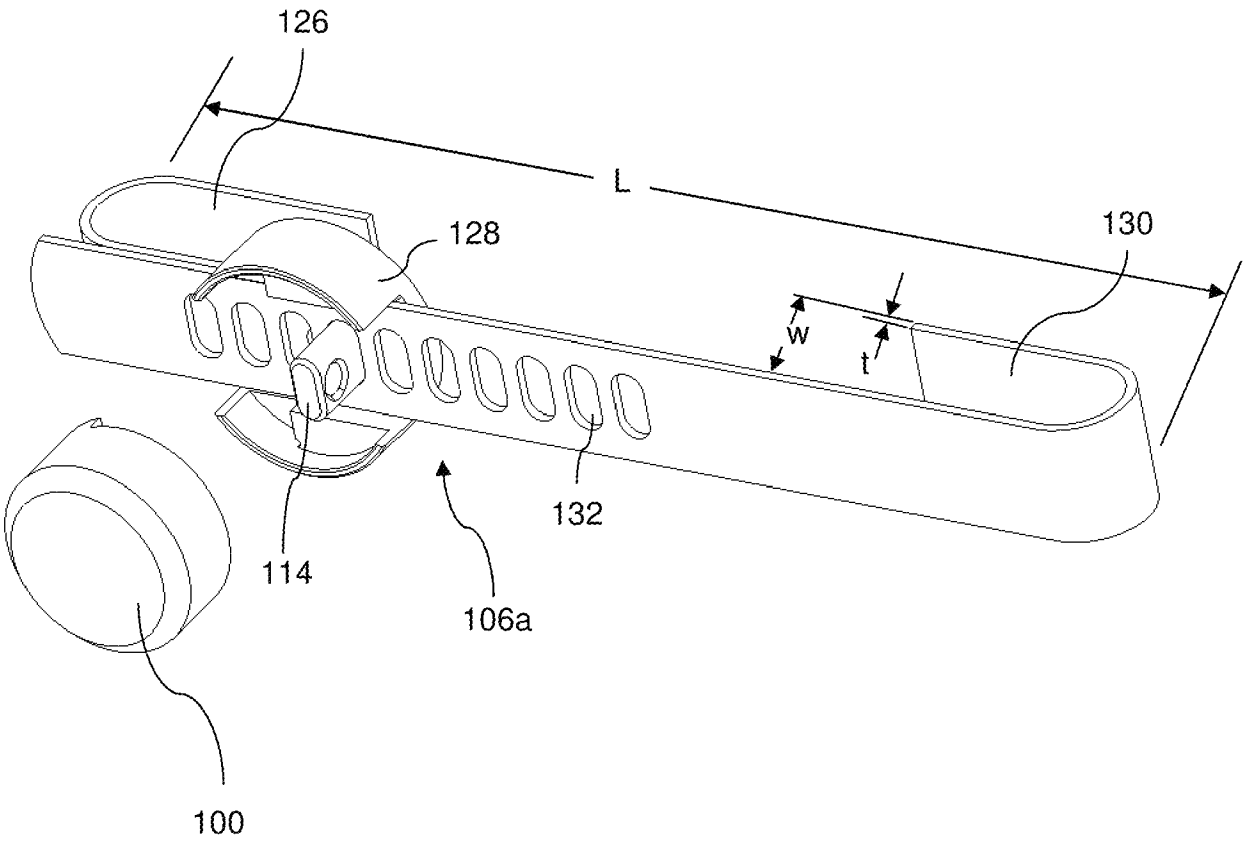
Figure 9:
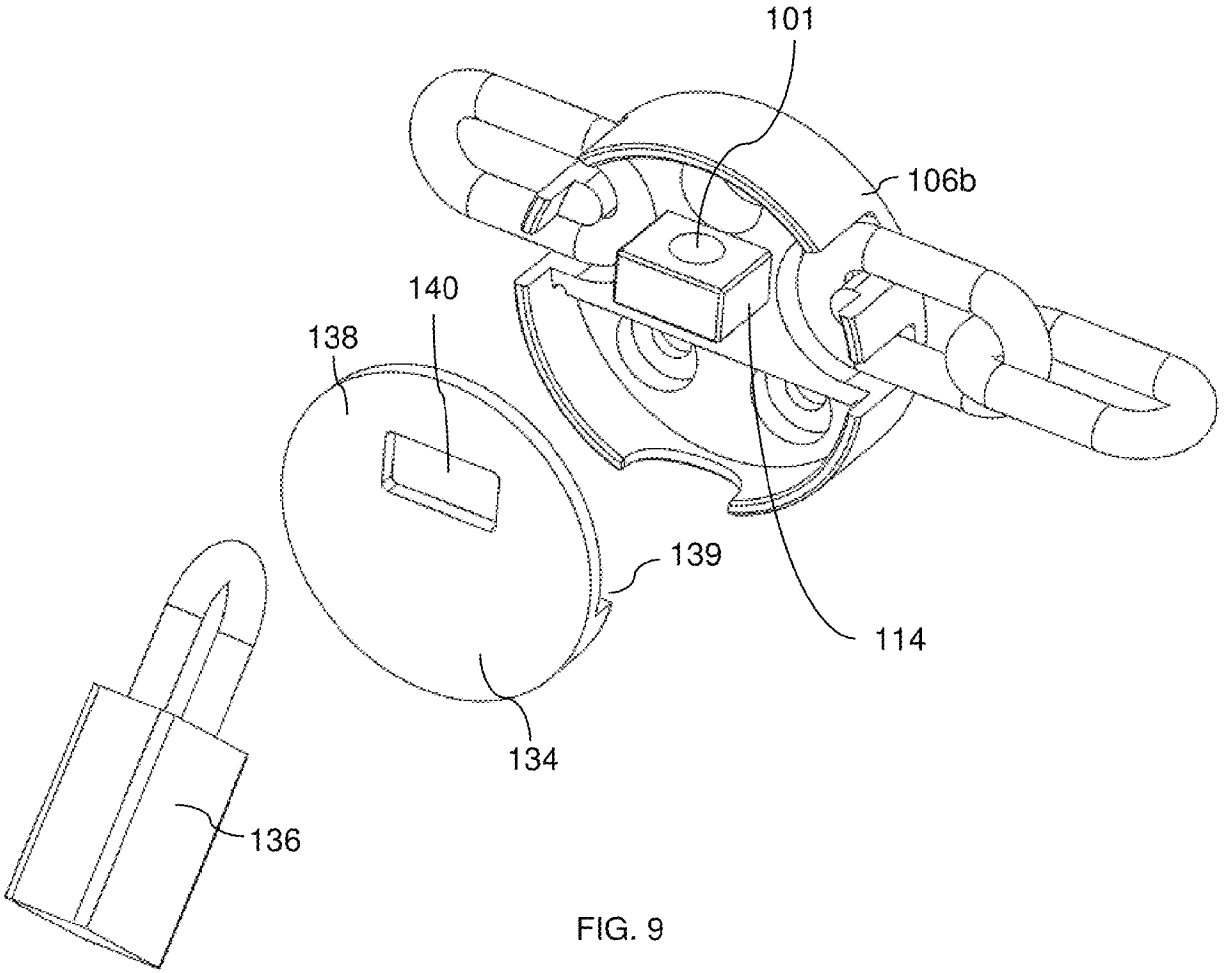
Figure 10:
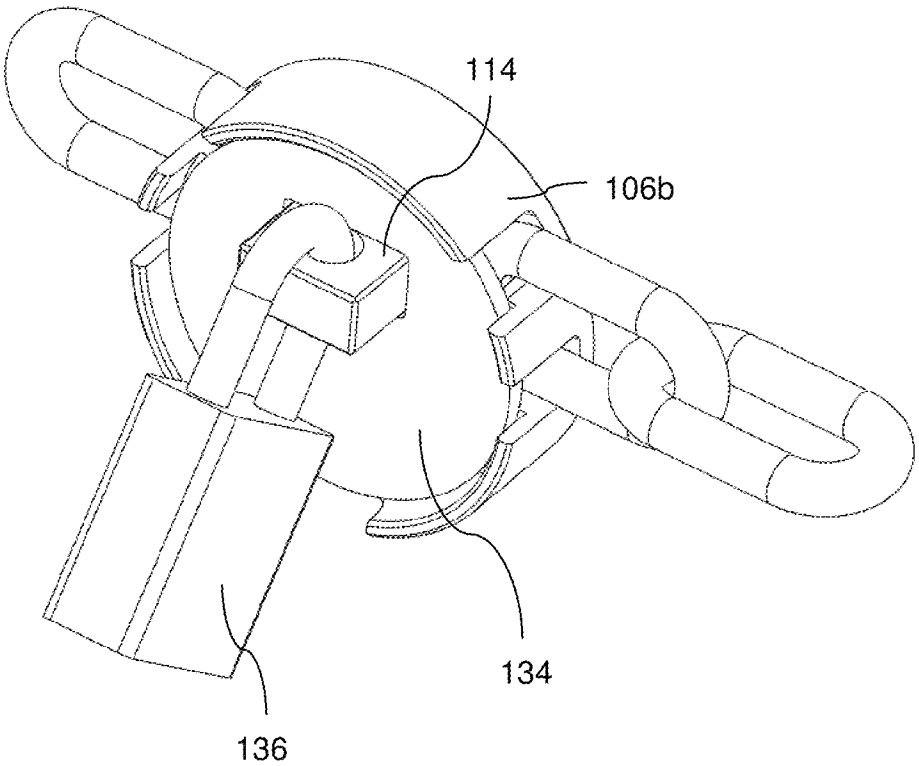
Figure 11:
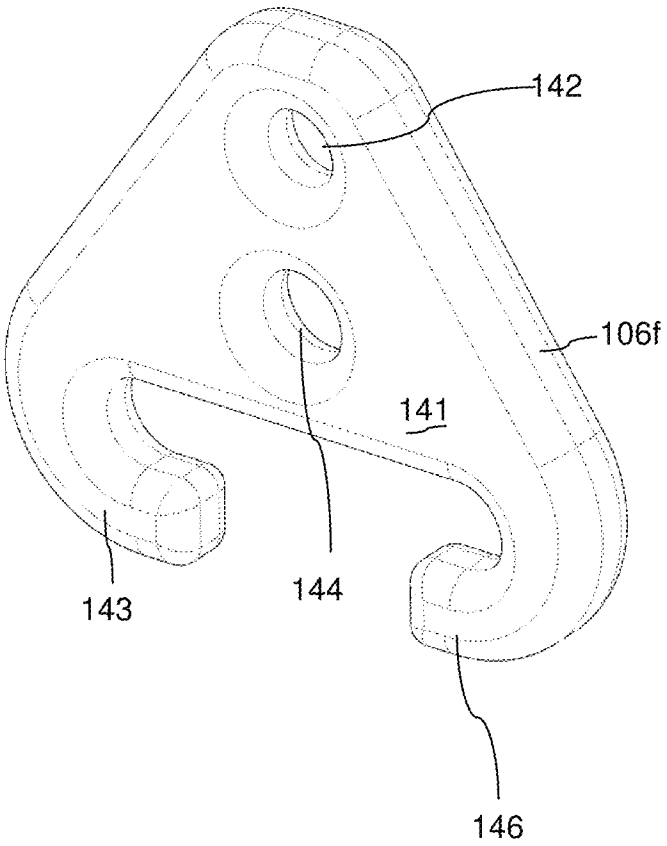
Figure 12:
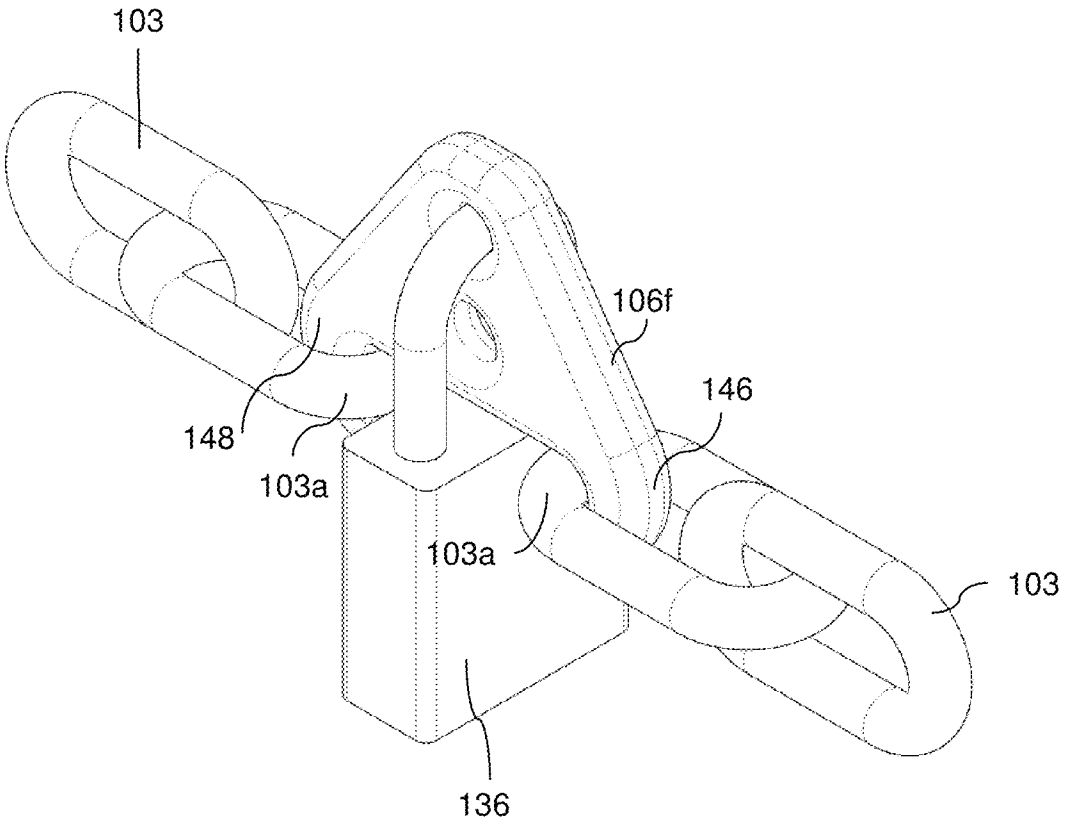
Figure 13:
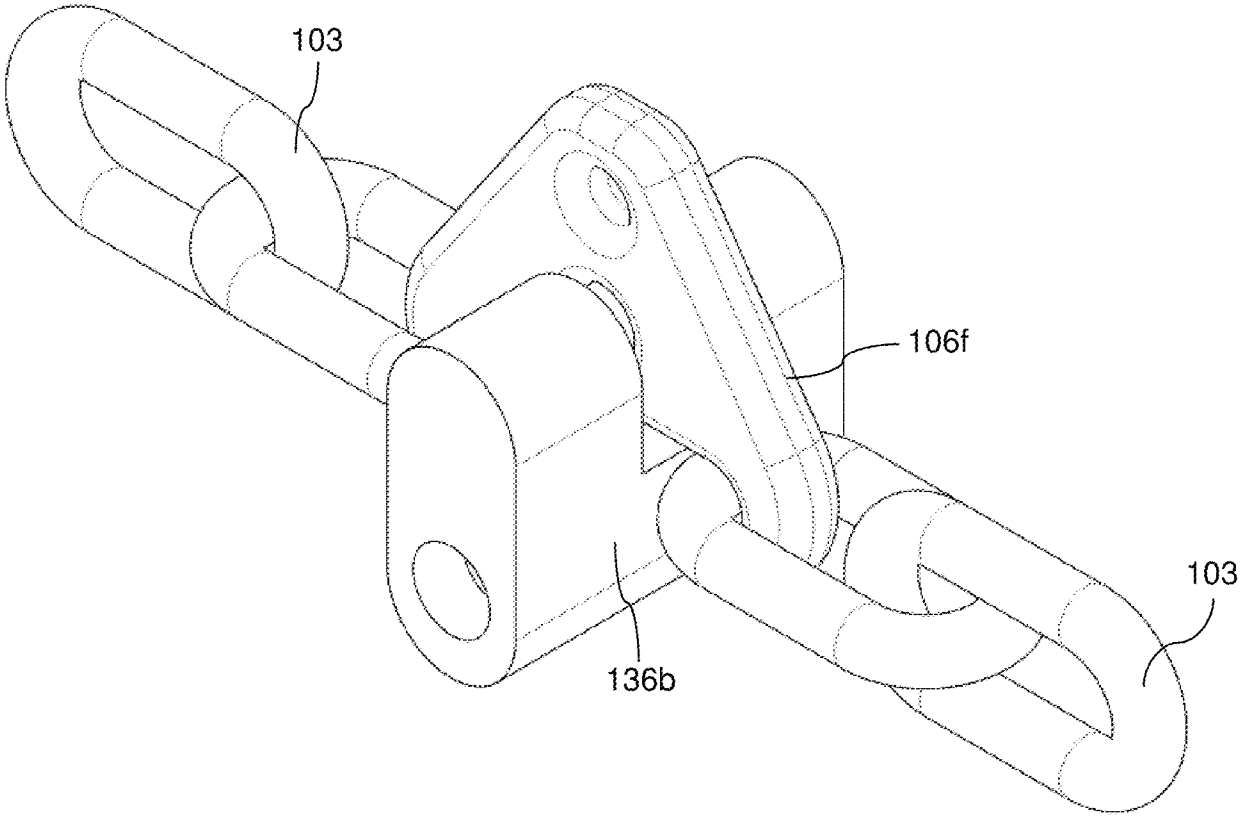
Figure 14:
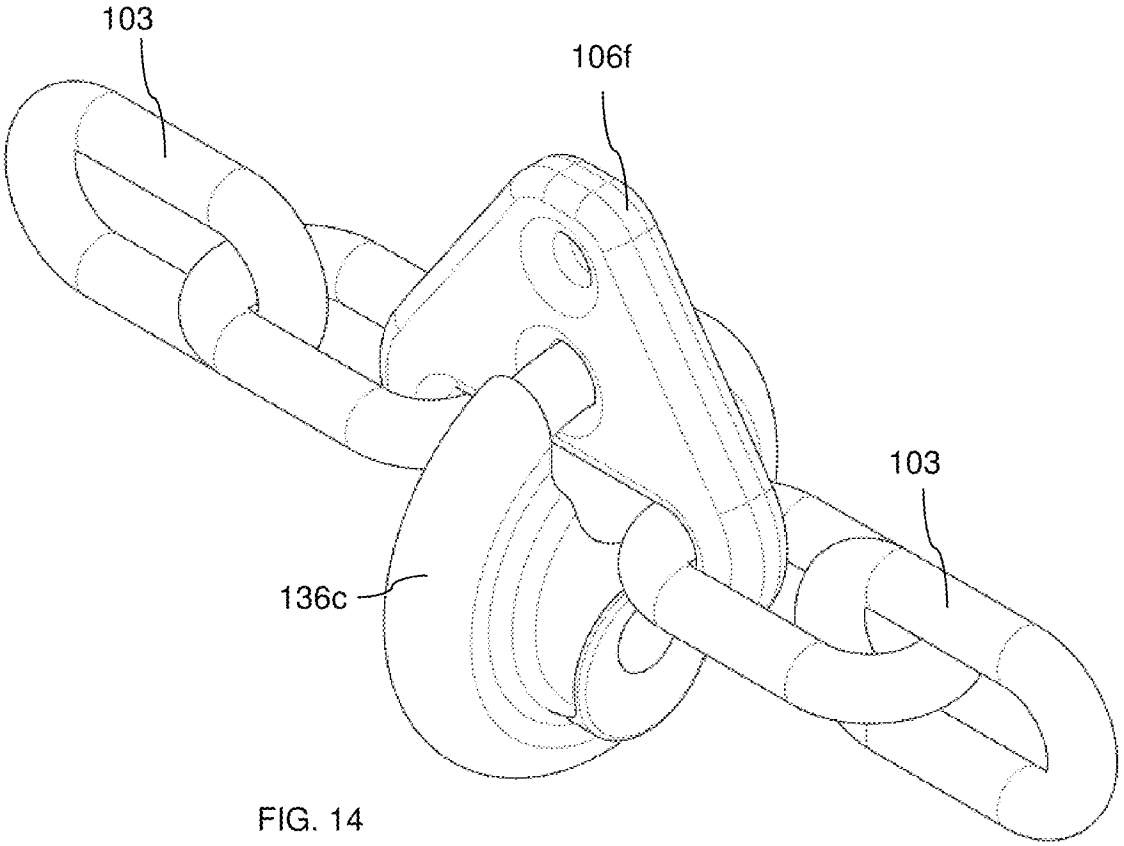
Figure 15:
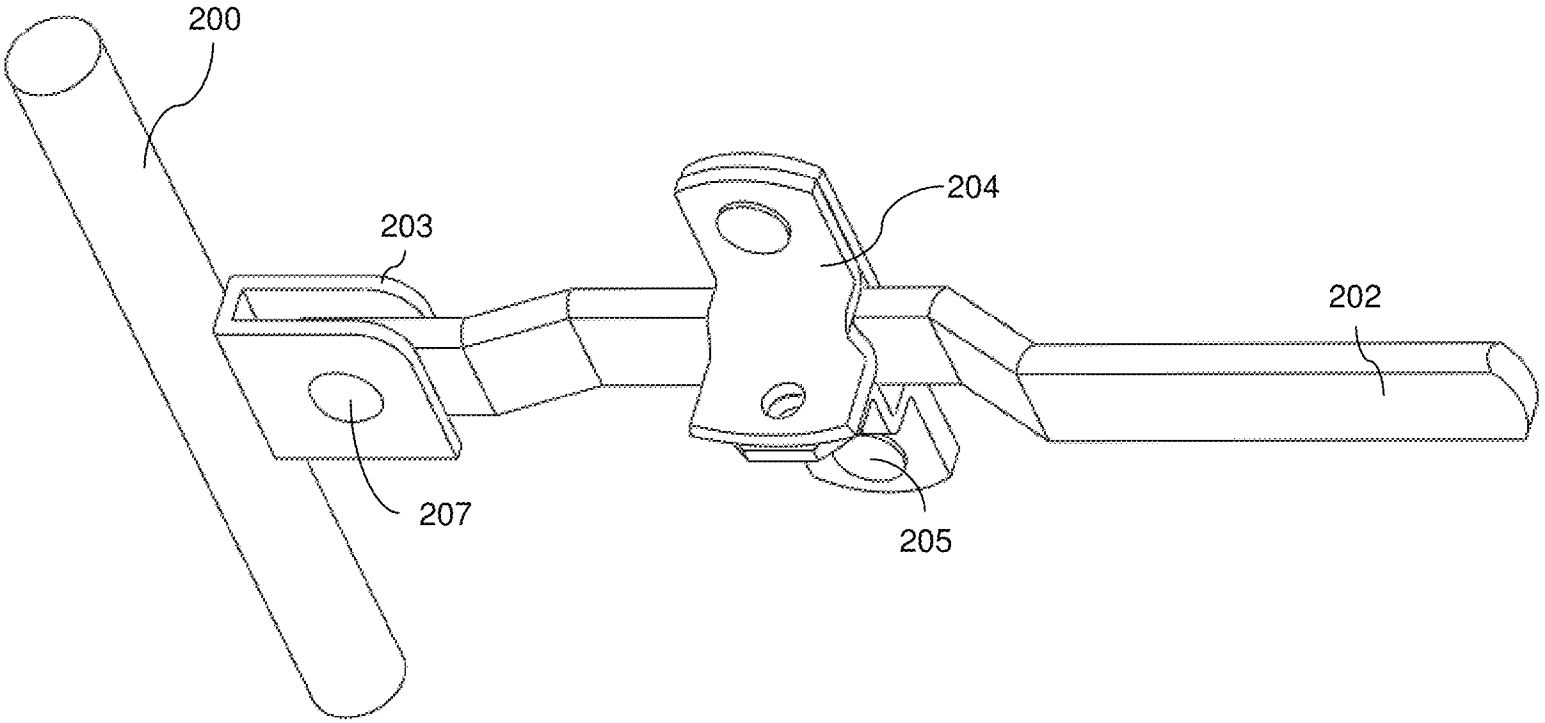
Figure 16:
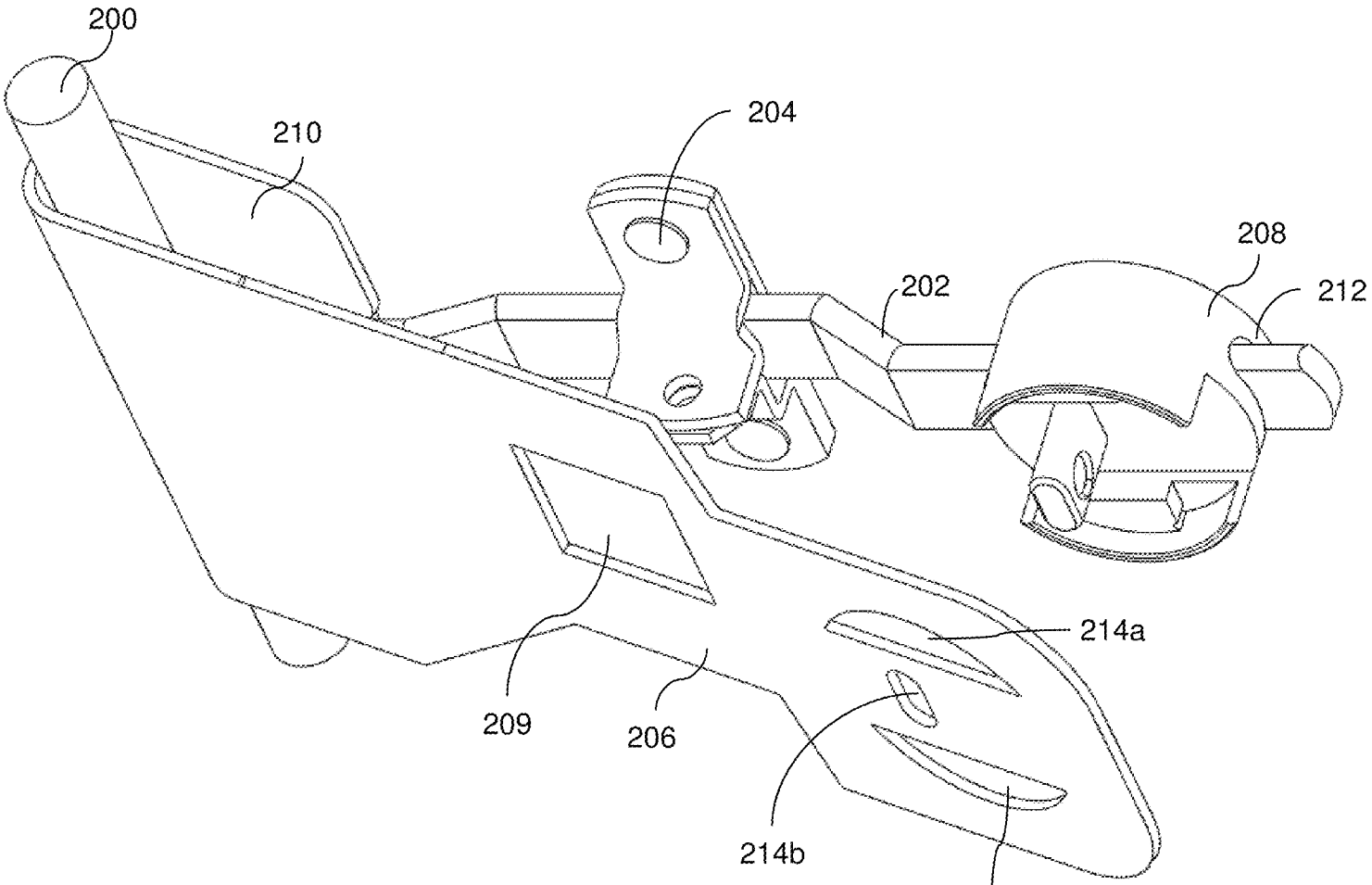
Figure 17:
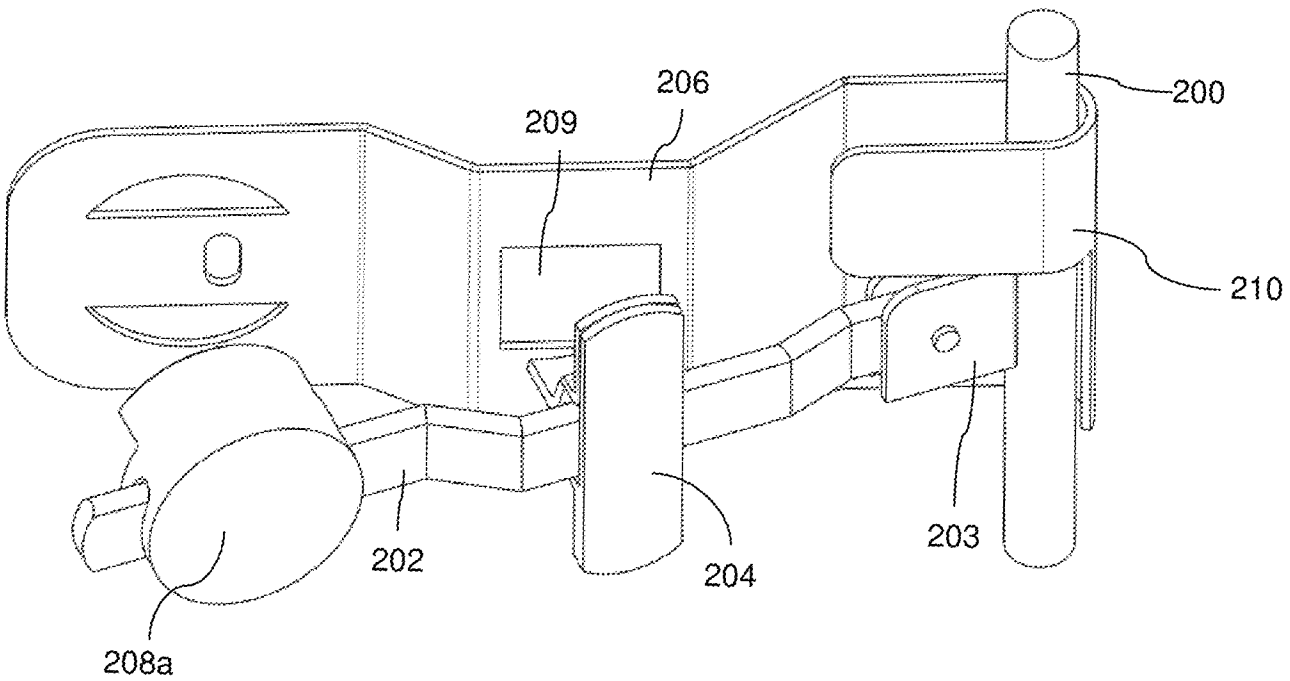
Figure 18:
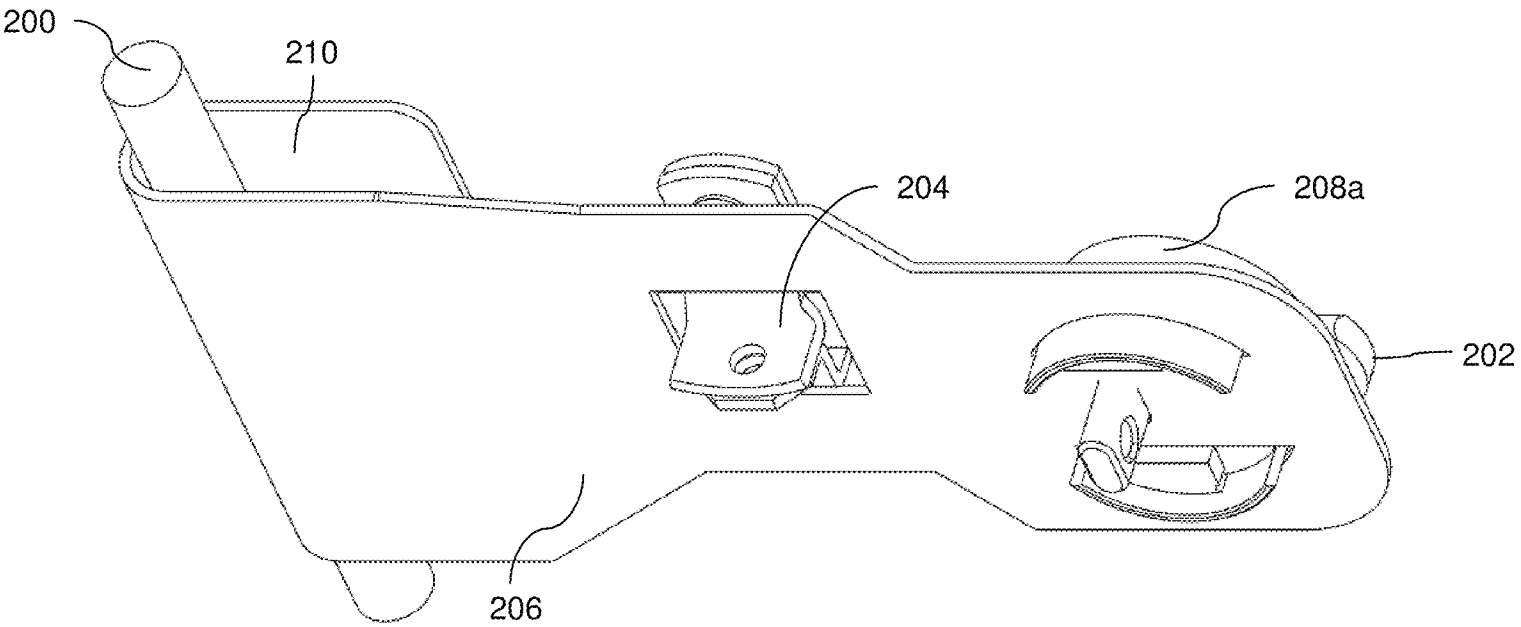
Figure 19:
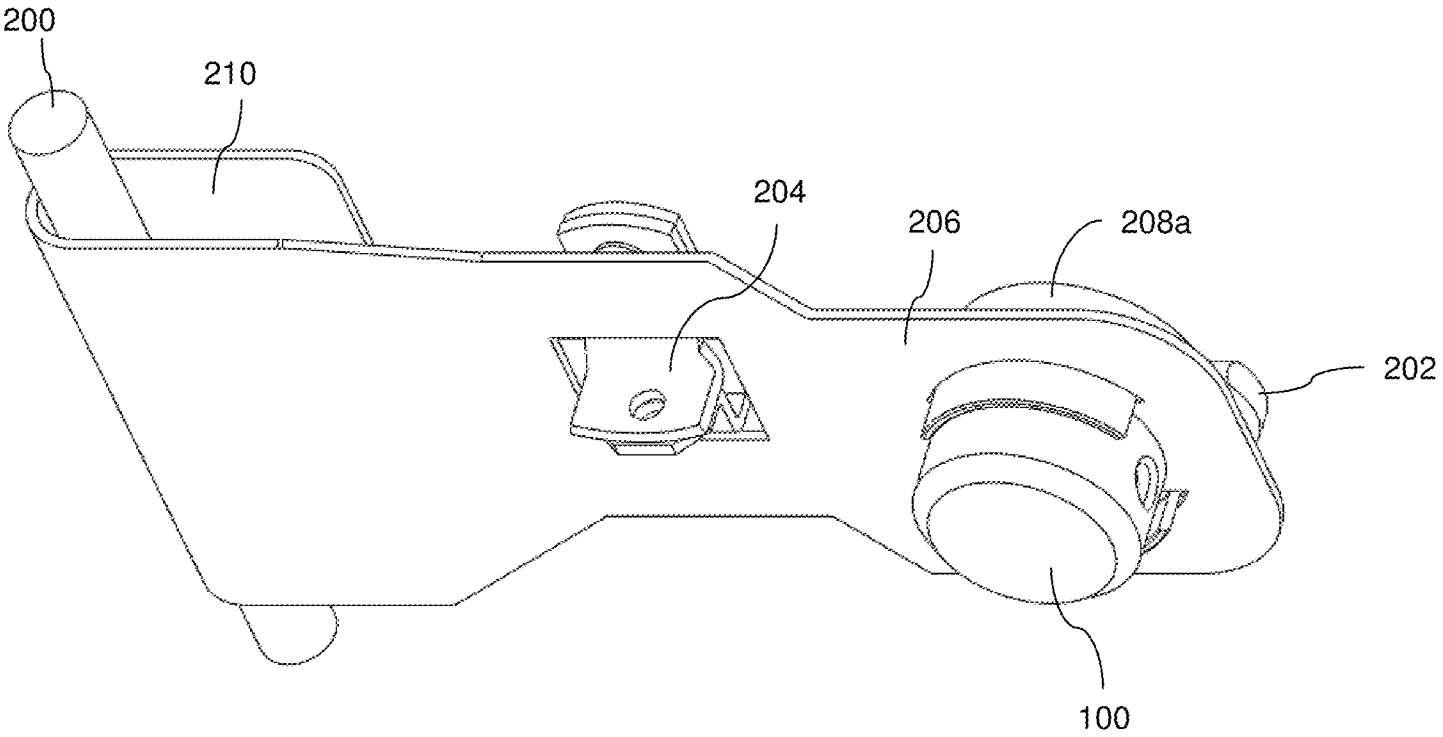
Figure 20:
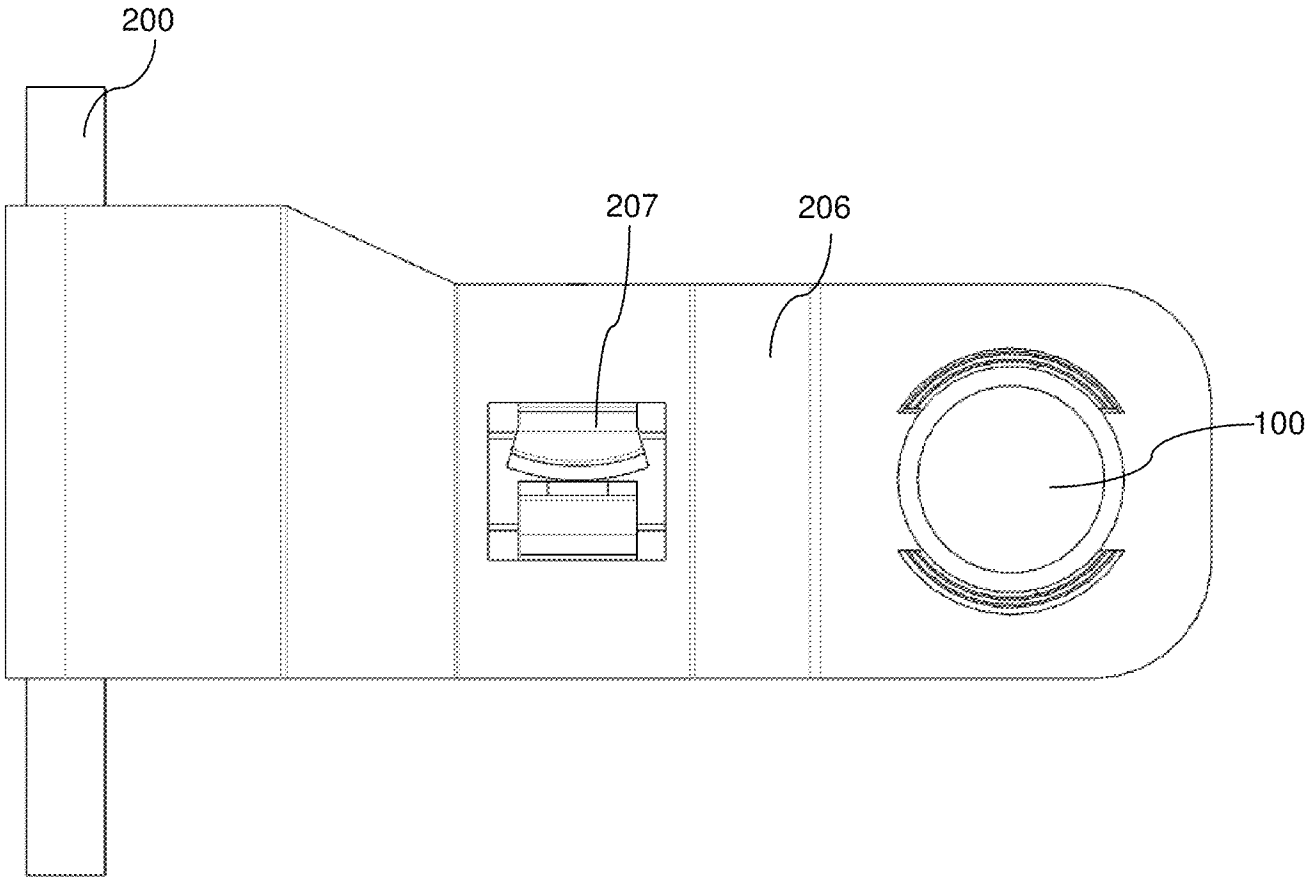
Figure 21:
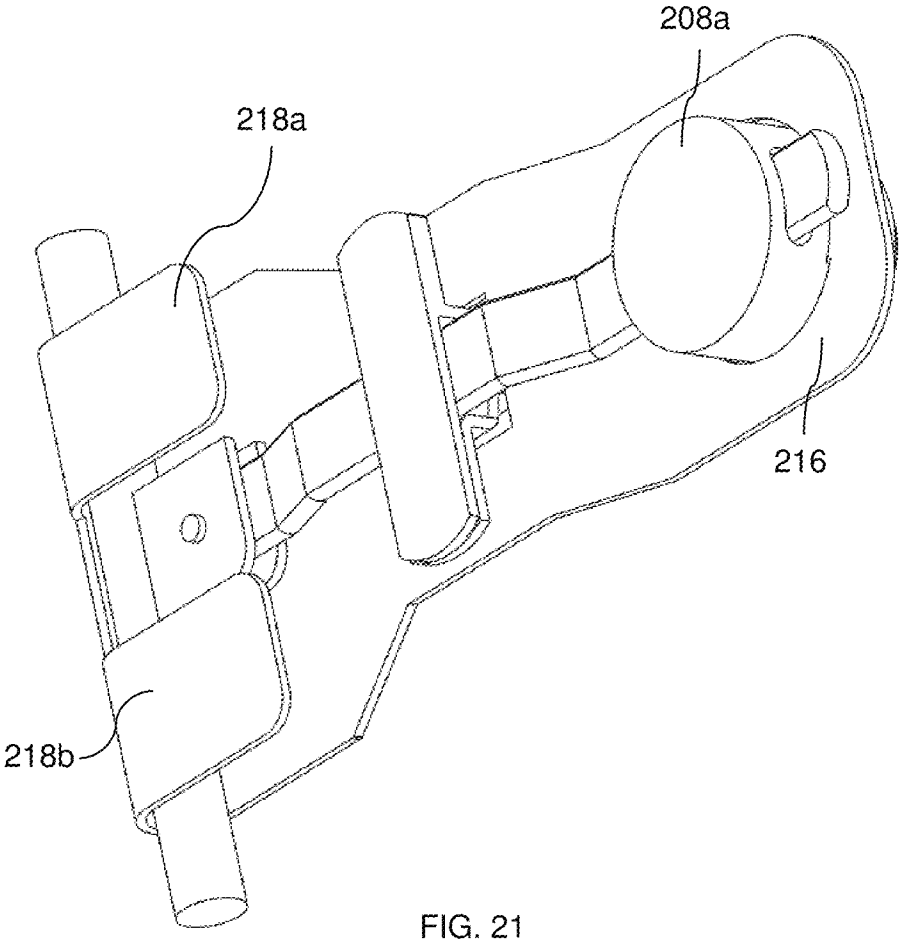
Figure 22:
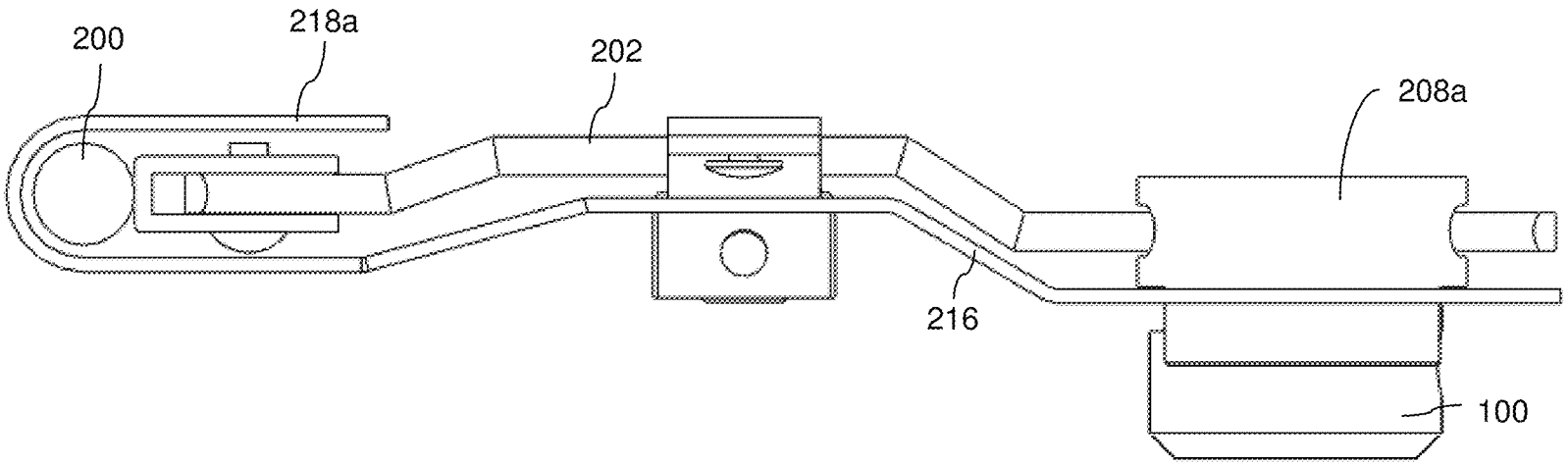
Figure 23:
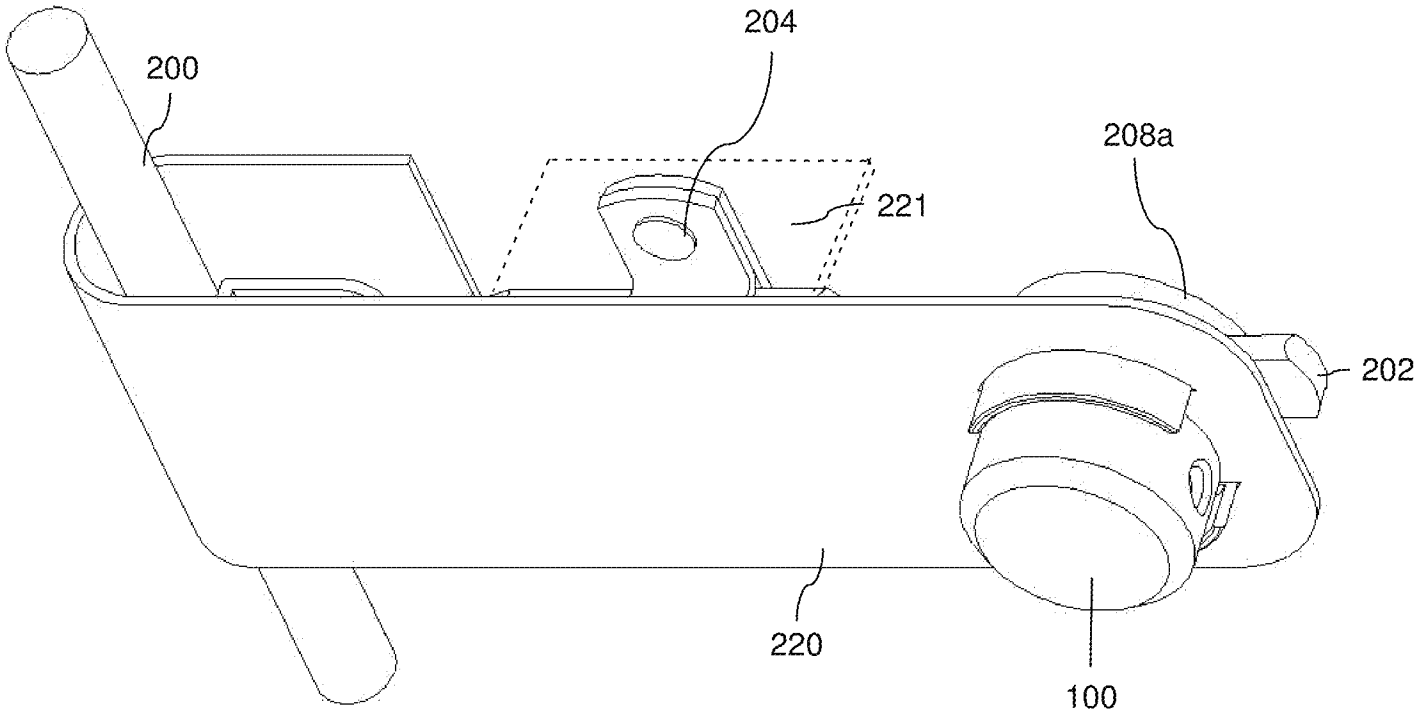
Figure 24:
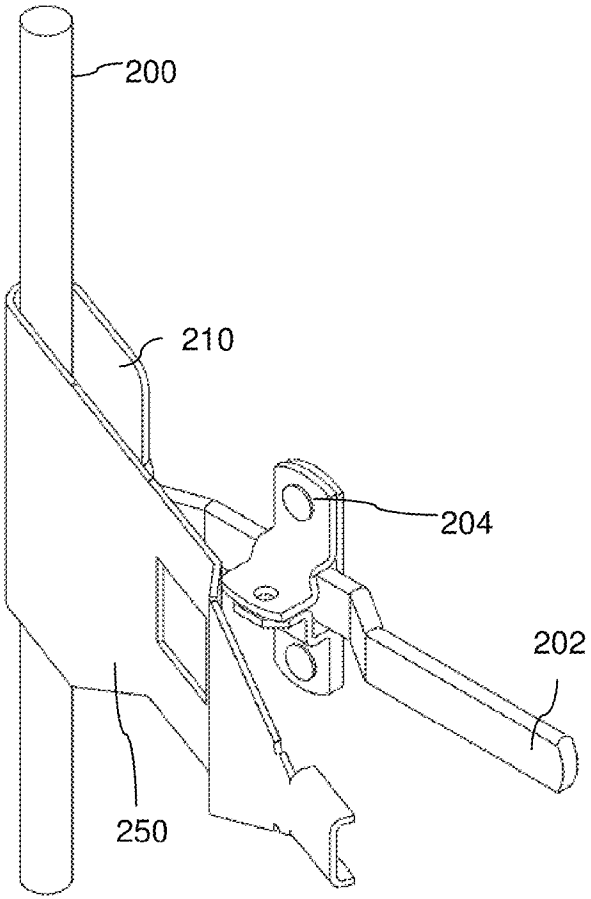
Figure 25:
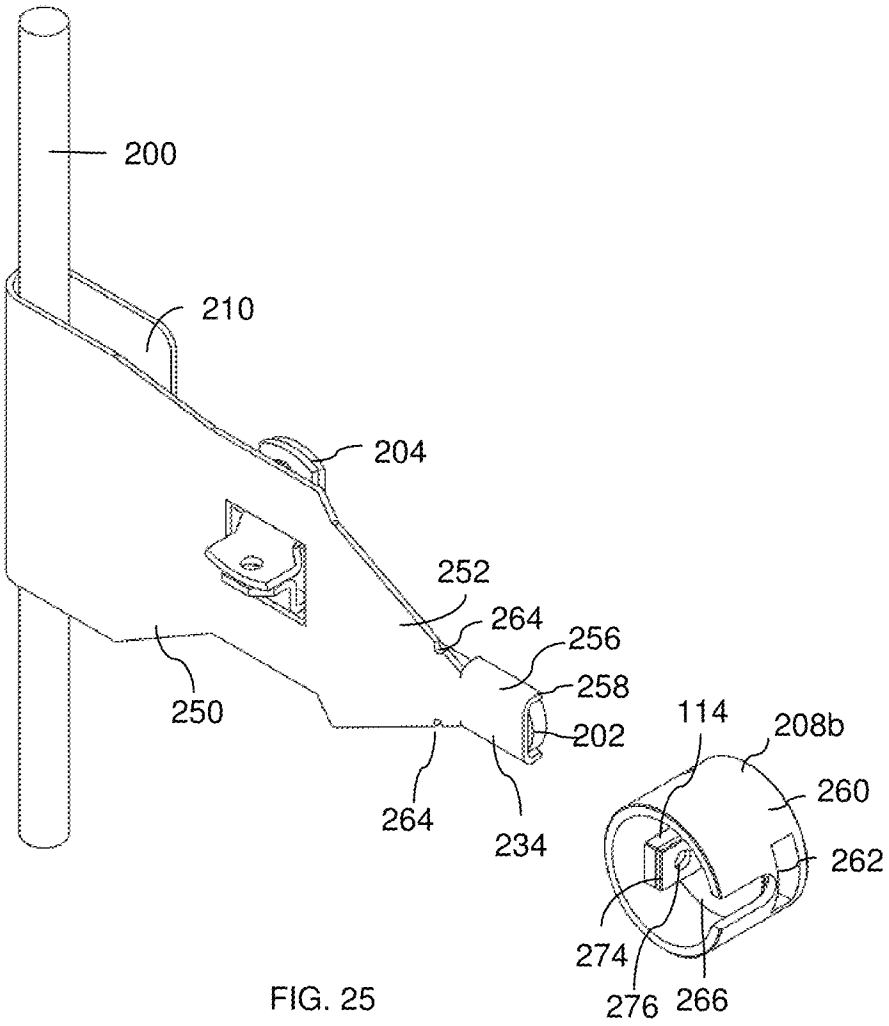
Figure 26:
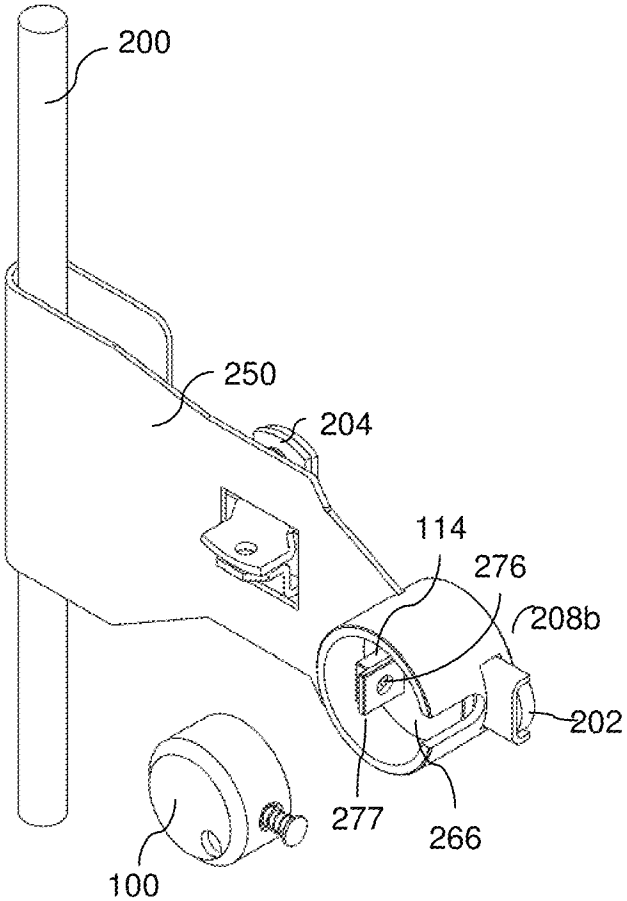
Figure 27:
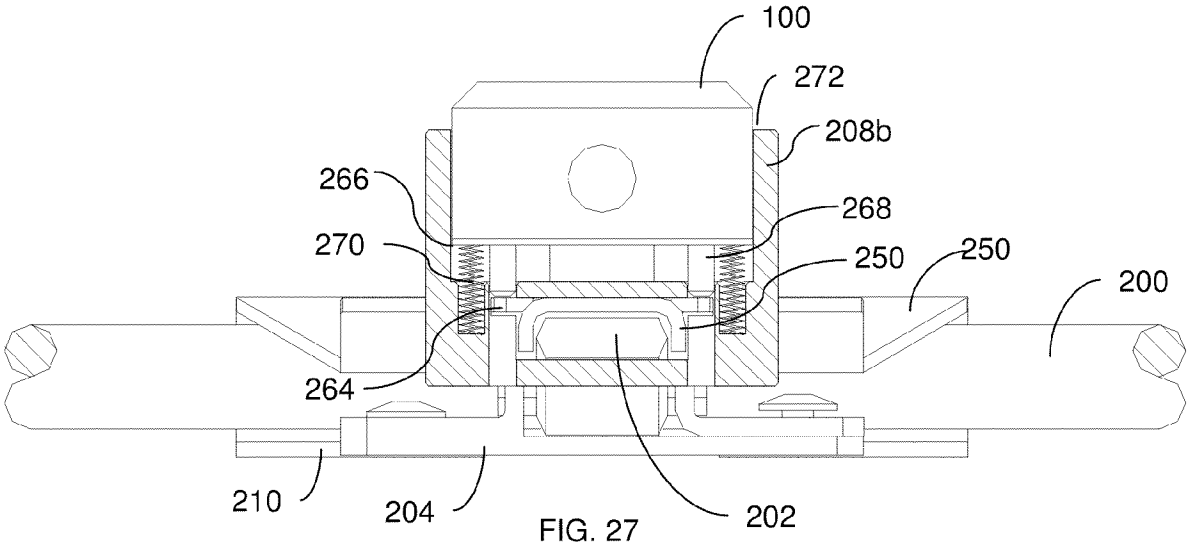
Figure 28:
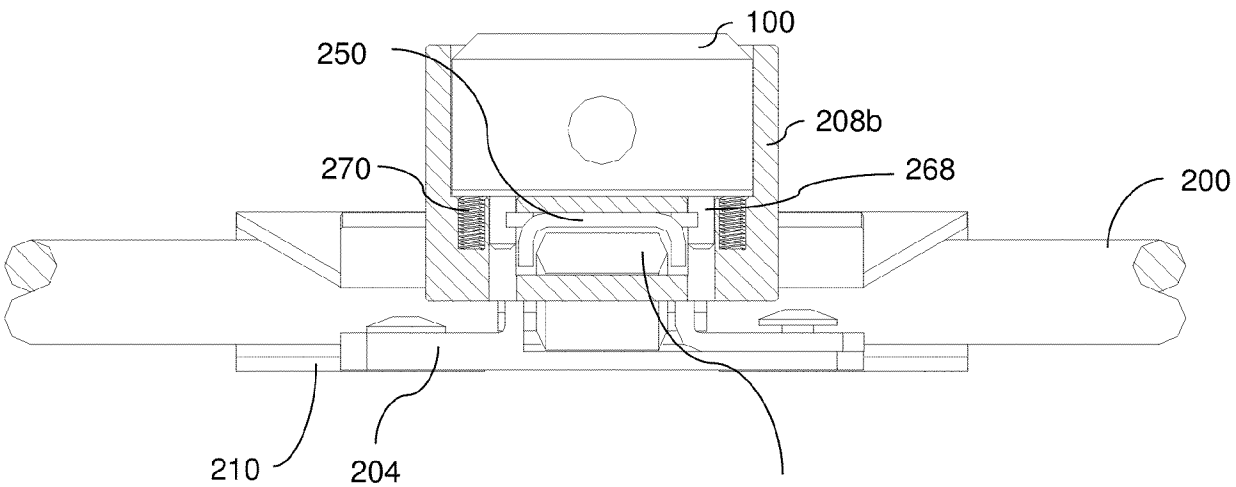
Figure 29:
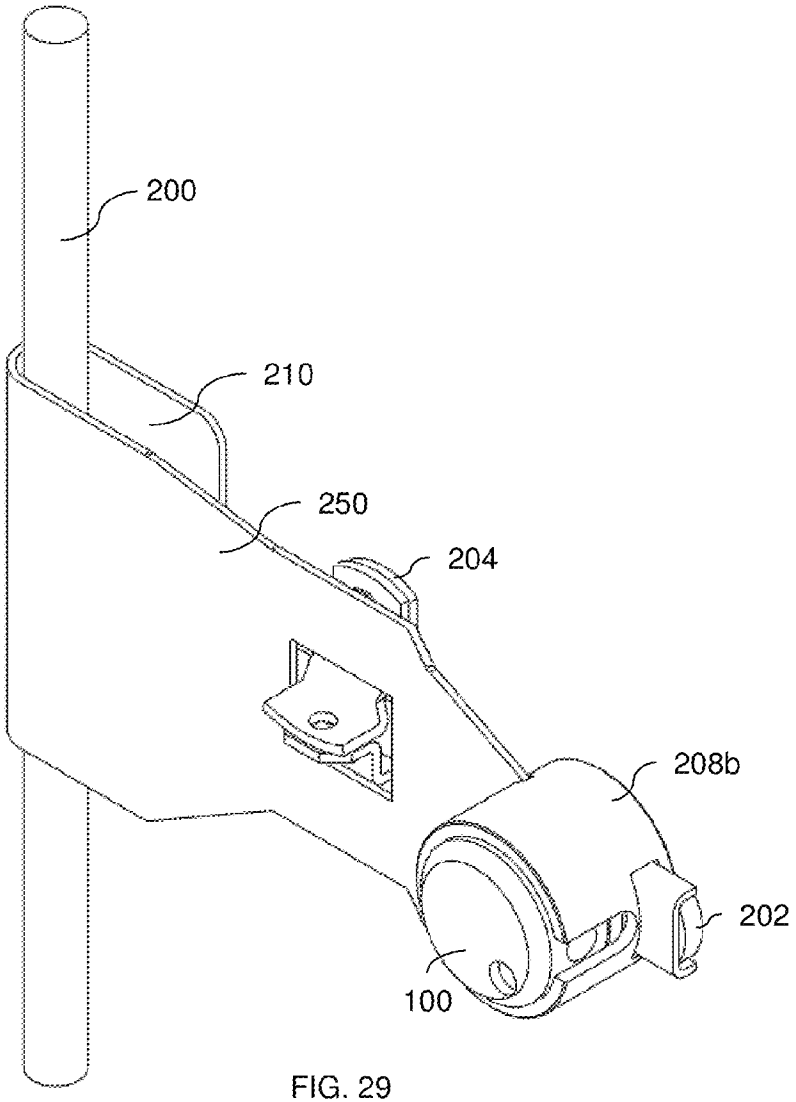
Figure 30:
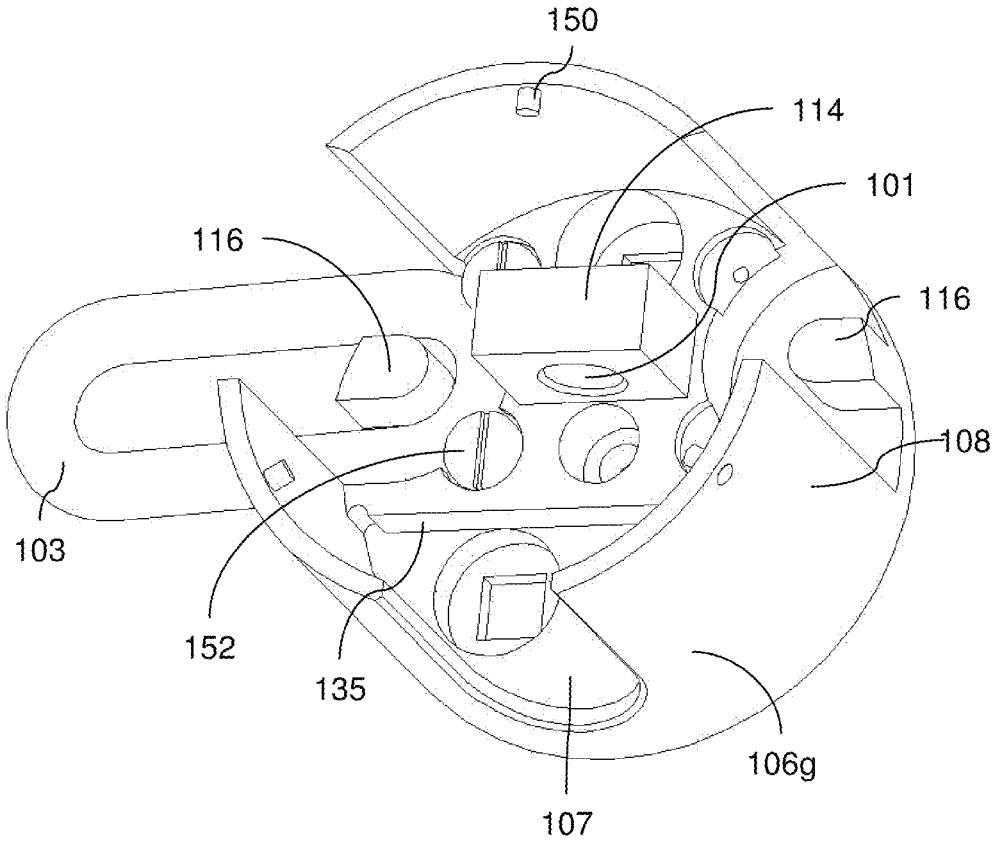
Figure 31:
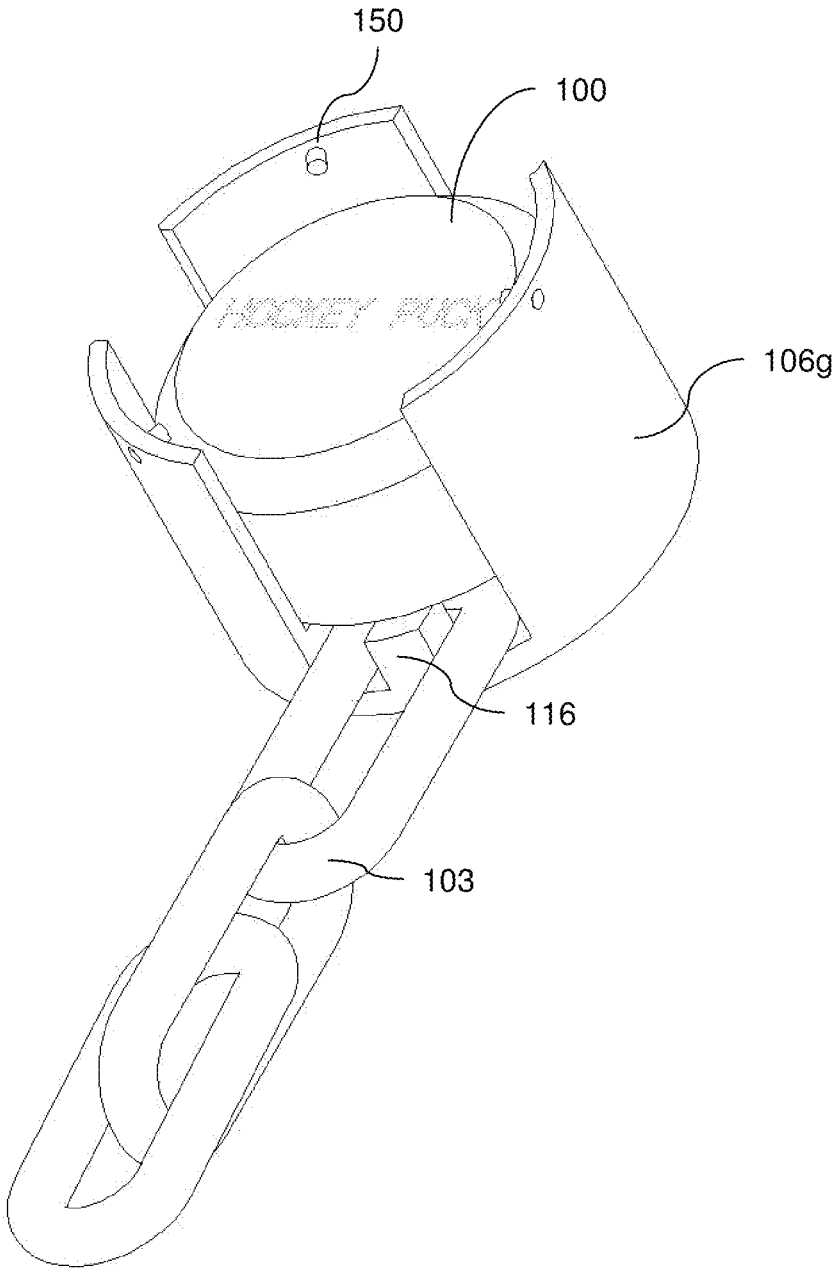
Figure 32:
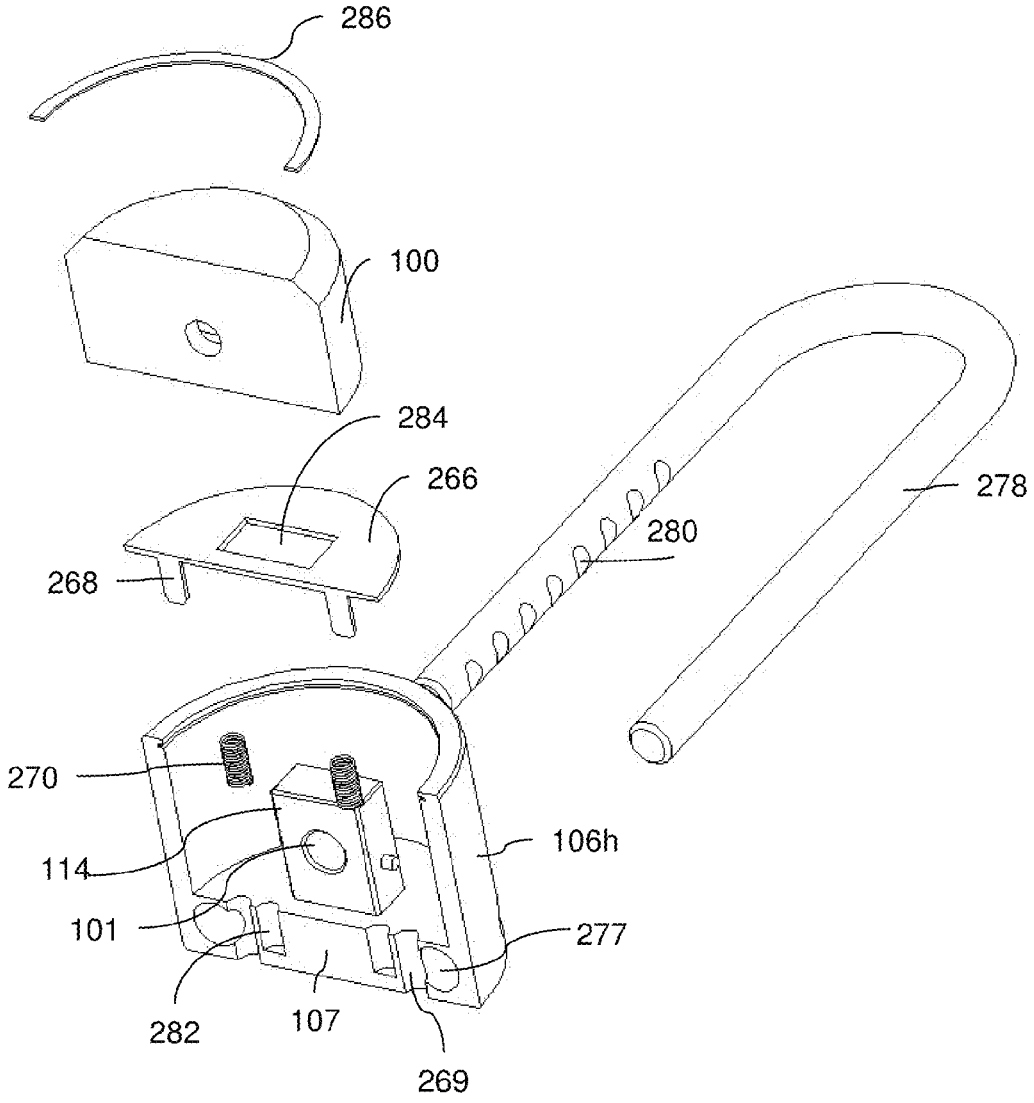
Figure 33:
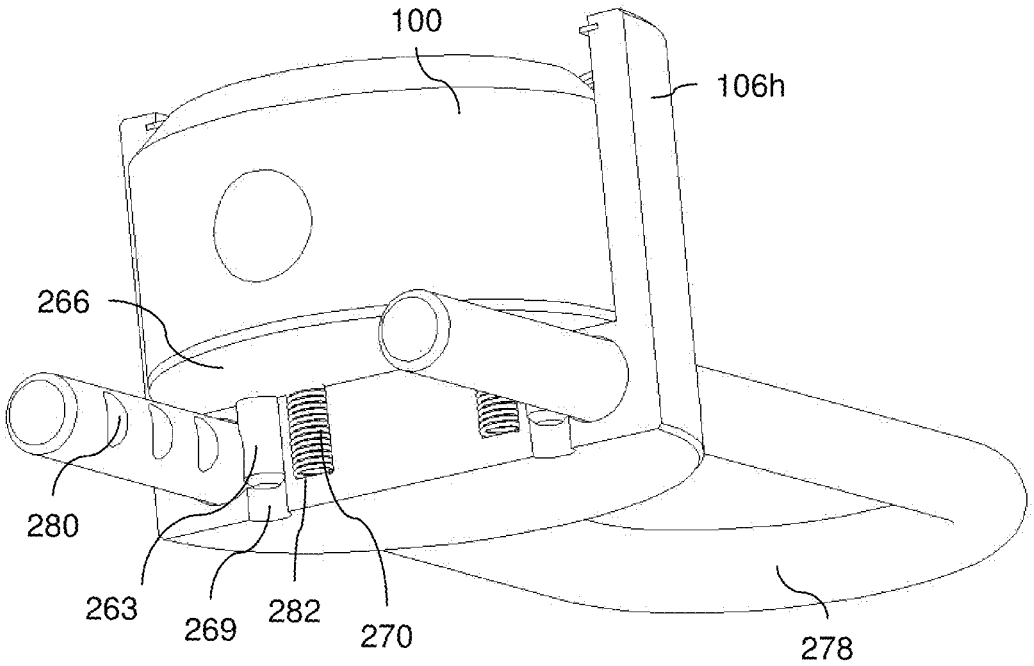
Figure 34:
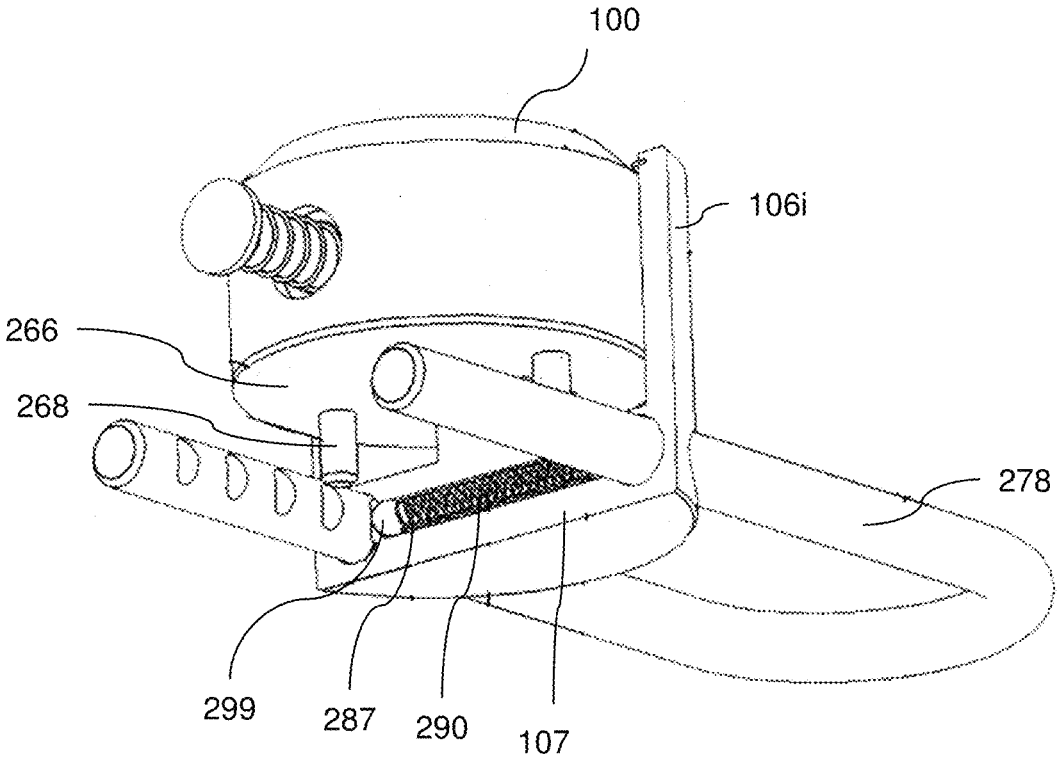
Figure 35:
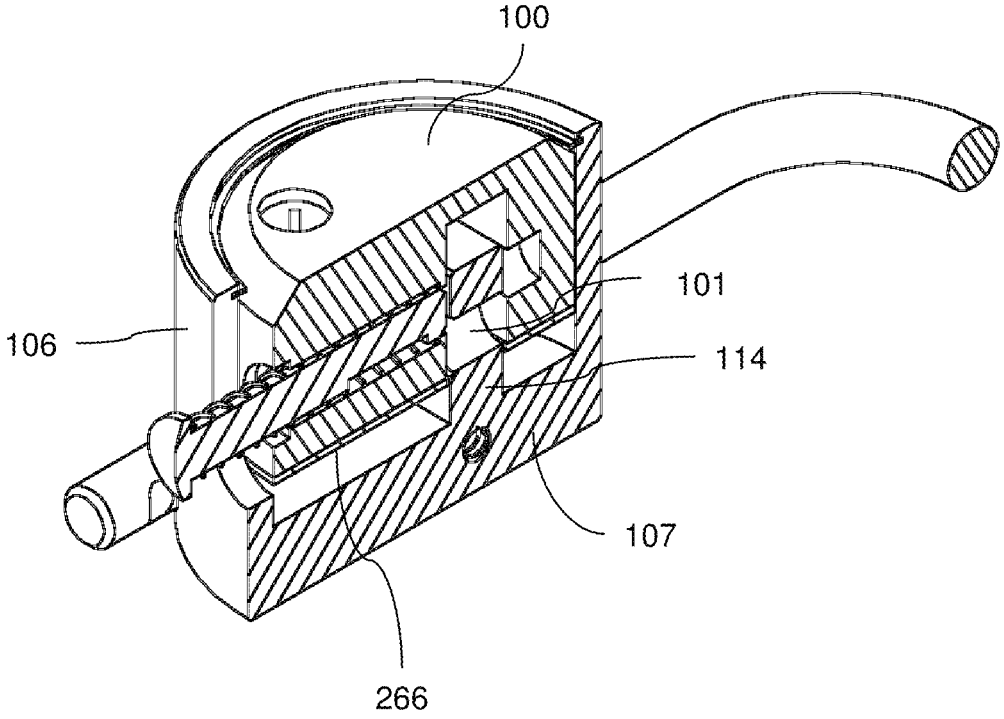
Figure 36:
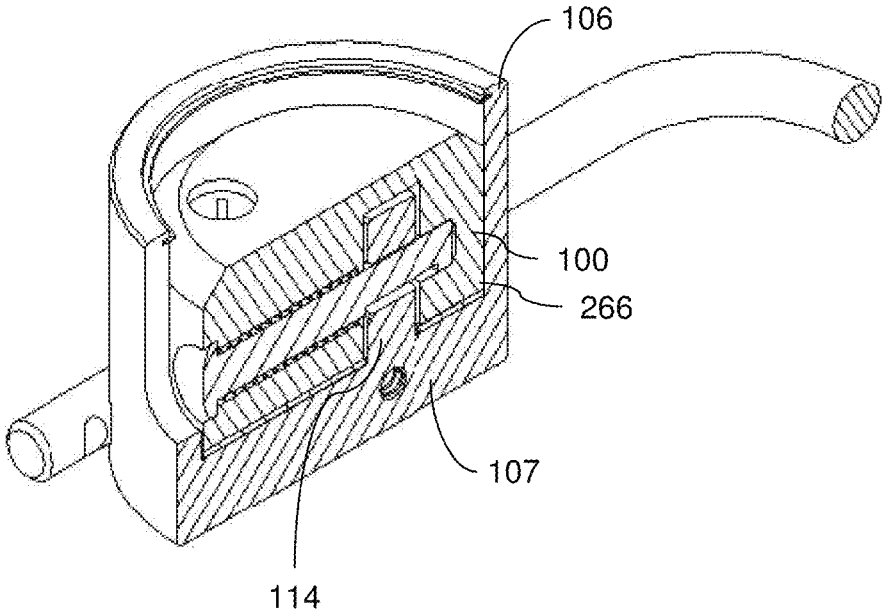
Figure 37:
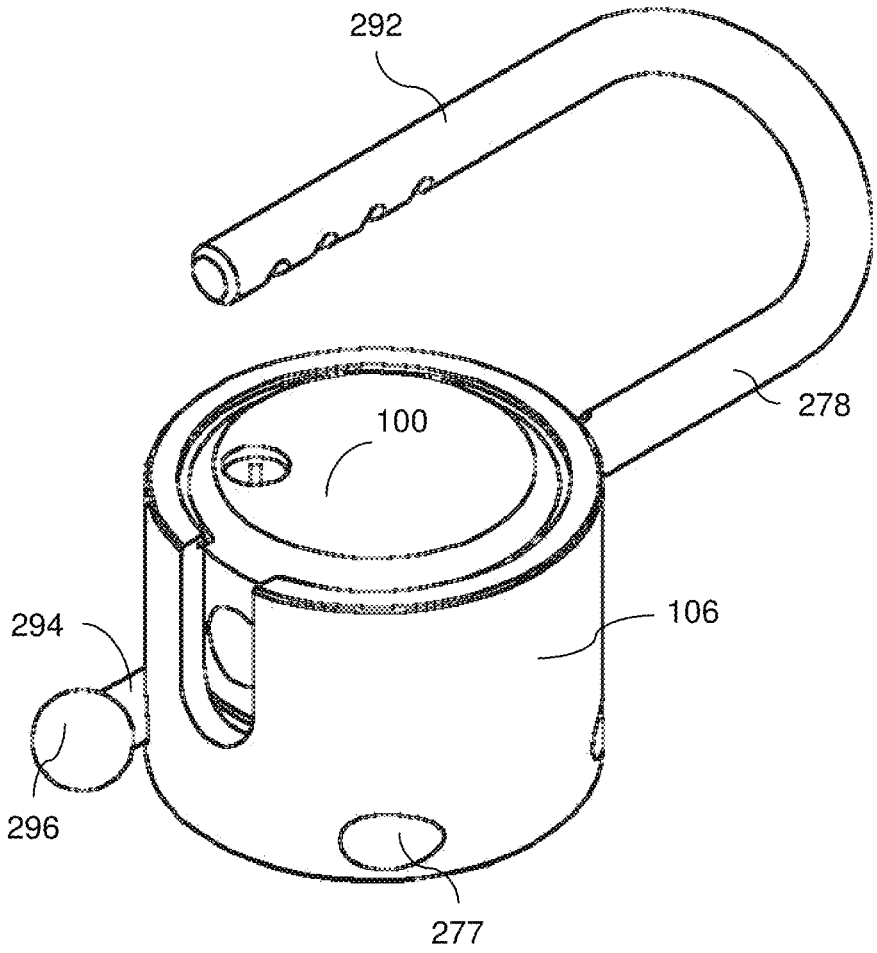
Figure 38:
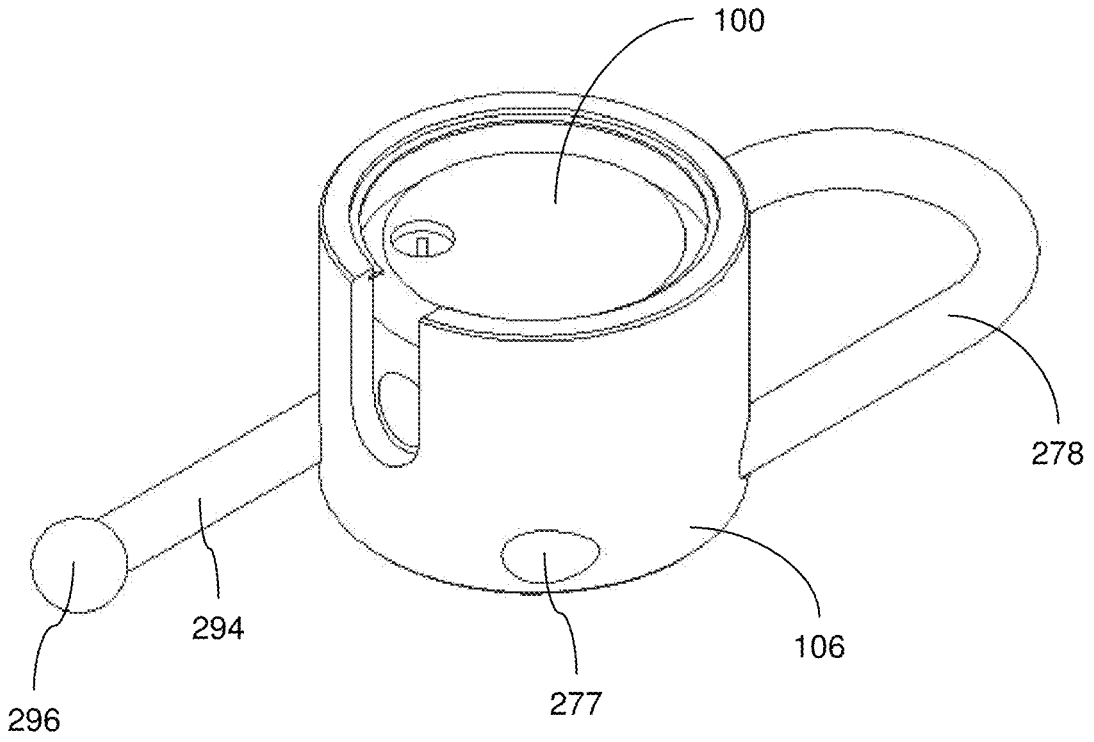
Figure 39:
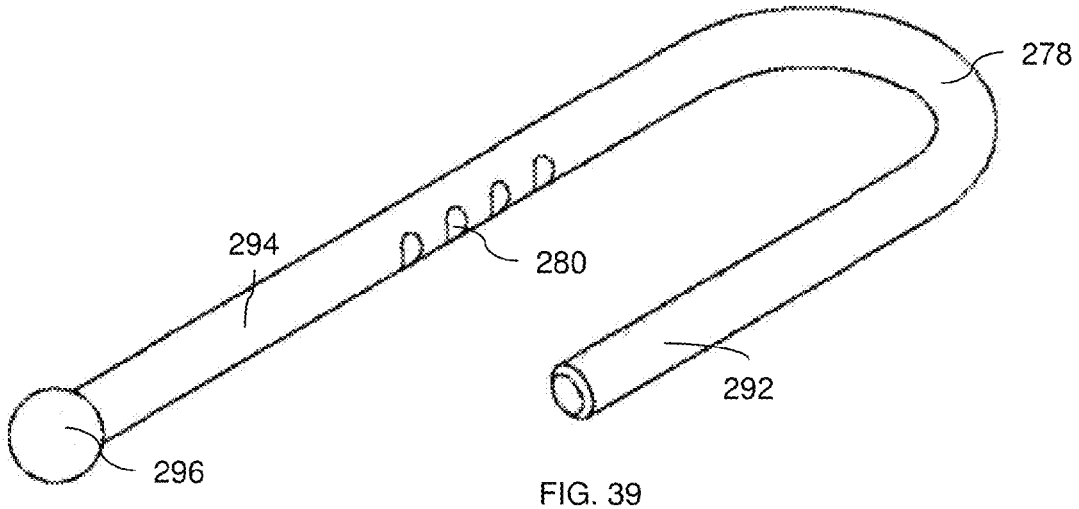
Figure 40:
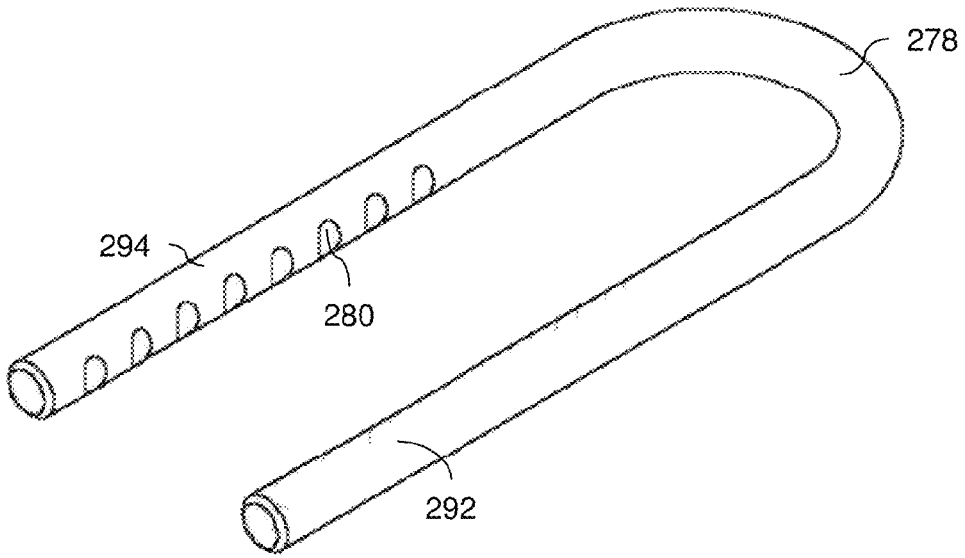
Figure 41:
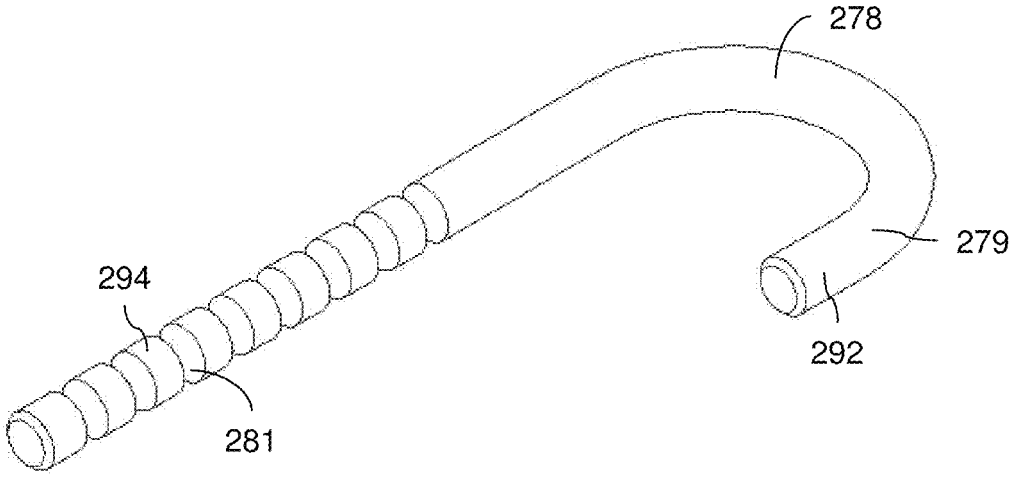
Figure 42:
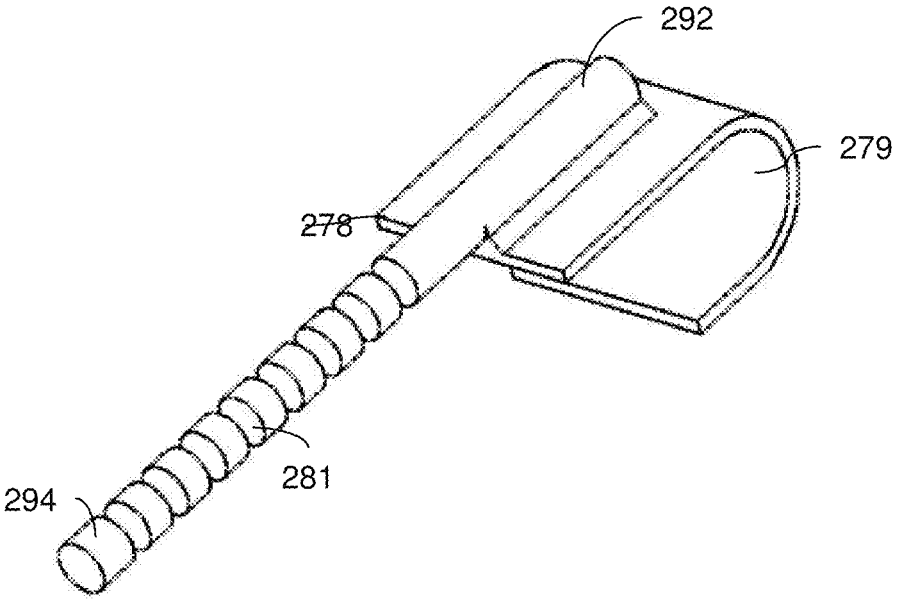
Figure 43:
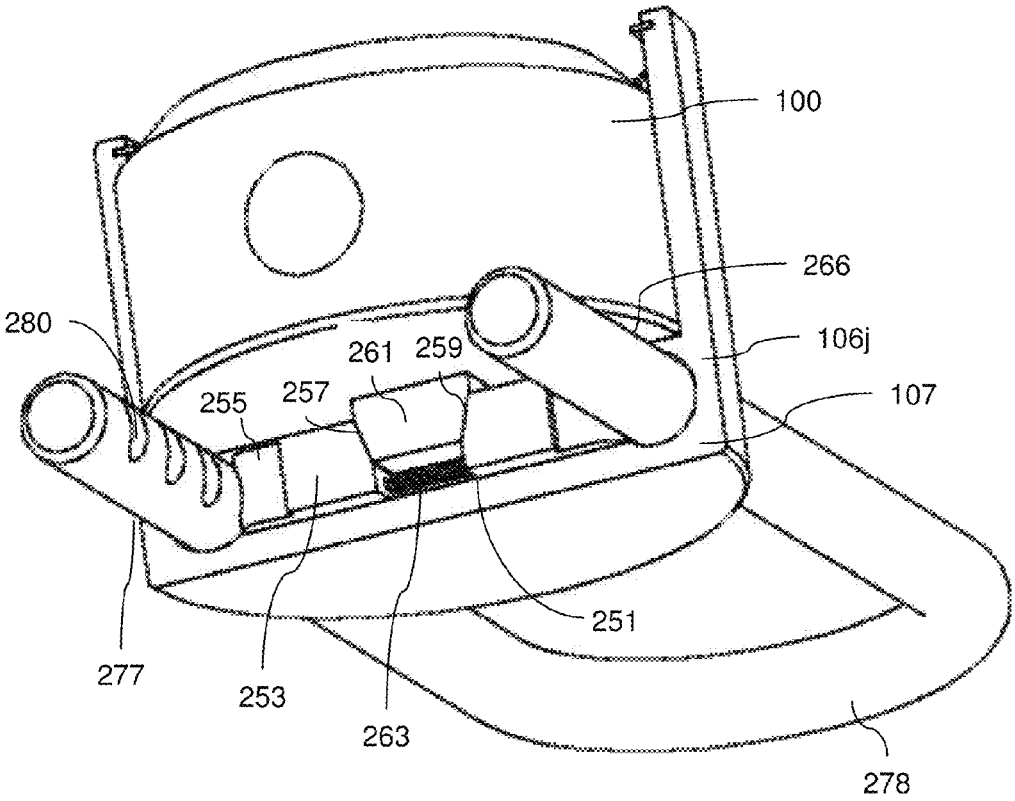
Figure 44:
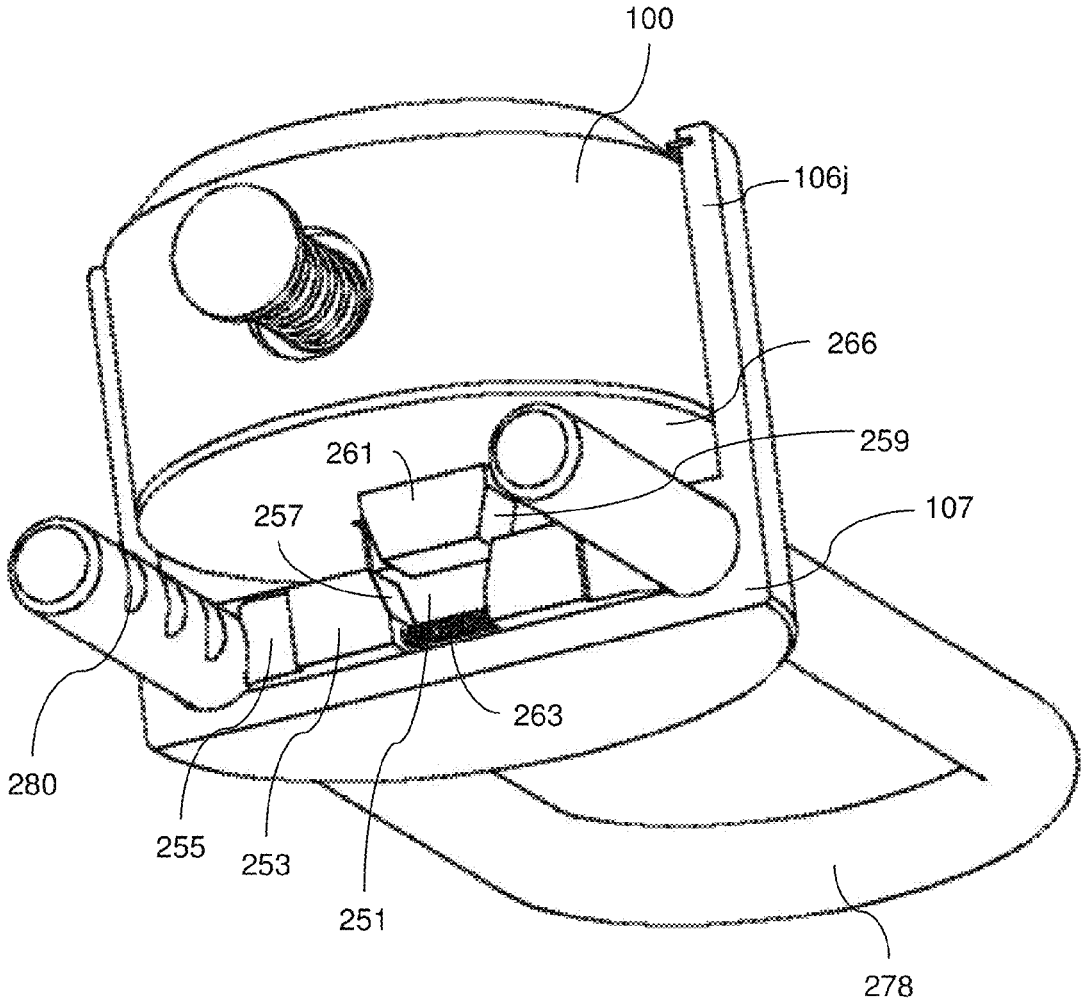
Figure 45:
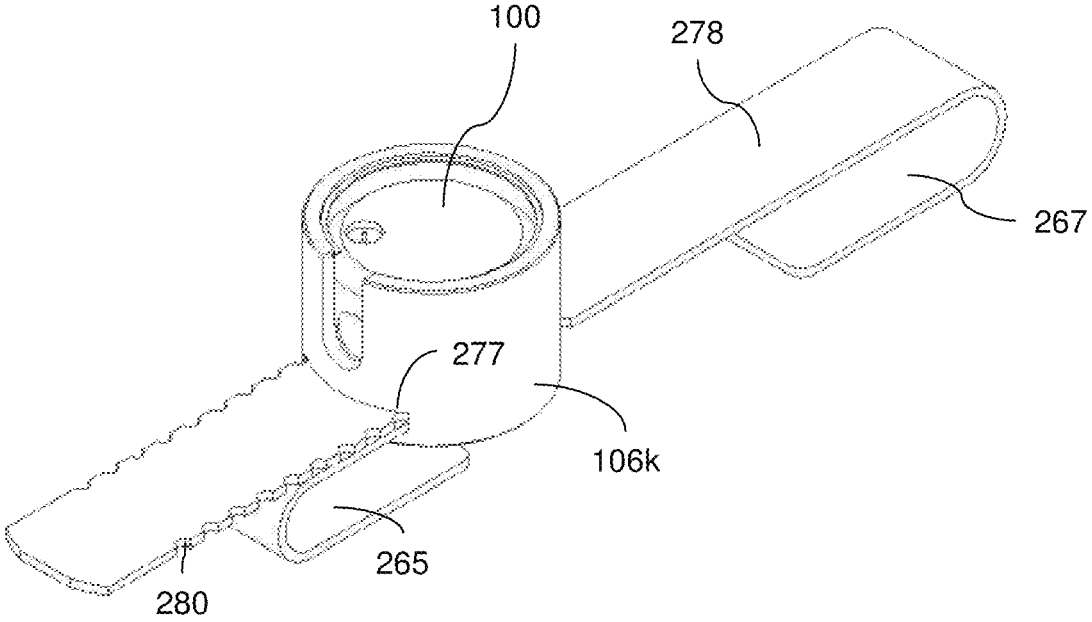
Figure 46:
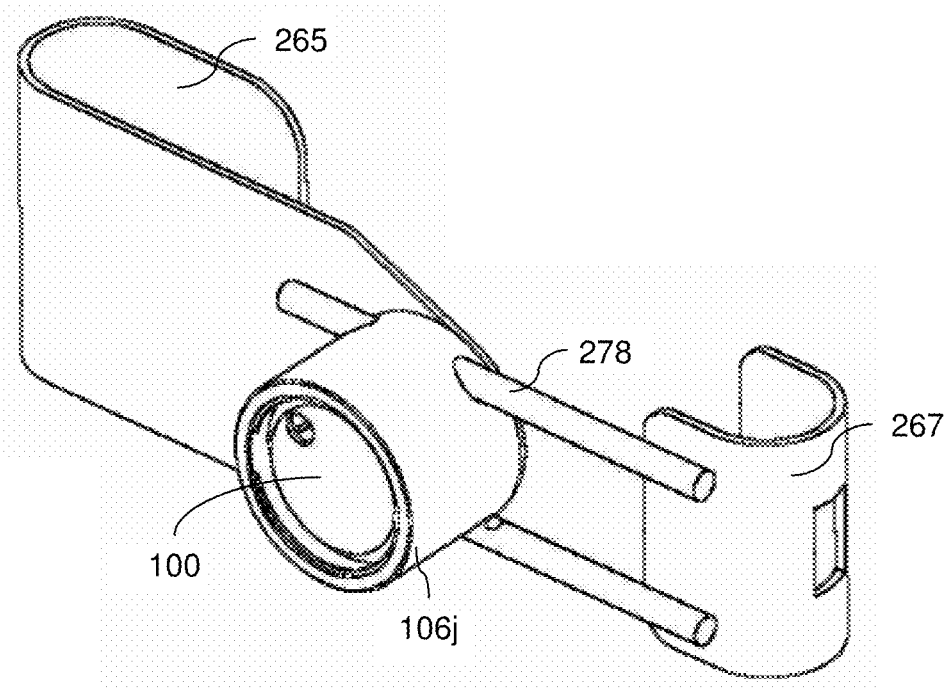
Figure 47:
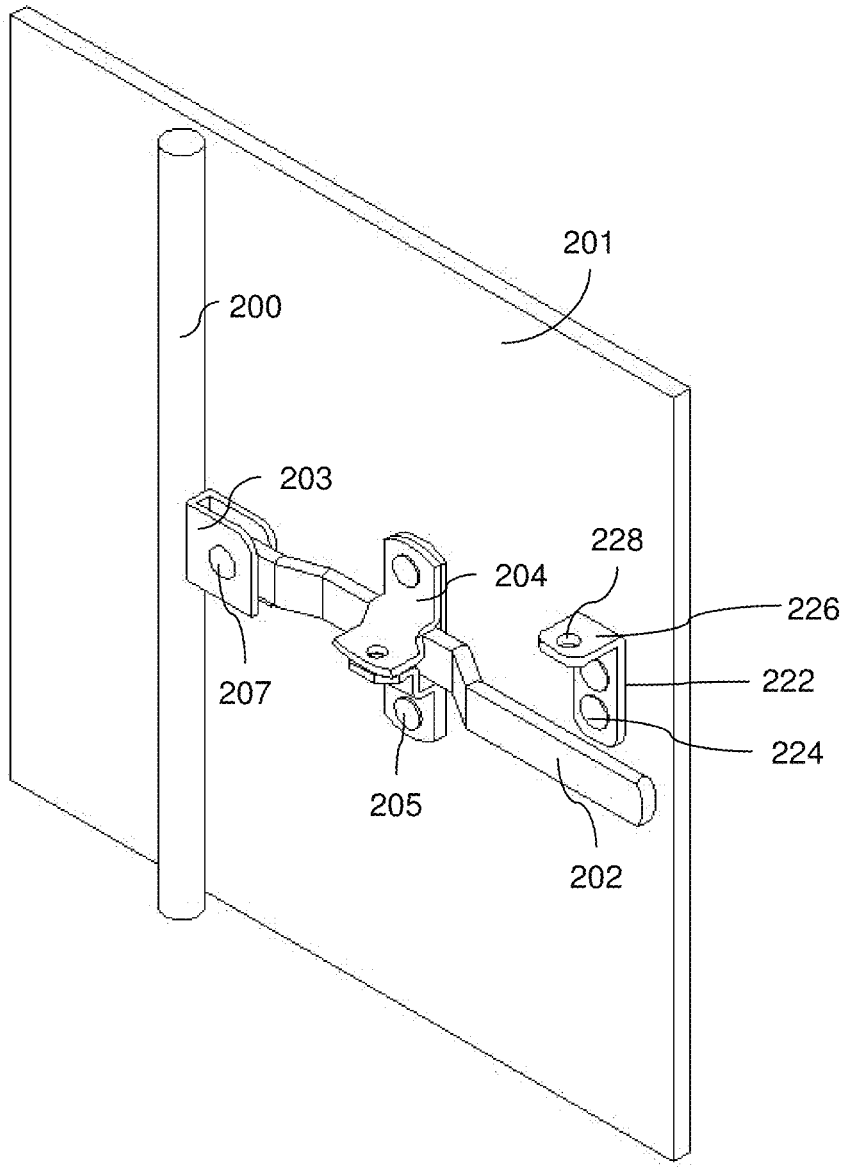
Figure 48:
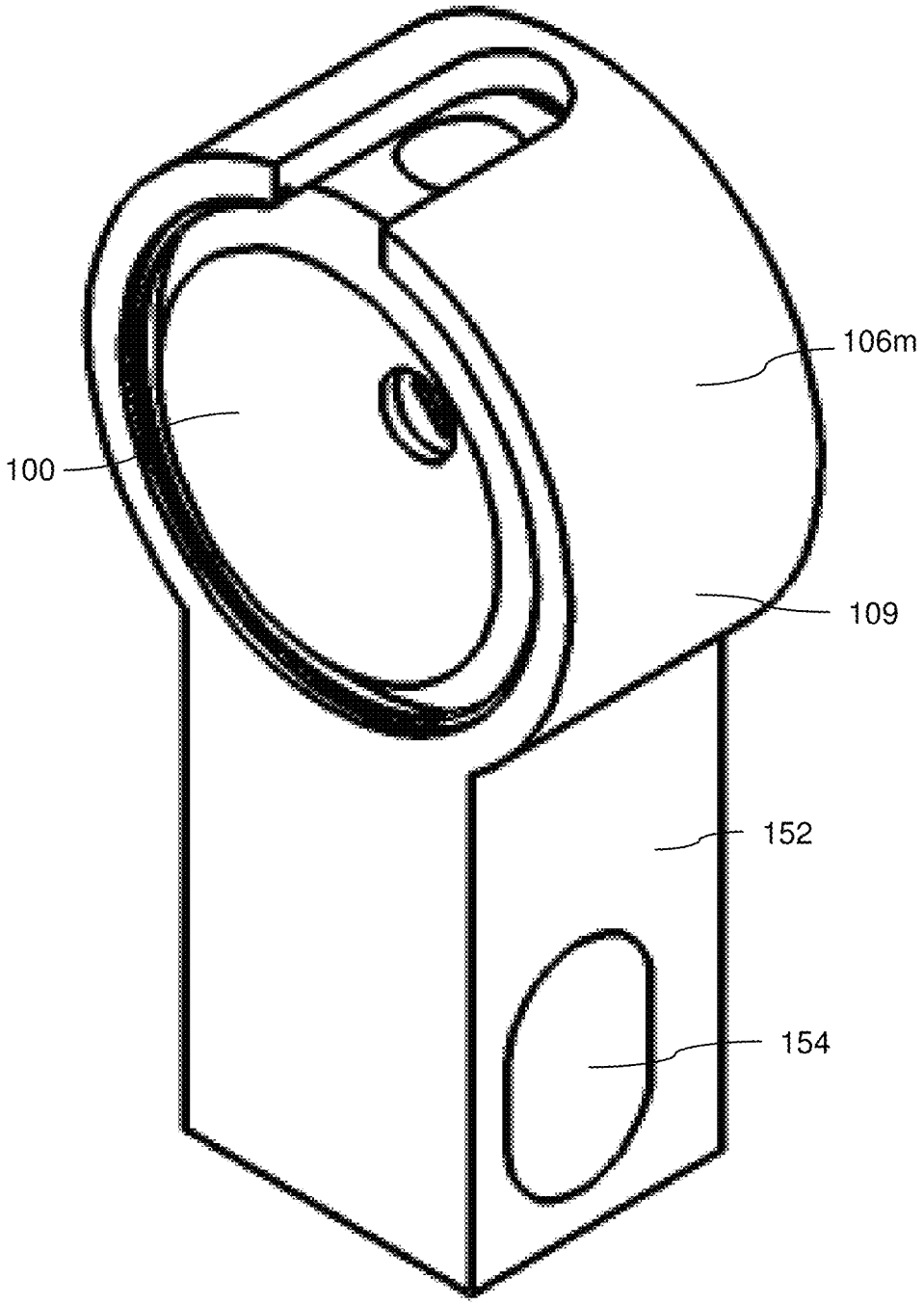
Figure 49:
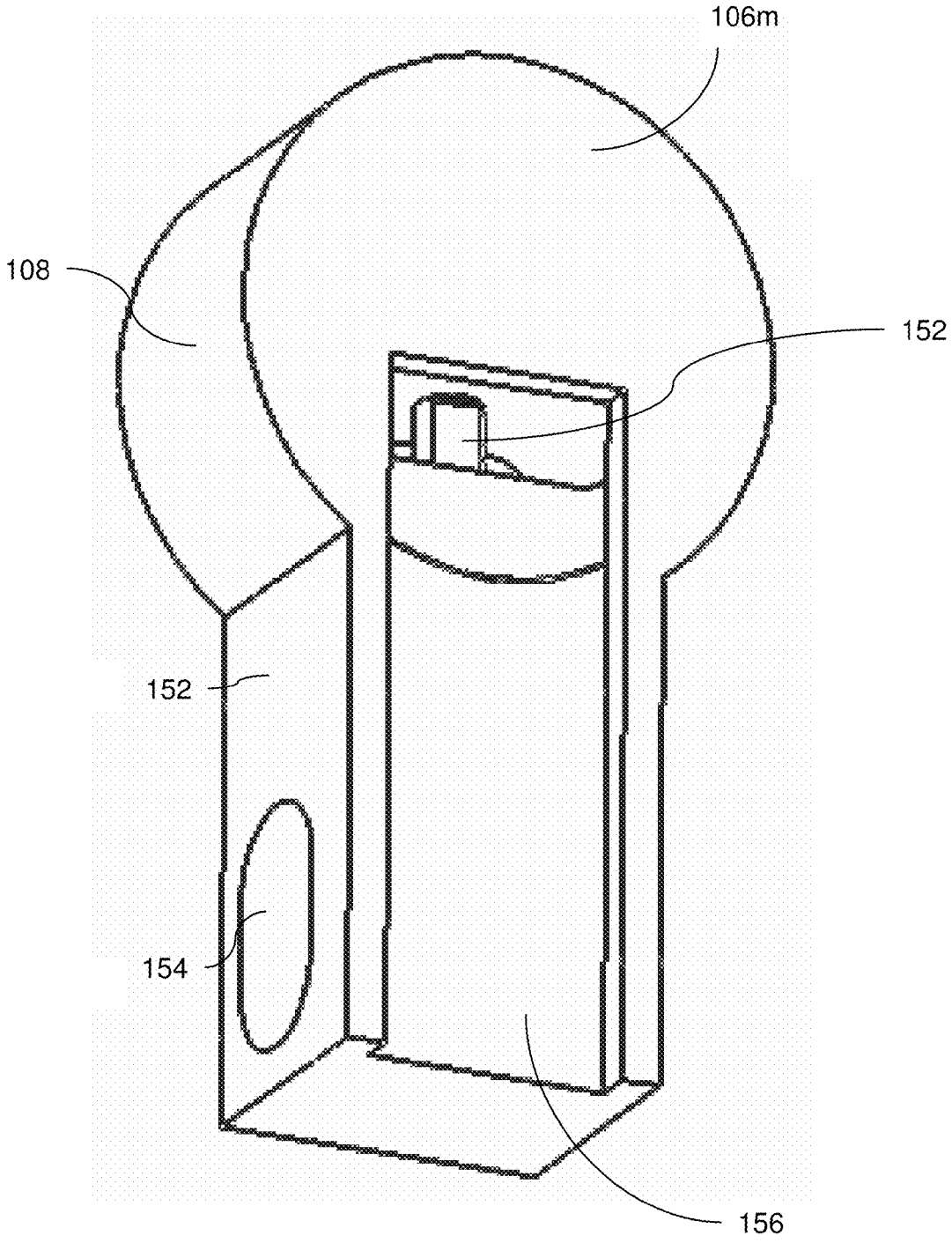
Figure 50:
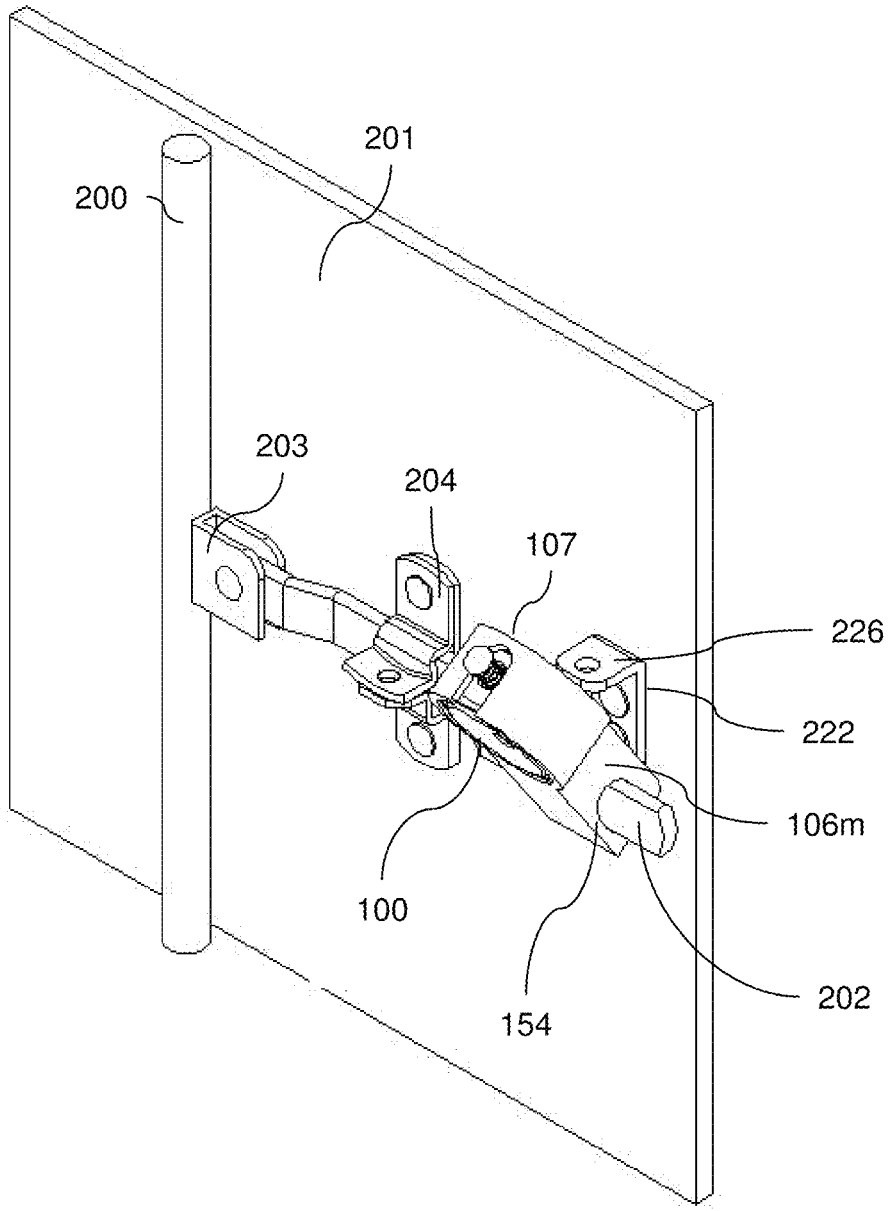
Figure 51:
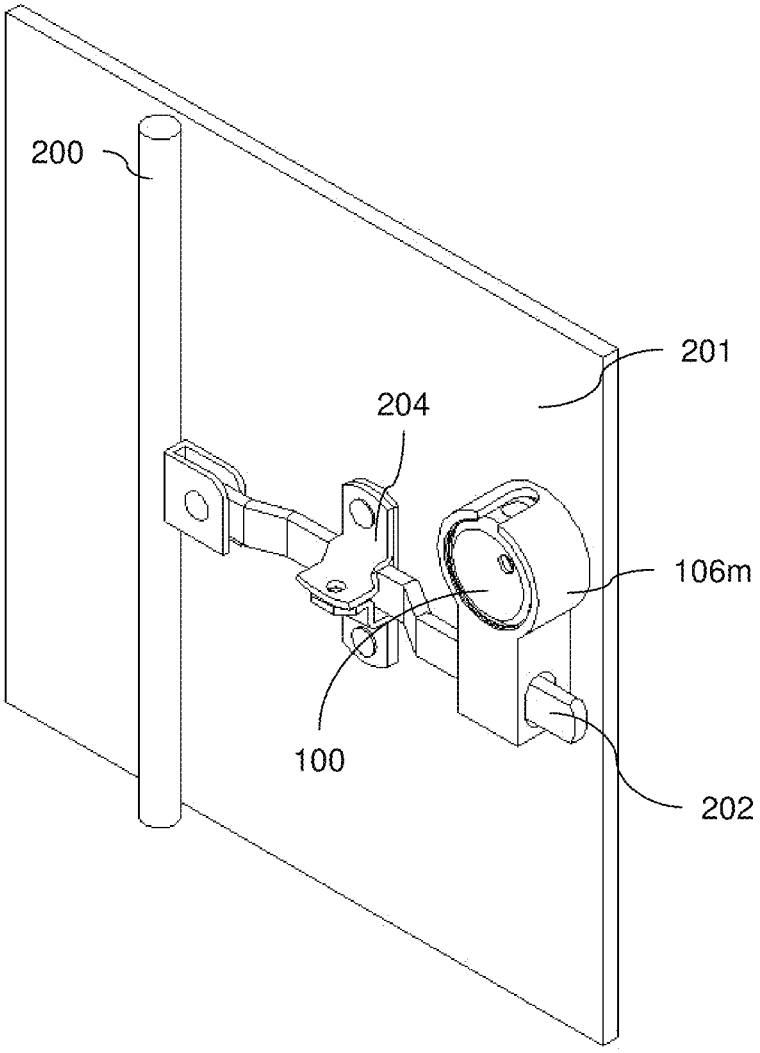
Figure 52:
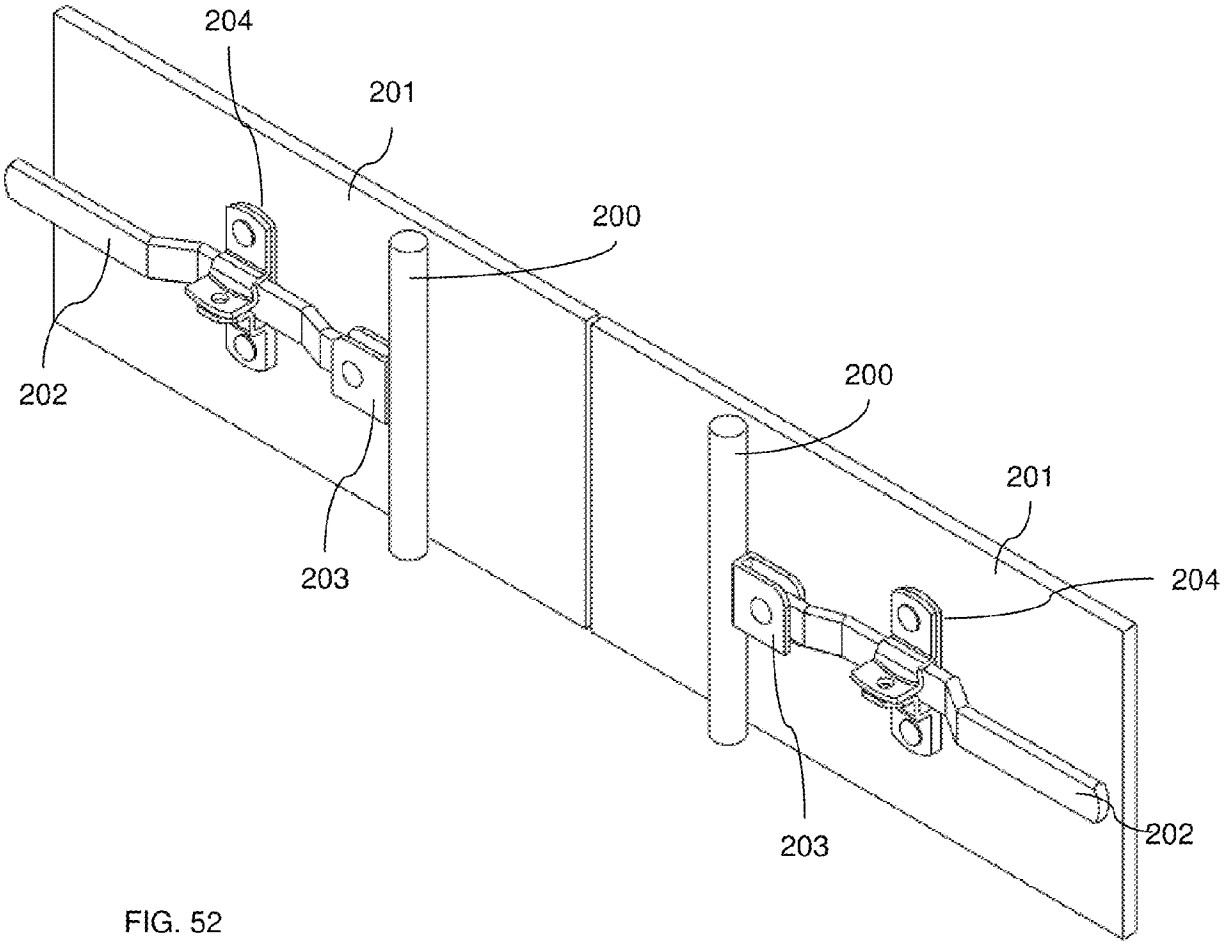
FIG. 52 (prior art)
Figure 53:
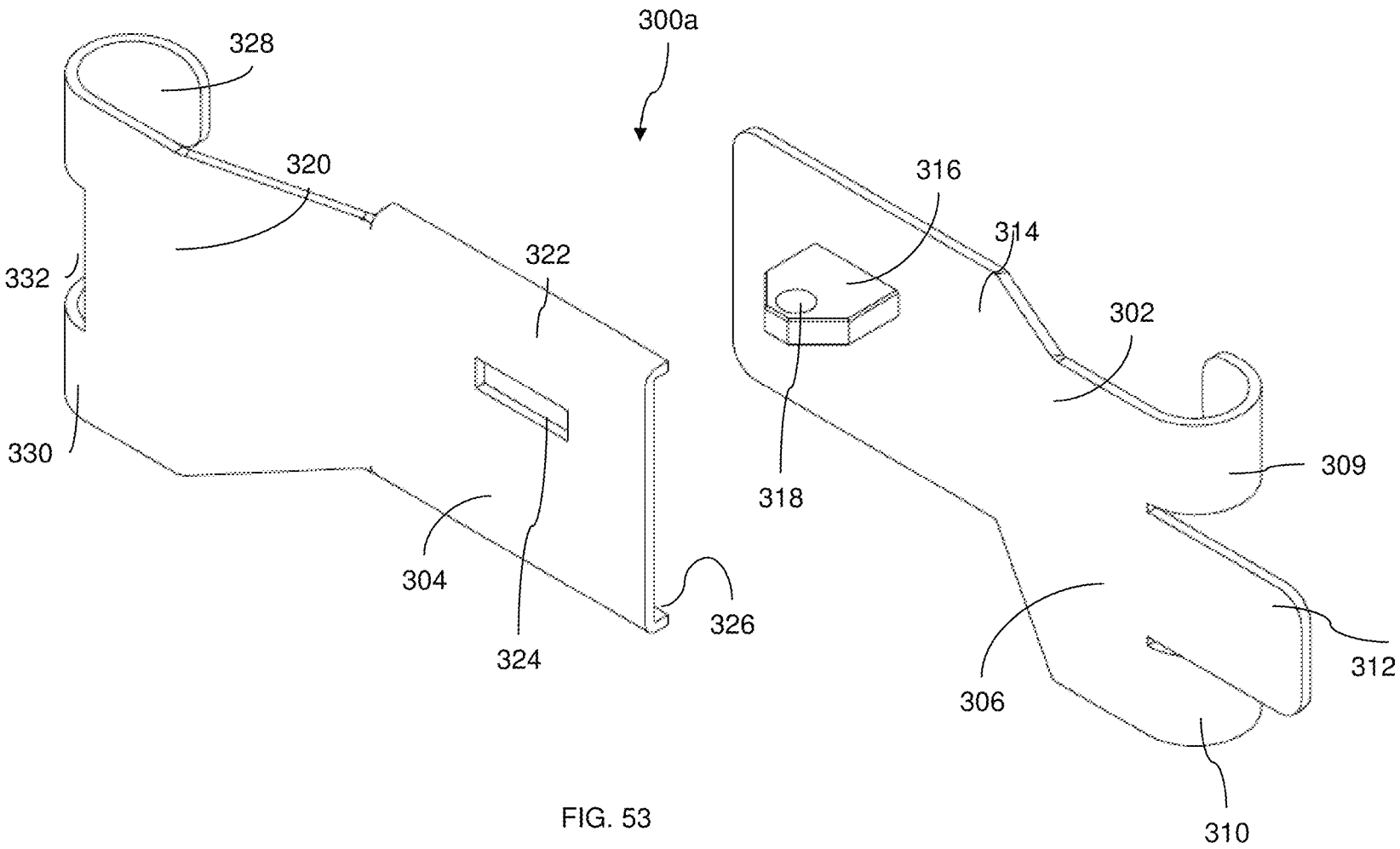
Figure 54:
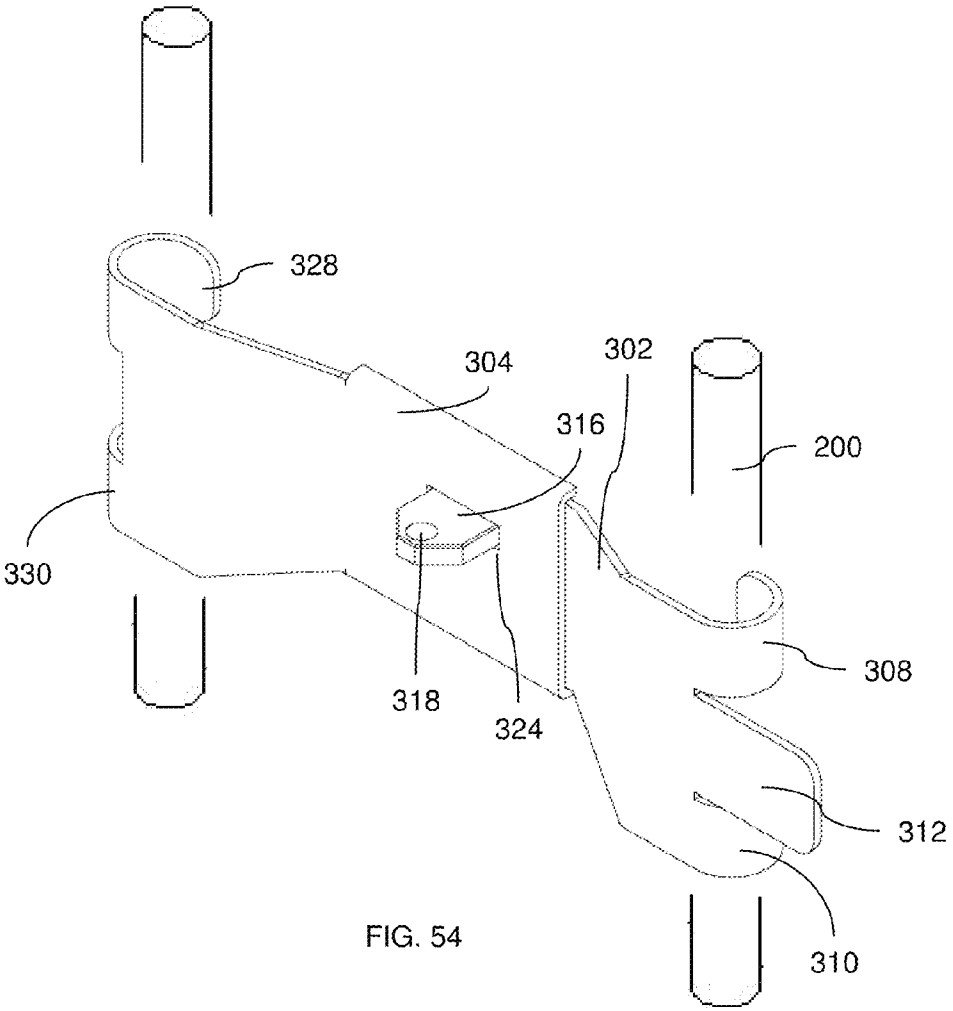
Figure 55:
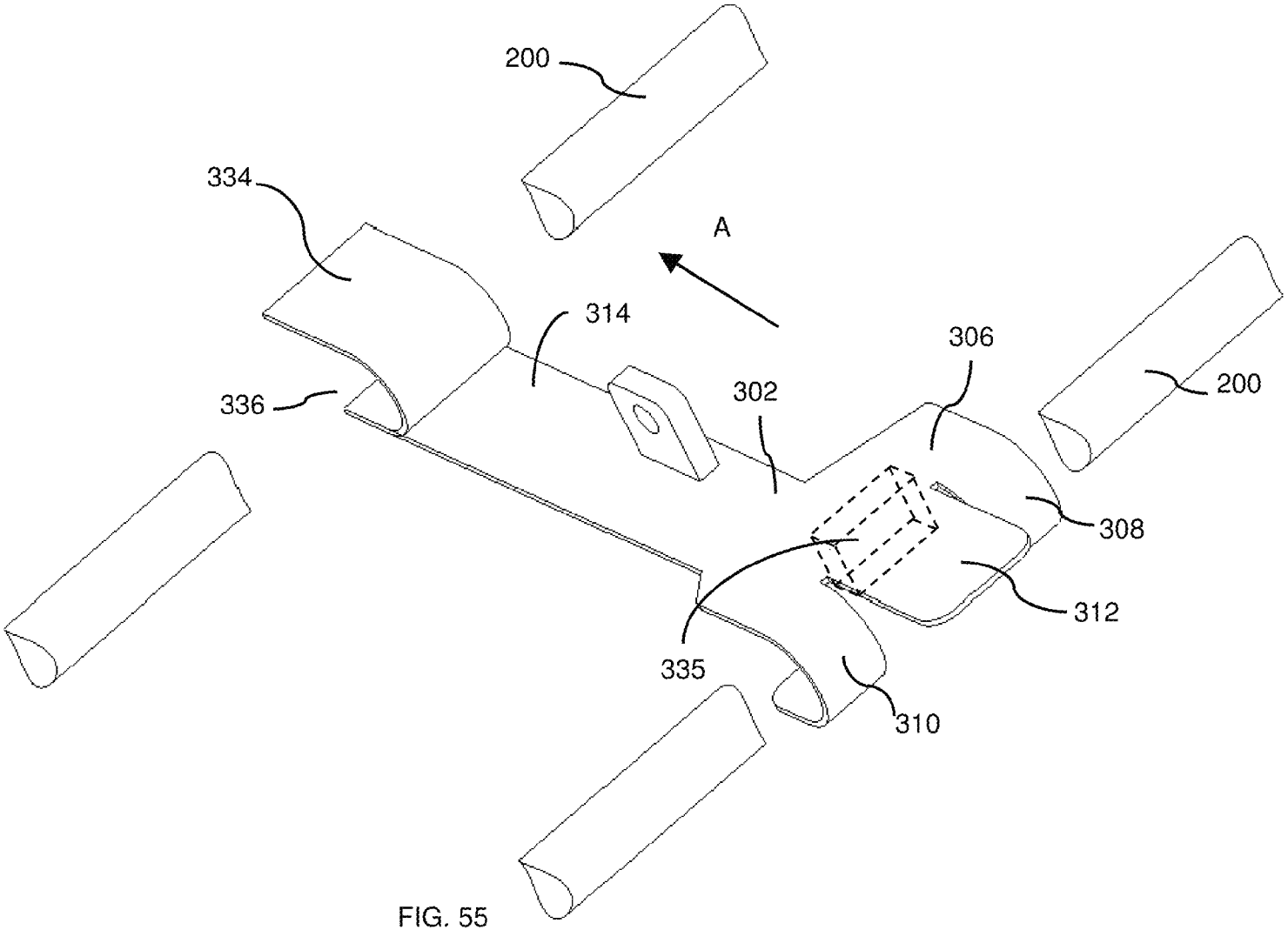
Figure 56:
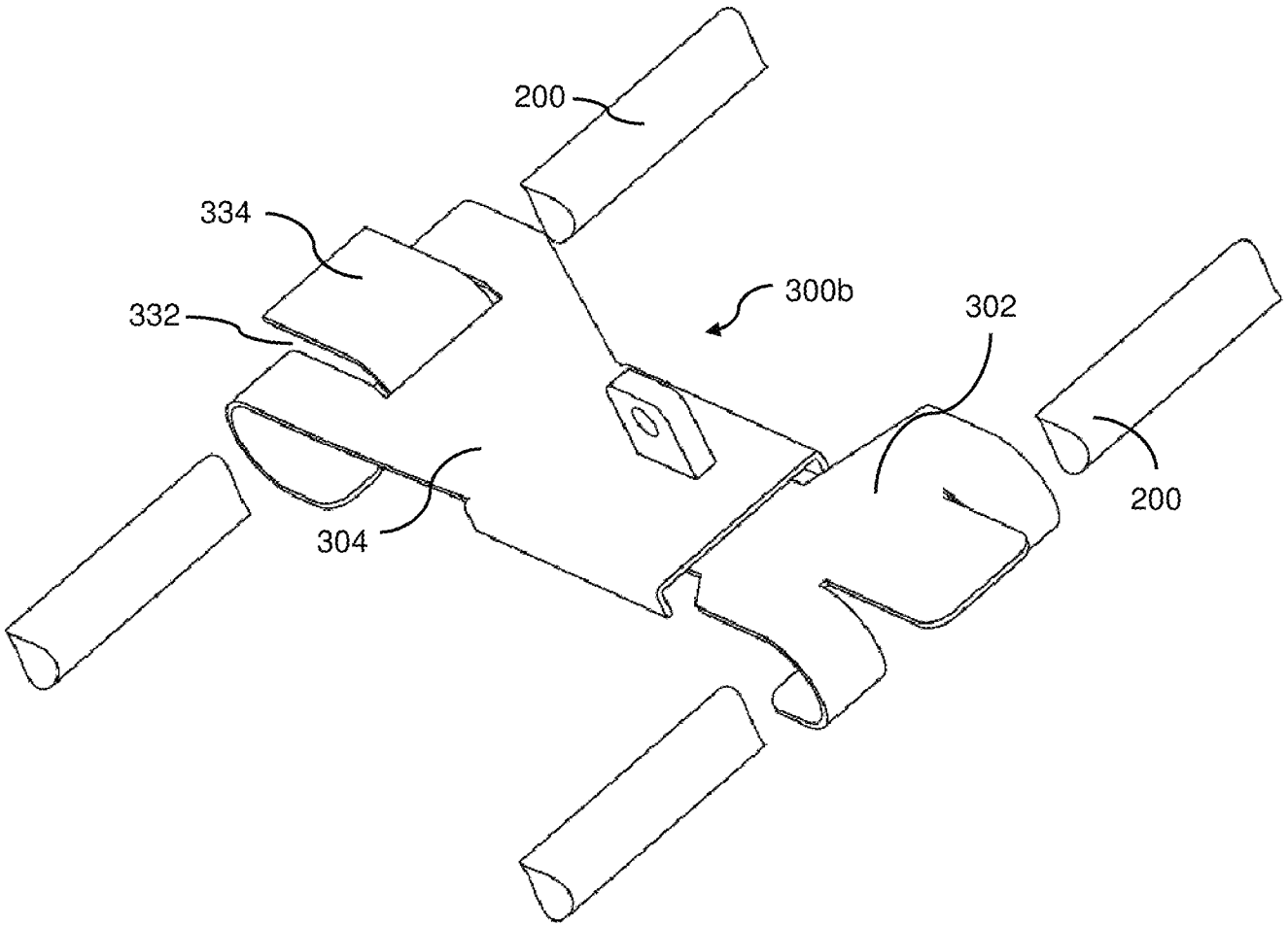
Figure 57:
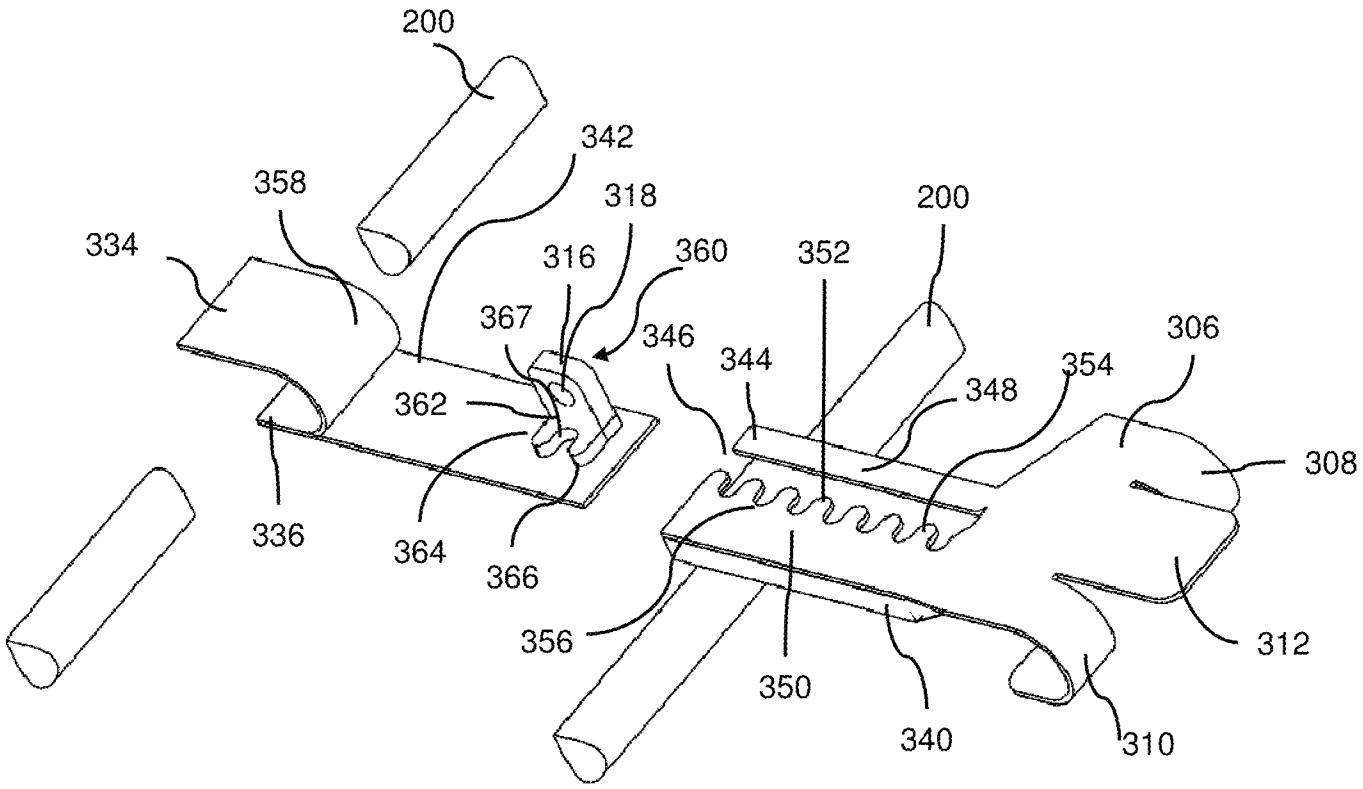
Figure 58:
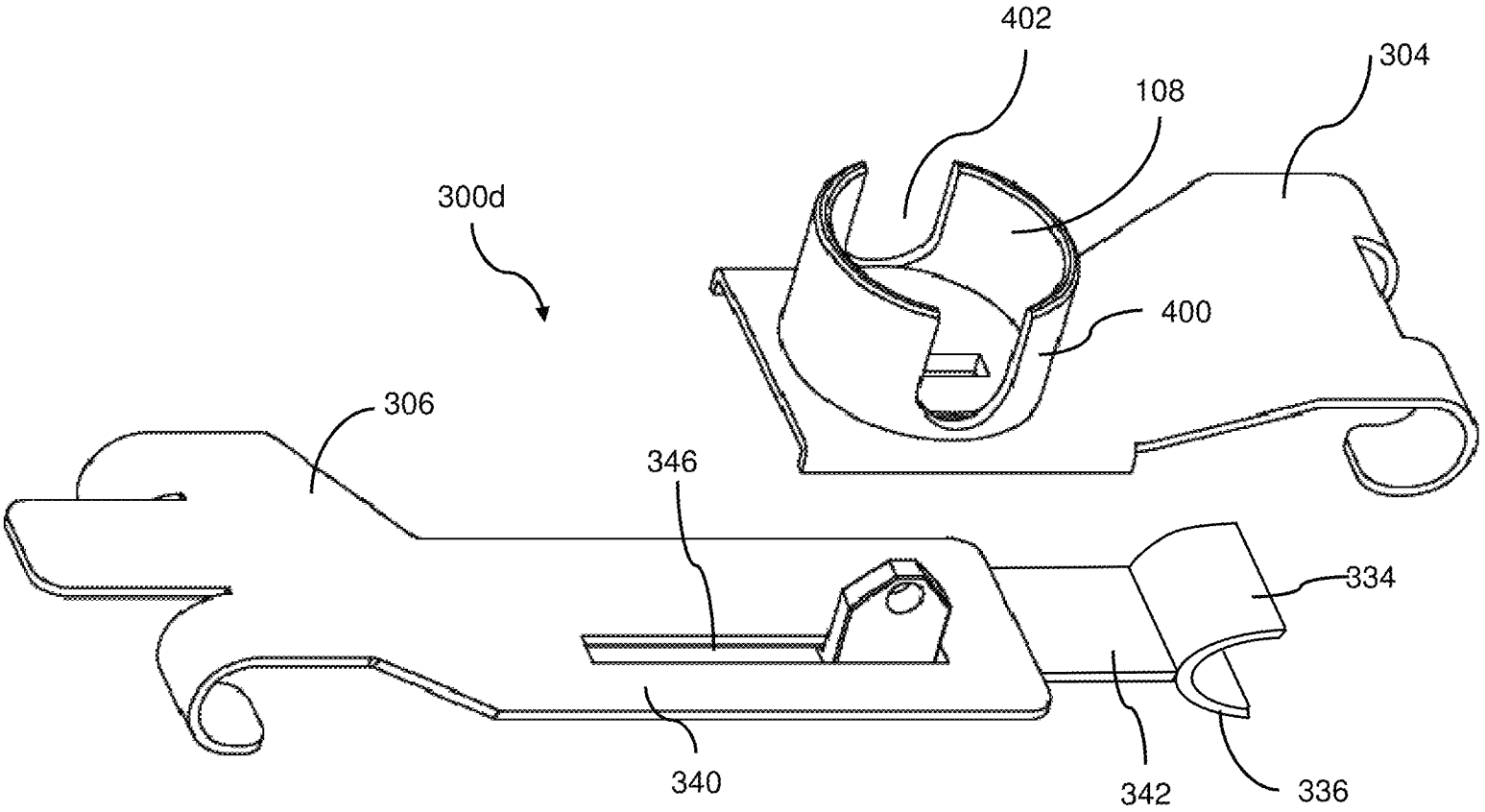
Figure 59:
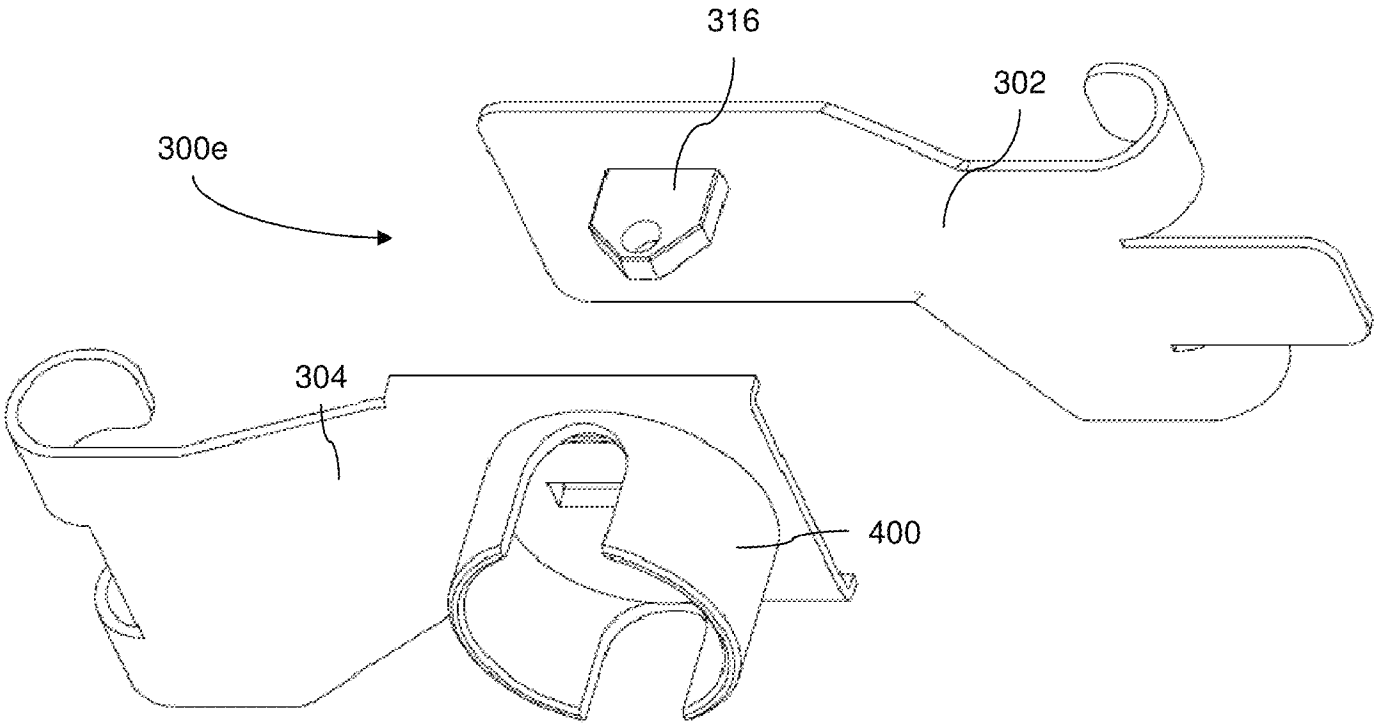
Figure 60:
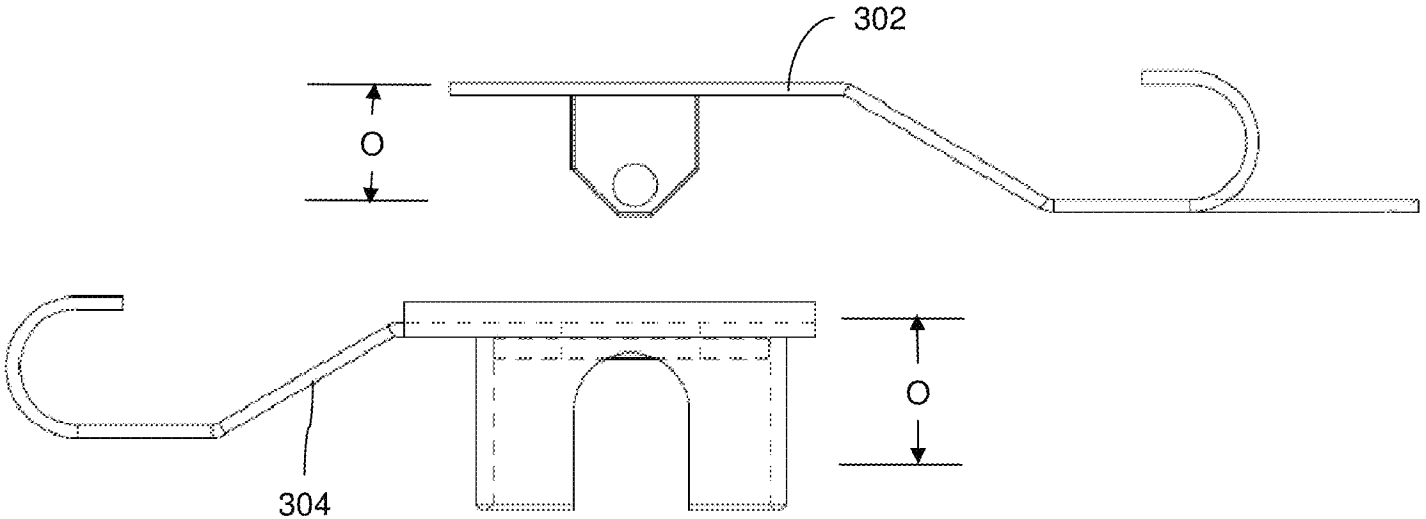
Figure 61:
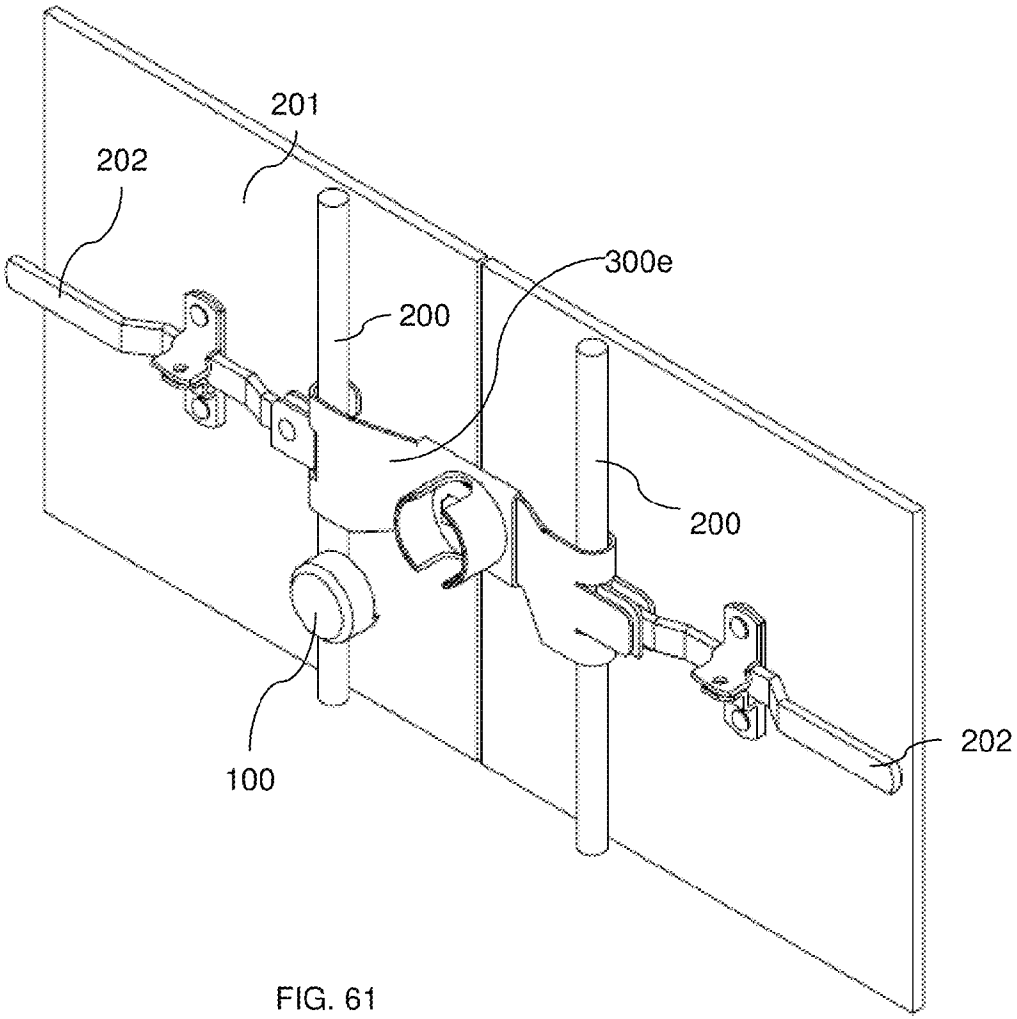
Figure 62:
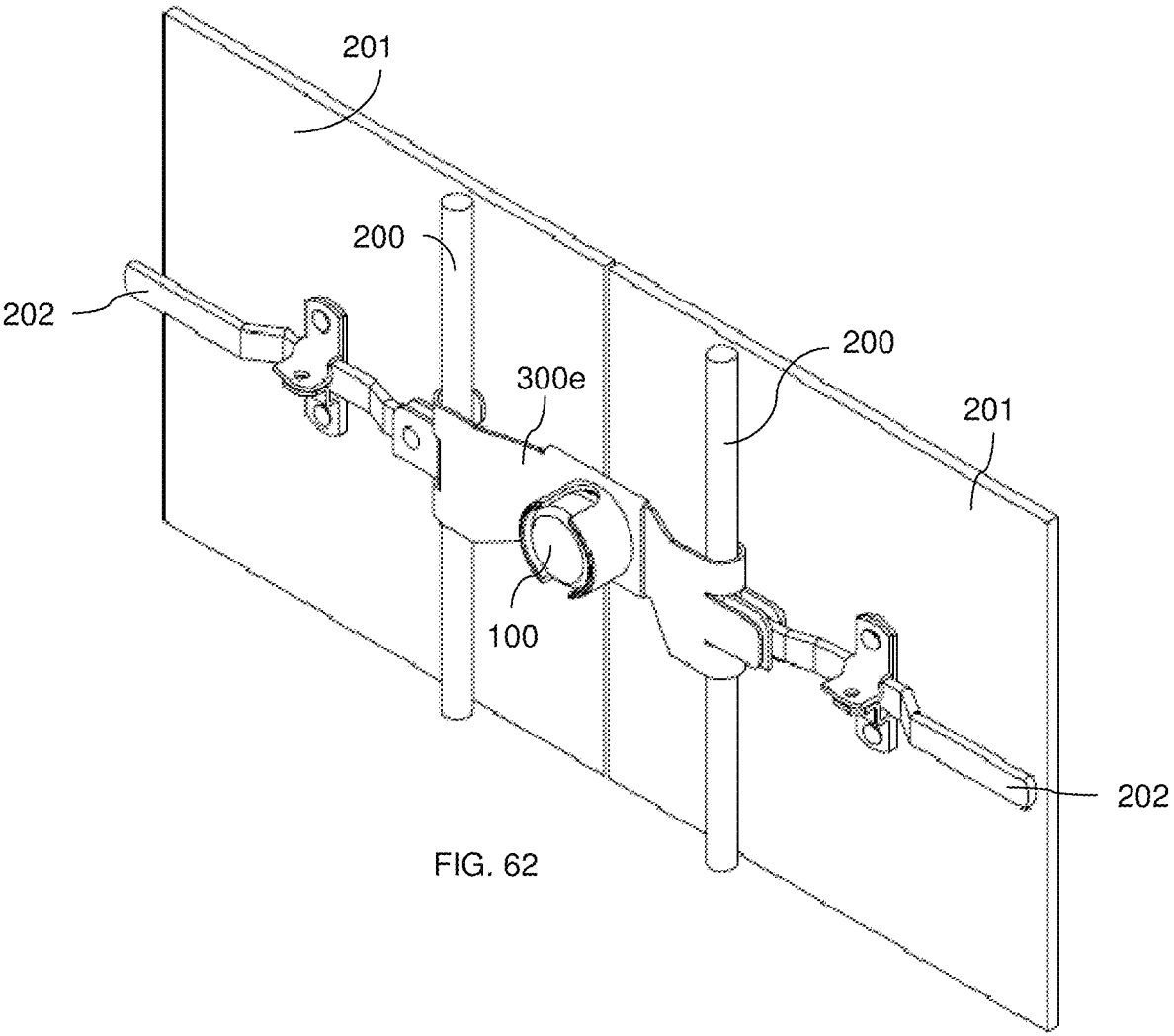
Figure 63:
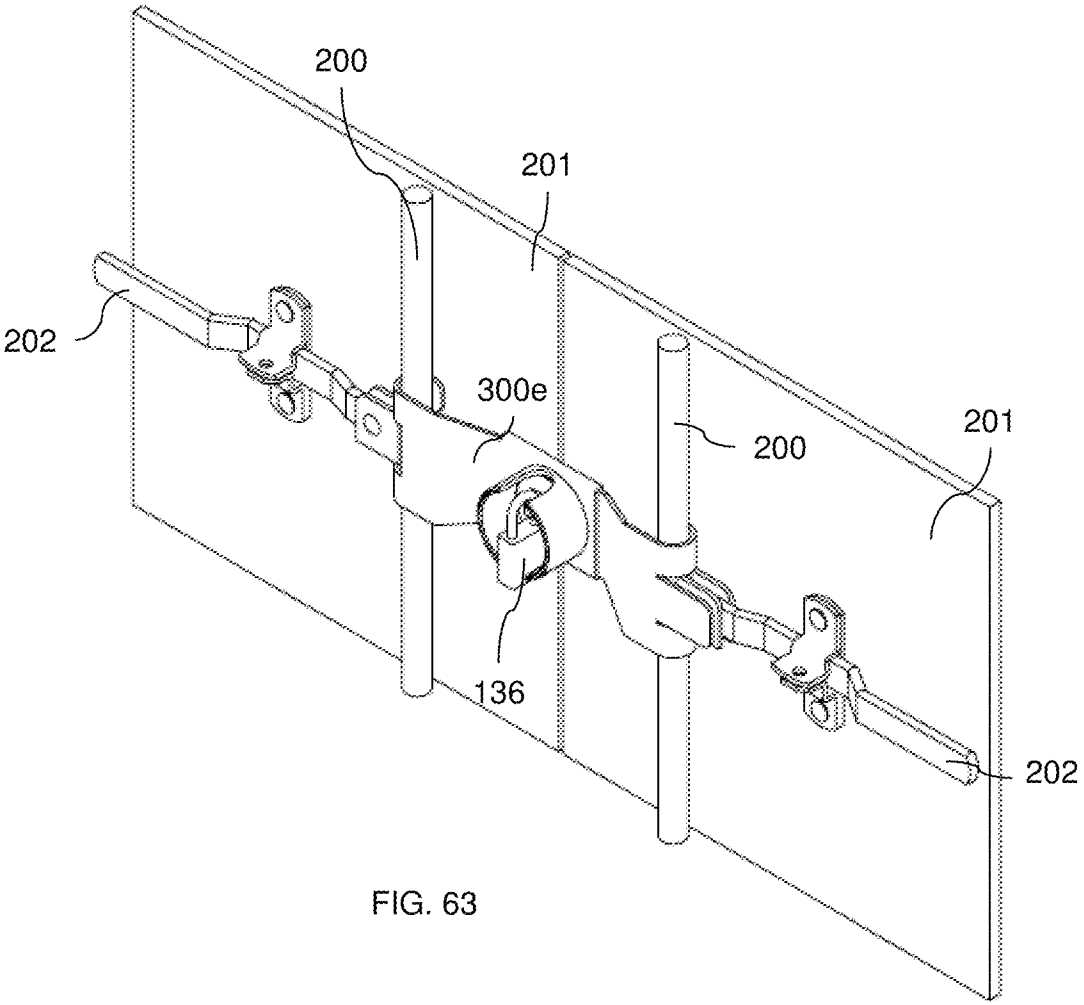
Figure 64:
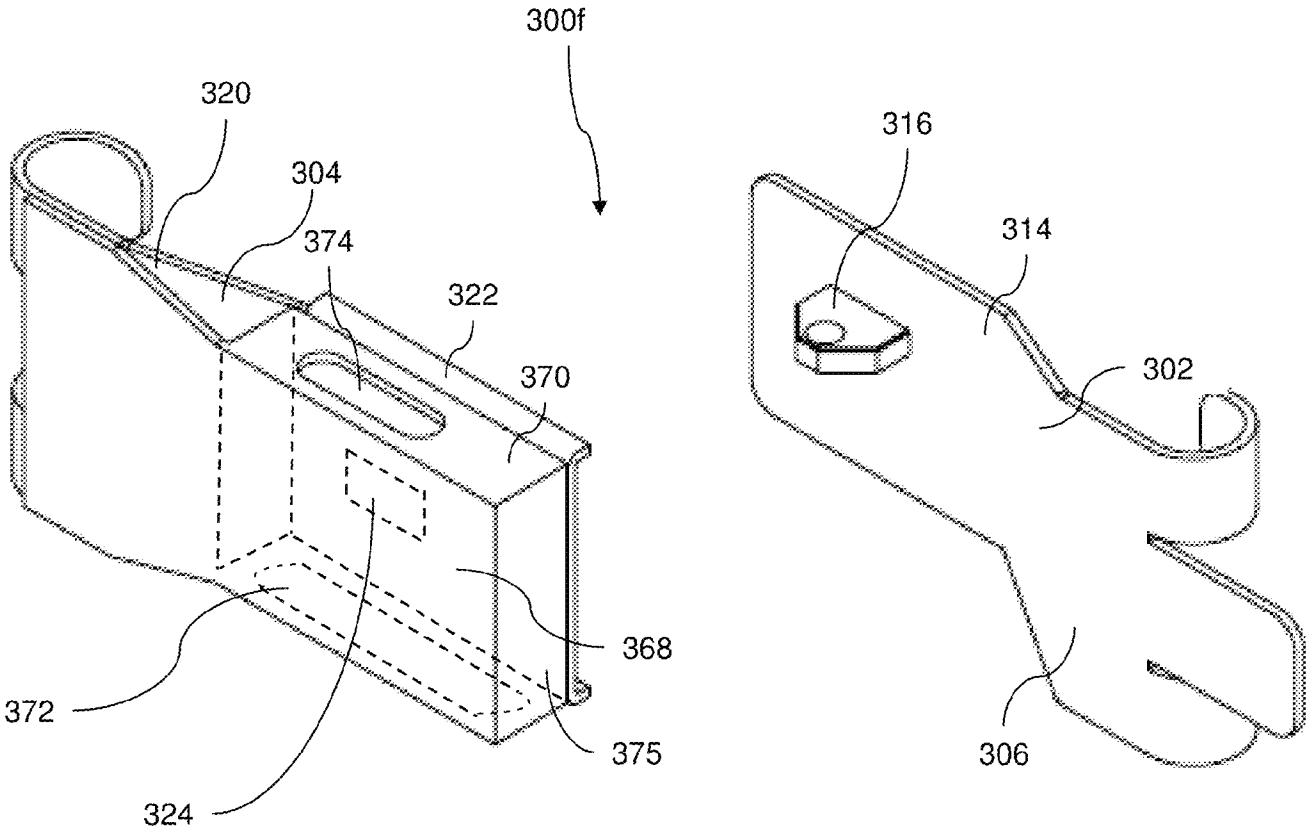
Figure 65:
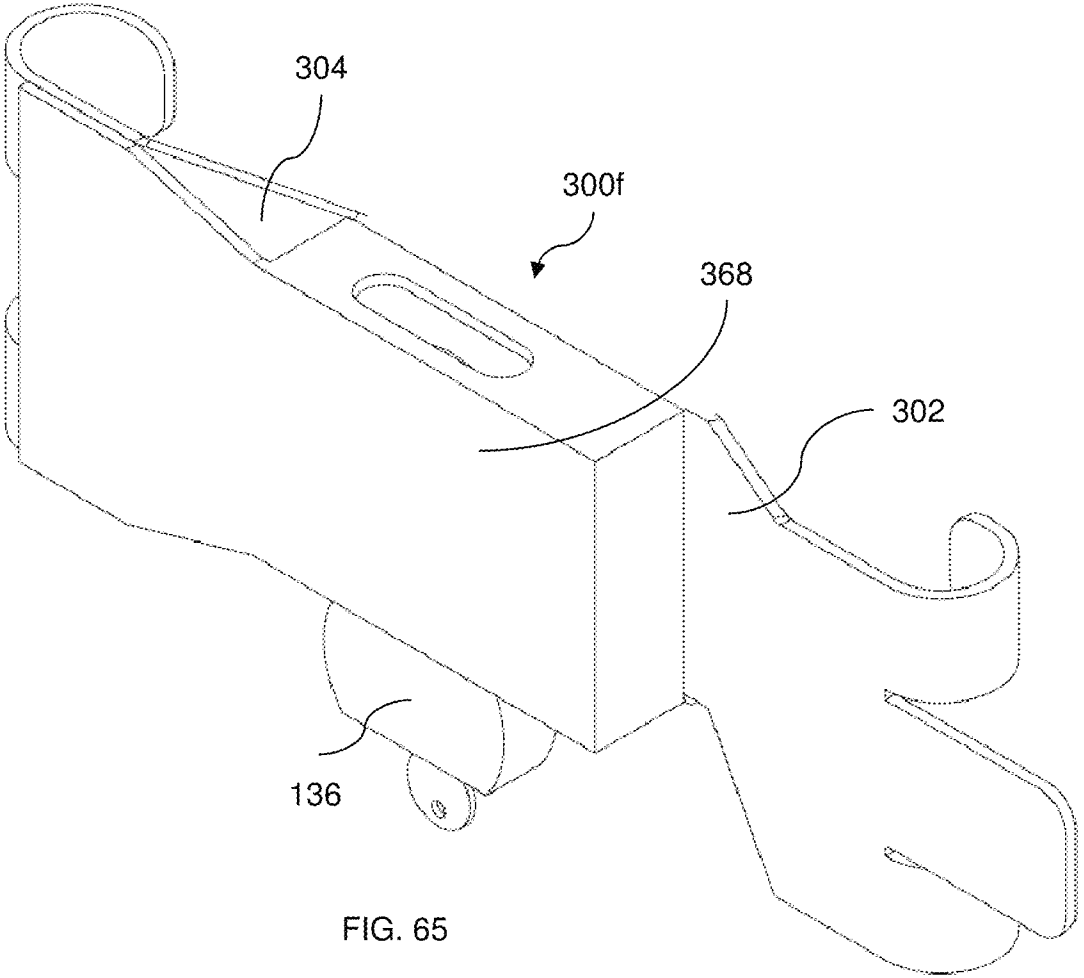
Figure 66:
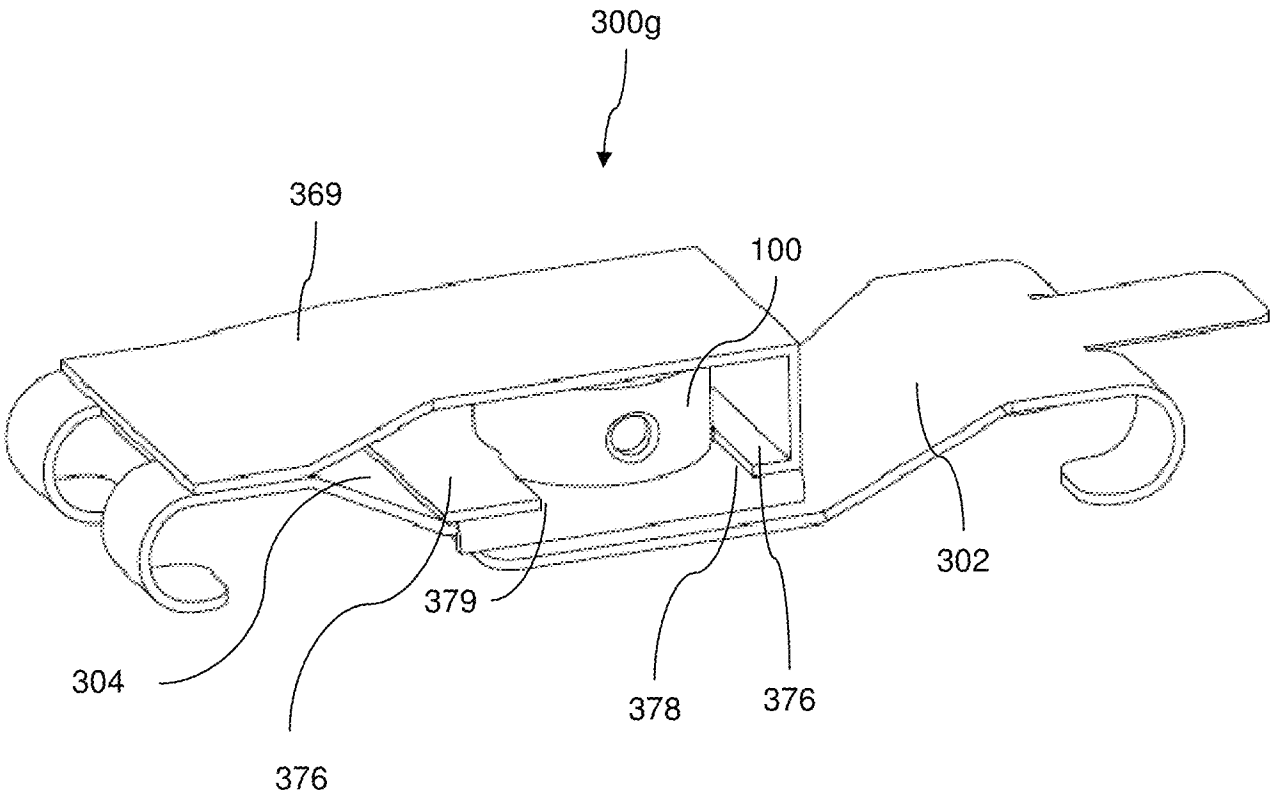
Figure 67:
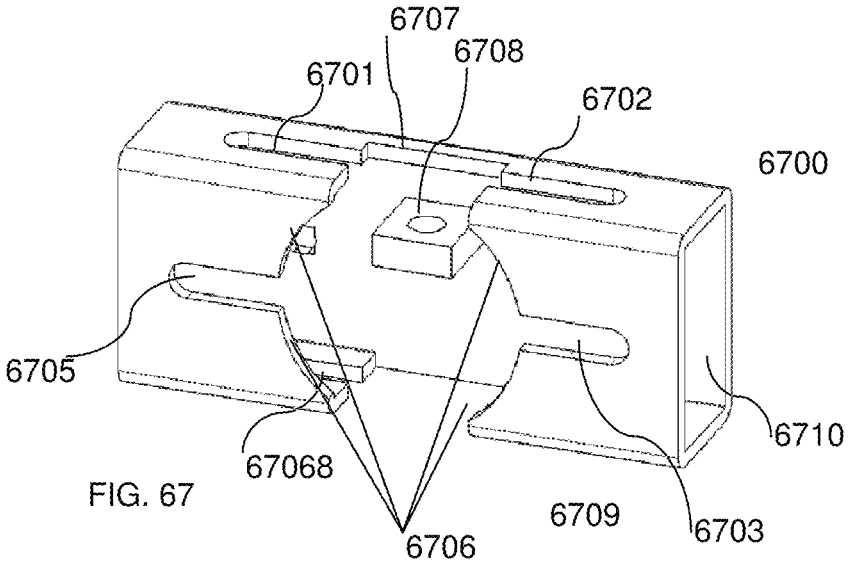
Figure 73:
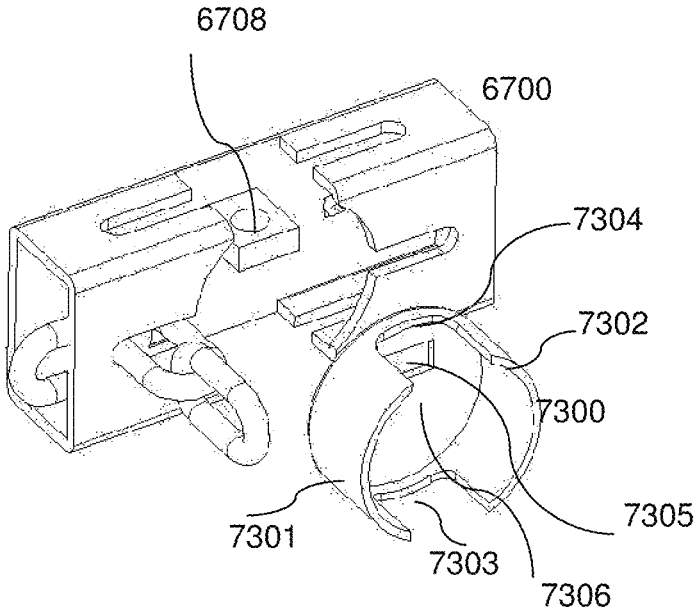
Figure 74:
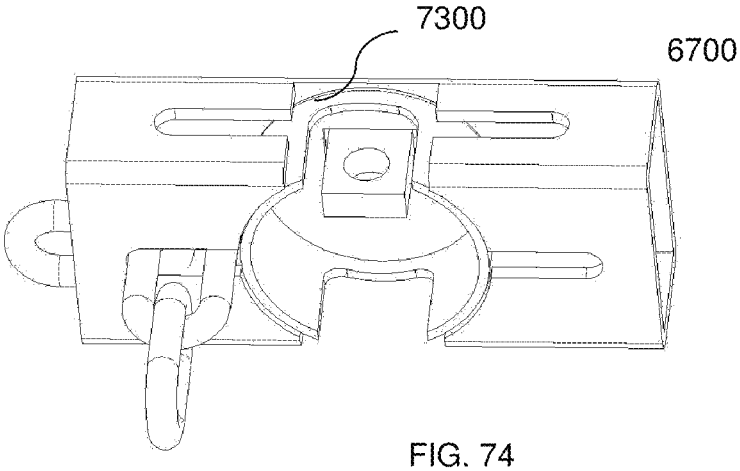
Figure 75:
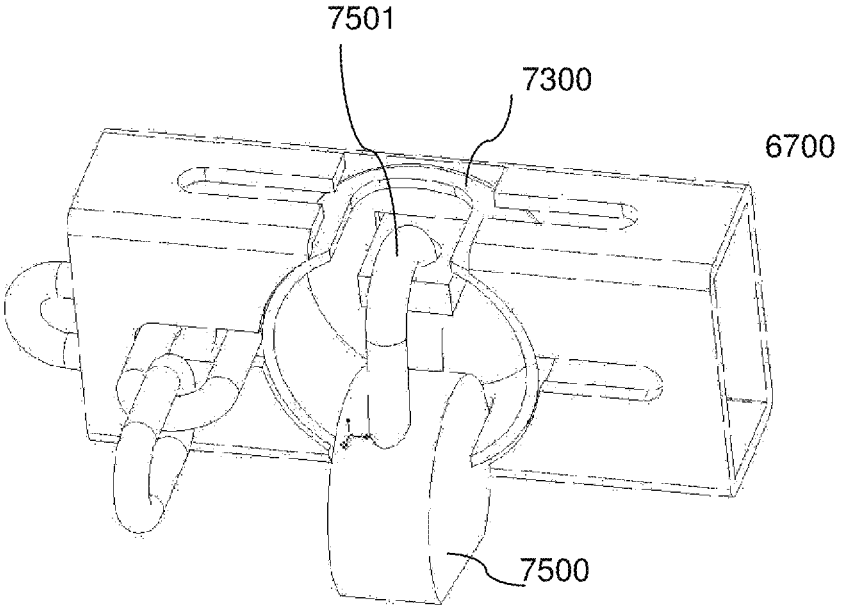
Figure 76:
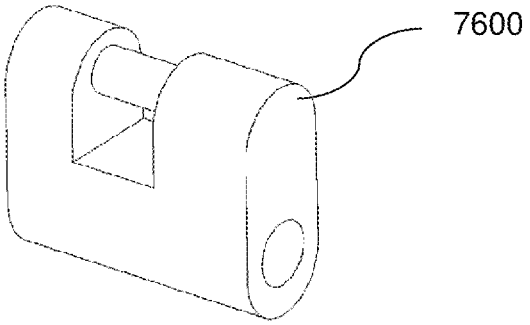
Figure 77:
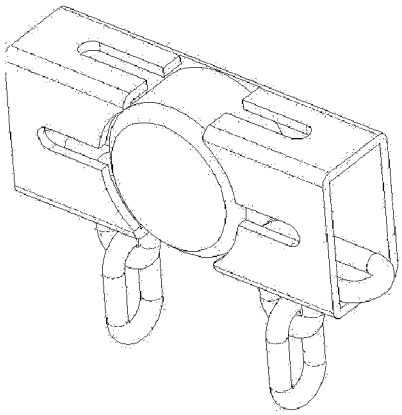
Figure 78:
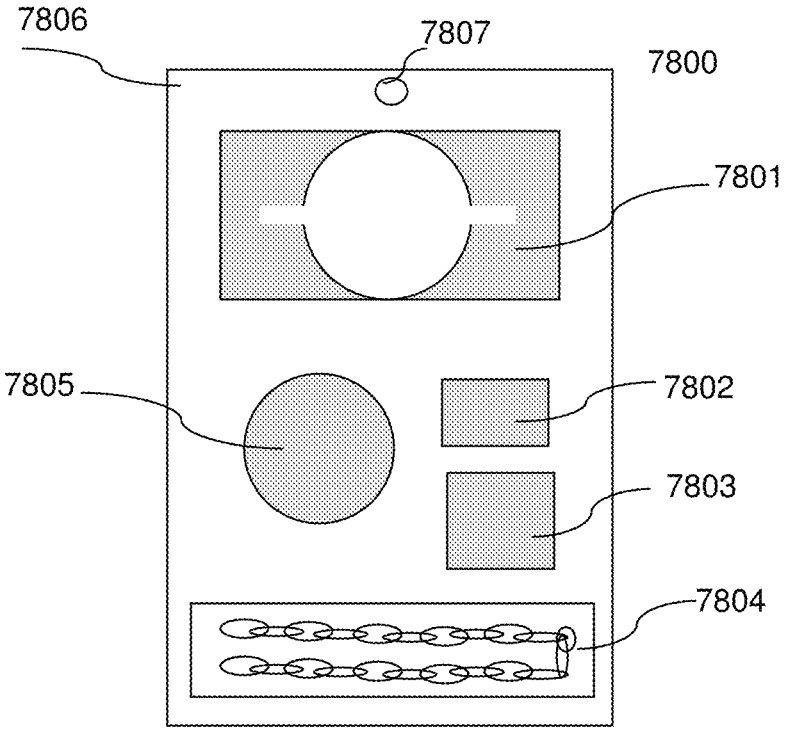
Figure 79:
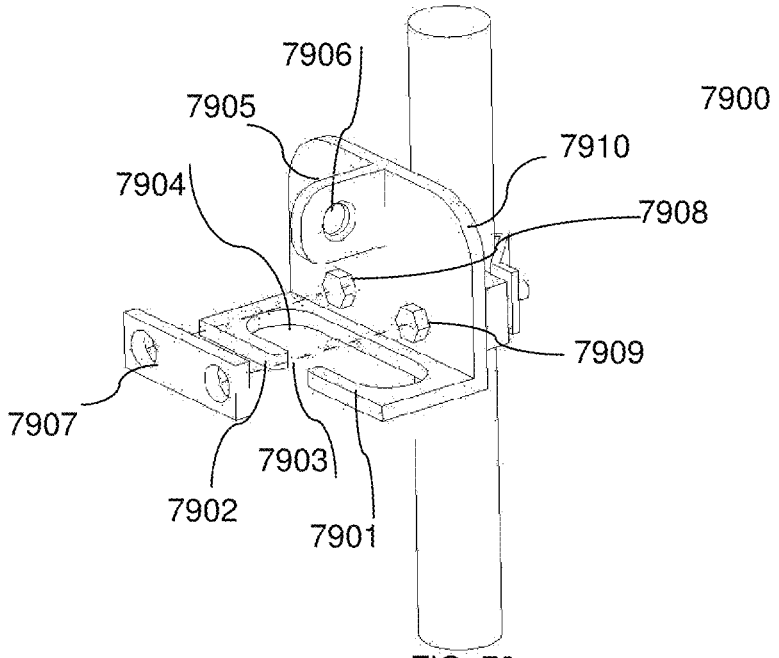
Figure 80:
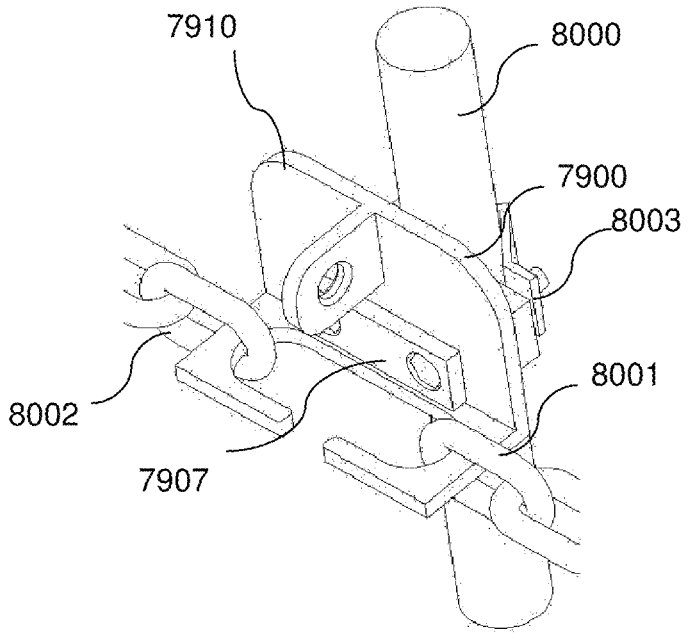
Figure 81:
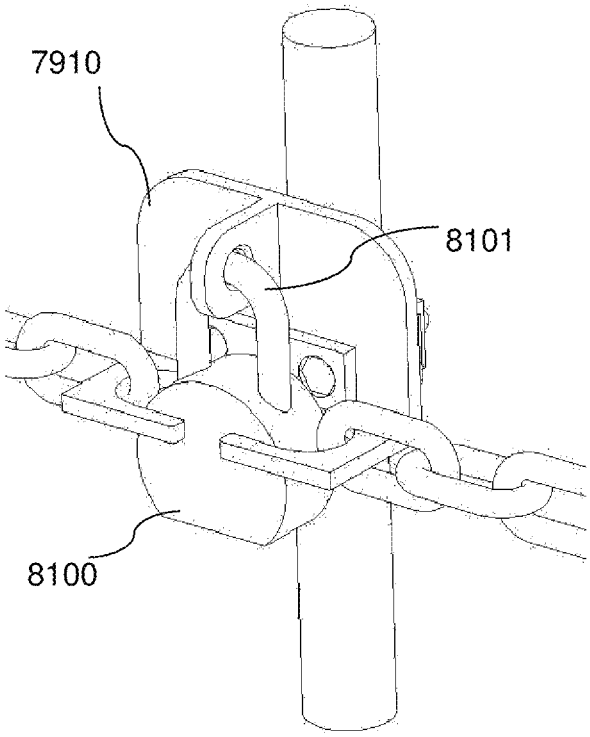
Figure 82:
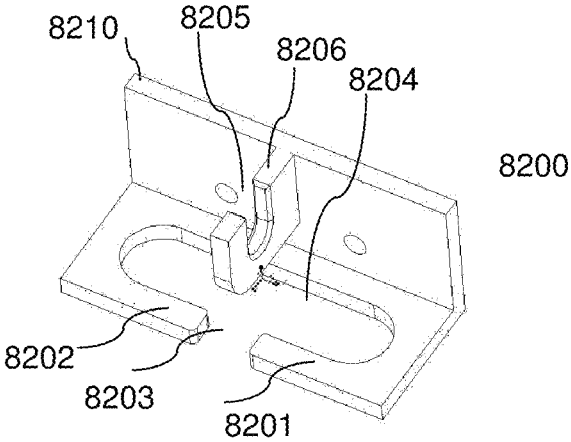
Figure 83:
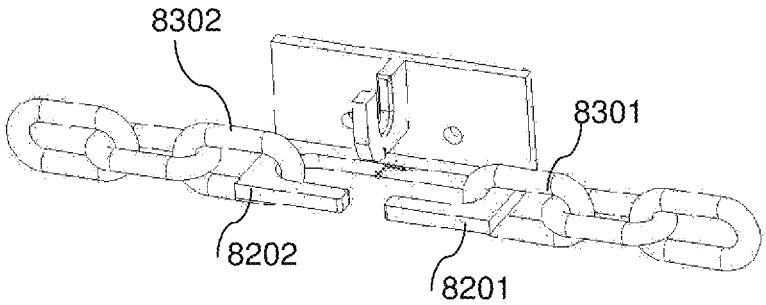
Figure 84:
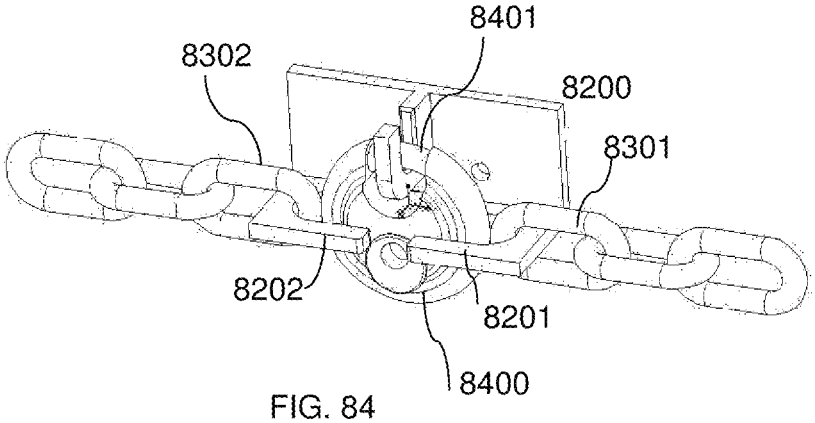
Figure 85:
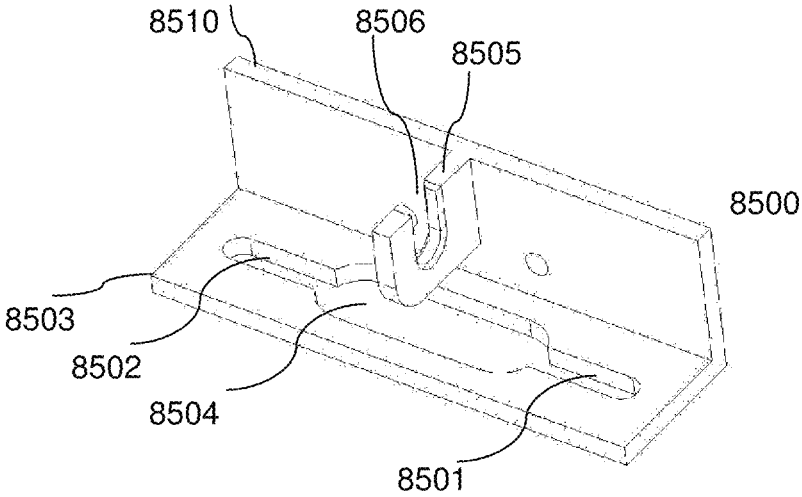
Figure 86:
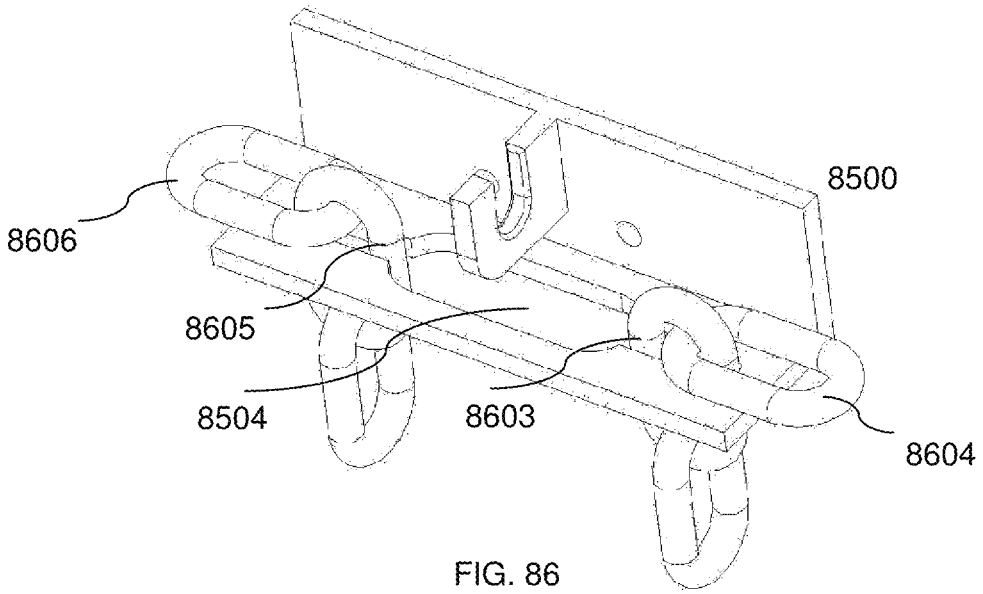
Figure 87:
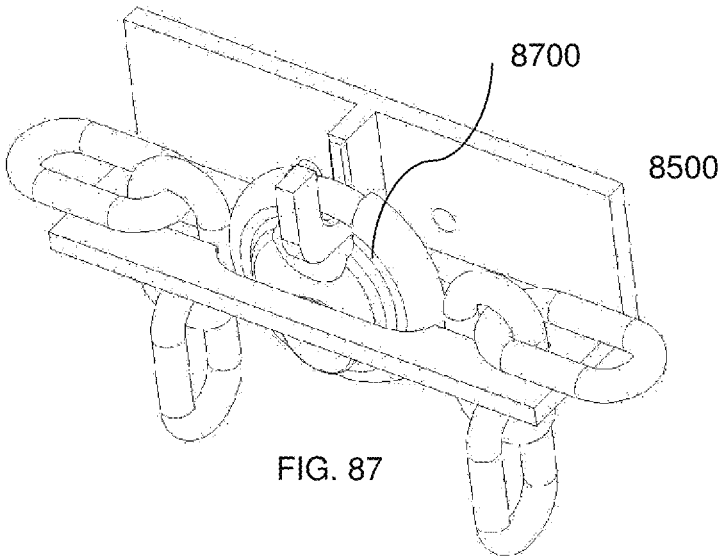
Figure 92:
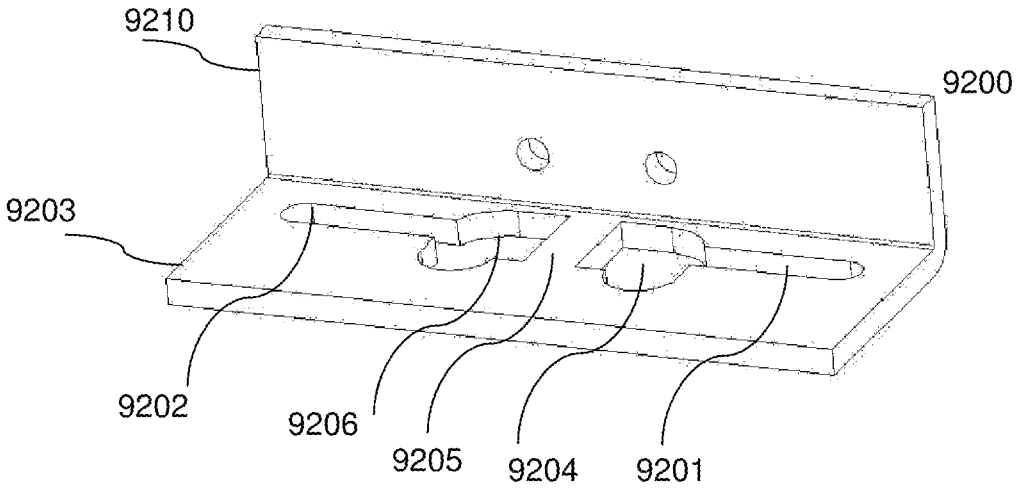
Figure 93:
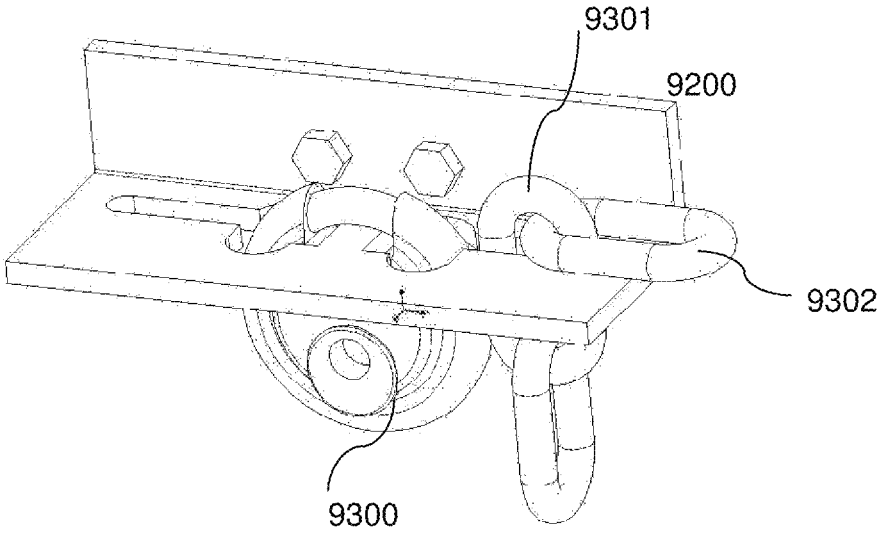
Figure 94:
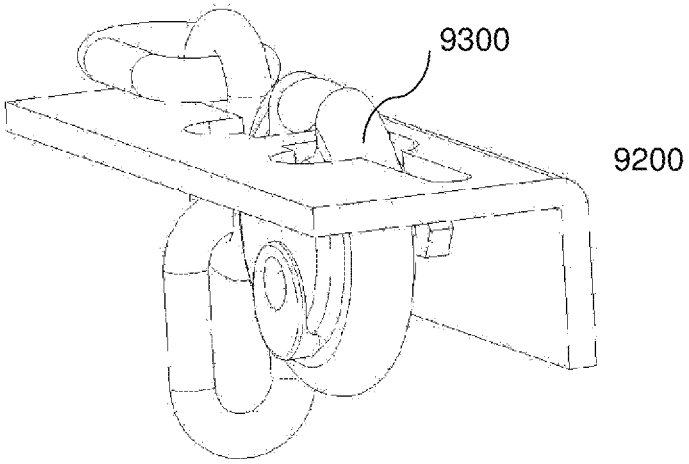
Figure 95:
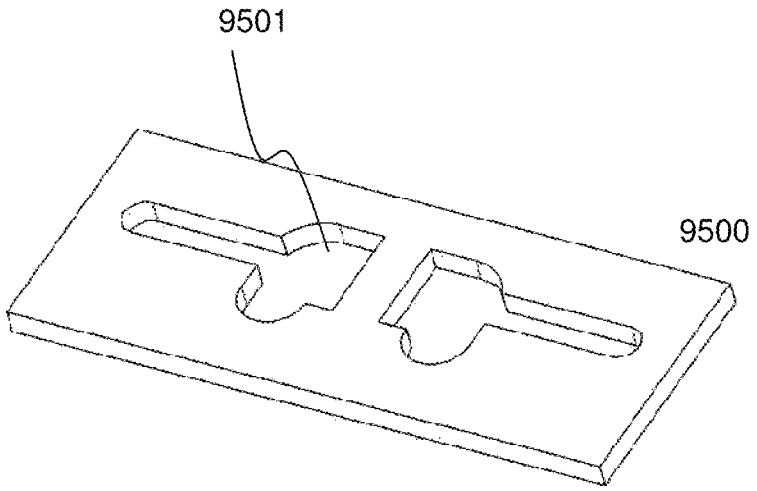
Figure 96:
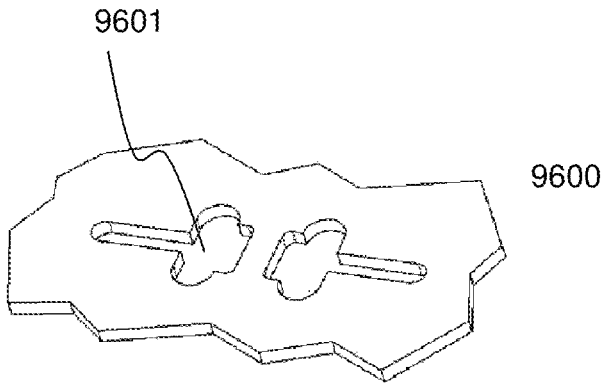
Figure 97:
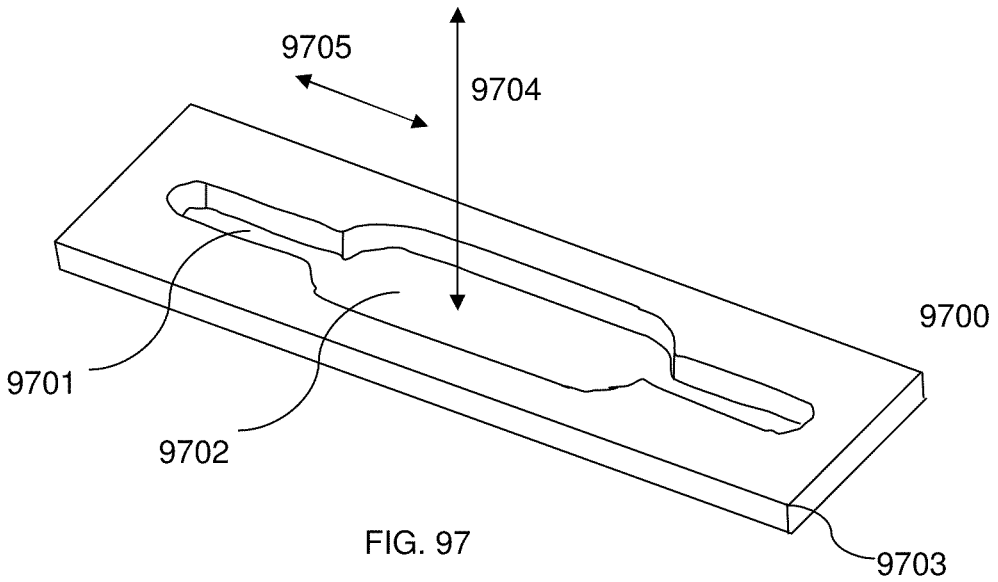
Figure 98:
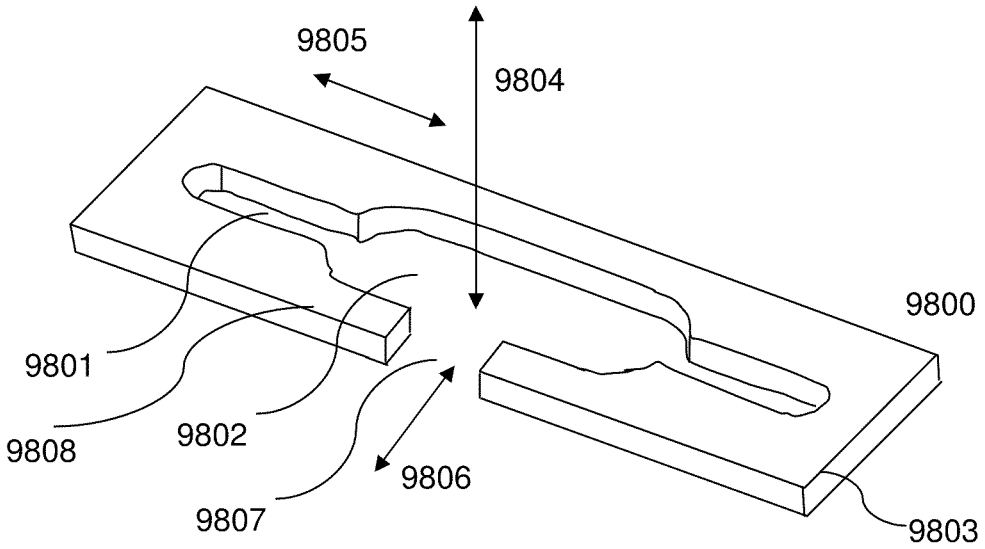

In regard to the drawings,

FIG. 1 depicts a top perspective view of a conventional hockey puck lock;

FIG. 2 depicts a bottom perspective view of the conventional hockey puck lock of FIG. 1;

FIG. 3 depicts a perspective view of a link system in accordance with certain embodiments of the present invention, with the hockey puck lock detached;

FIG. 4 depicts a perspective view of the link system of claim 3, with the hockey puck lock attached;

FIG. 5 depicts a perspective view of a link system in accordance with further aspects of the present invention;

FIG. 6 depicts a perspective view of a link system in accordance with yet another aspect of the present invention;

FIG. 7 depicts a top view of a link in accordance with an additional aspect of the present invention;

FIG. 8 depicts a perspective view of a link system in accordance with still further aspects of the present invention;

FIG. 9 depicts a perspective view of a link system in accordance with another aspect of the present invention in an unassembled condition;

FIG. 10 depicts a perspective view of the link system of FIG. 9 in an assembled condition;

FIG. 11 depicts a perspective view of a link system in accordance with still further aspects of the present invention;

FIG. 12 depicts a perspective view of the link system of FIG. 11 in use with conventional chain and padlock;

FIG. 13 depicts a perspective view of the link system of FIG. 11 in use with a conventional chain and straight-shackle lock;

FIG. 14 depicts a perspective view of the link system of FIG. 11 in use with a conventional chain and circular shackle lock;

FIG. 15 depicts a perspective view of a conventional locking assembly used on barn-style doors of intermodal containers, trailers, and the like;

FIG. 16 depicts a frontal perspective view of a link system in accordance with further aspects of the present invention in conjunction with the conventional locking assembly shown in FIG. 15;

FIG. 17 depicts a rear perspective view of the link system and locking assembly shown in FIG. 16;

FIG. 18 depicts a frontal perspective view of the link system and locking assembly shown in FIG. 16, with the link system in a partially secured condition;

FIG. 19 depict a frontal perspective view of the link system and locking assembly shown in FIG. 18, with the link system in a fully secured condition;

FIG. 20 depicts a frontal view of the link system and locking assembly of FIG. 19;

FIG. 21 depicts a rear perspective view of a link system in accordance with still further aspects of the present invention in conjunction with the conventional locking assembly shown in FIG. 15;

FIG. 22 depicts a top view of the link system and locking assembly shown in FIG. 21;

FIG. 23 depicts a perspective view of a link system in accordance with additional aspects of the present invention in conjunction with the conventional locking assembly shown in FIG. 15;

FIG. 24 depicts a perspective view of portions a link system in accordance with a still further aspect of the present invention, in a partially installed position;

FIG. 25 depicts a perspective view of portions of the link system of FIG. 24 in a more fully installed position;

FIG. 26 depicts a perspective view of portions of the link system of FIG. 25 in a still more fully installed position;

FIG. 27 depicts a cross section the link system of FIG. 24 in a nearly installed position;

FIG. 28 depicts a cross section of the link system of FIG. 24 in a fully installed position;

FIG. 29 depicts a perspective view of the link system of FIG. 24 in a fully installed position;

FIG. 30 depicts a perspective view of a link system in accordance with additional aspects of the present invention;

FIG. 31 depicts a perspective view of the link system of FIG. 30 with a hockey puck lock installed;

FIG. 32 depicts a partially cut-away exploded view of a link system in accordance with additional aspects of the present invention;

FIG. 33 depicts a perspective partially cut-away view of the link system of FIG. 32, in an assembled condition with a hockey puck lock;

FIG. 34 depicts a partially cut-away perspective view of a link system in accordance with still further aspects of the present invention;

FIG. 35 depicts a cut-away perspective view of a link system in accordance with further aspects of the present invention in an unlocked condition;

FIG. 36 depicts a cut-away perspective view of the link system of FIG. 35 in a locked condition;

FIG. 37 depicts a perspective view of a link system in accordance with additional aspects of the present invention in an opened condition FIG. 38 depicts a perspective view of the link system of FIG. 37 in a locked condition;

FIG. 39 depicts a perspective view of a shackle in accordance with certain embodiments of the present invention;

FIG. 40 depicts a perspective view of a shackle in accordance with certain embodiments of the present invention;

FIG. 41 depicts a perspective view of a shackle in accordance with certain embodiments of the present invention;

FIG. 42 depicts a perspective view of a shackle in accordance with certain embodiments of the present invention;

FIG. 43 depicts a partially cut-away perspective view of a link system in accordance with yet another aspect of the present invention in a locked condition;

FIG. 44 depicts a partially cut-away perspective view of the link system of FIG. 43 in an unlocked condition;

FIG. 45 depicts a perspective view of a link in accordance with a still further embodiment of the present invention;

FIG. 46 depicts a perspective view of a link in accordance with another embodiment of the present invention;

FIG. 47 depicts a perspective view of a conventional locking assembly used on barn-style doors of intermodal containers, trailers, and the like, with the addition of a bracket or hasp connected to the door in accordance with certain aspects of the present invention;

FIG. 48 depicts a perspective view of a link in accordance with further aspects of the present invention;

FIG. 49 depicts a rear perspective view of the link of FIG. 48;

FIG. 50 depicts a perspective view of one step in the assembly in the link of FIG. 48 on the locking assembly of FIG. 47;

FIG. 51 depicts a second step in the assembly of the link of FIG. 48 upon the locking assembly of FIG. 47;

FIG. 52 depicts a perspective view of another conventional locking assembly used on barn-style doors of intermodal containers, trailers, and the like;

FIG. 53 depicts an exploded perspective view of a strap in accordance with certain aspects of the present invention;

FIG. 54 depicts a perspective view of the strap of FIG. 53 assembled upon the locking assembly of FIG. 52 with certain elements not shown for clarity;

FIG. 55 depicts a perspective view of a portion of a strap in accordance with still further aspects of the present invention, with portions of the locking assembly of FIG. 52 shown;

FIG. 56 depicts a perspective view of a fully assembled strap in accordance with still further aspects of the present invention with portions of the locking assembly of FIG. 52 shown;

FIG. 57 depicts a exploded perspective view of portions of a strap in accordance with still further aspects of the present invention with portions of the locking assembly of FIG. 52 shown;

FIG. 58 depicts a partially exploded perspective view of an adjustable strap in accordance with yet another aspect of the present invention;

FIG. 59 depicts an exploded perspective view of a nonadjustable strap in accordance with certain aspects of the present invention;

FIG. 60 depicts a top plan view of the strap of FIG. 59;

FIG. 61 depicts a strap with link assembled upon the locking assembly of FIG. 52, in accordance with certain aspects of the present invention together with a hockey puck lock outside the link;

FIG. 62 depicts a strap of FIG. 61 in a fully locked condition with a hockey puck lock installed;

FIG. 63 depicts the strap of FIG. 61 in a locked condition with a conventional pad lock installed;

FIG. 64 depicts an exploded perspective view of a strap in accordance with still further aspects of the present invention;

FIG. 65 depicts a fully assembled perspective view of the strap of FIG. 64 with a padlock installed;

FIG. 66 depicts a fully assembled perspective view of a strap in accordance with still further aspects of the present invention in a fully assembled condition;

FIGS. 67-72 depict a perspective view of a link system in accordance with certain embodiments of the present invention, that may be used with the hockey puck lock;

FIGS. 73-75 depict a perspective view of a link system in accordance with another aspect of the present invention while applying a security link adaptor as a blocking element;

FIG. 76 depicts a perspective view of a straight shackle padlock;

FIG. 77 depicts a perspective view of the link system of FIG. 67 in use with a conventional chain a hockey puck lock;

FIG. 78 is a diagram of a kit with a security link in accordance with an aspect of the present invention;

FIGS. 79-81 depict a perspective view of another embodiment of a security link;

FIGS. 82-84 depict a perspective view of yet another embodiment of a security link;

FIGS. 85-87 depict a perspective view of yet another embodiment of a security link;

FIGS. 88-91 depict a perspective view of yet another embodiment of a security link;

FIGS. 92-94 depict a perspective view of yet another embodiment of a security link;

FIG. 95 depicts a perspective view of yet another embodiment of a security link;

FIG. 96 depicts a perspective view of yet another embodiment of a security link;

FIGS. 97 and 98 illustrate the process of entering and leaving a secured position in a security link by a securing member.

Figure 104:
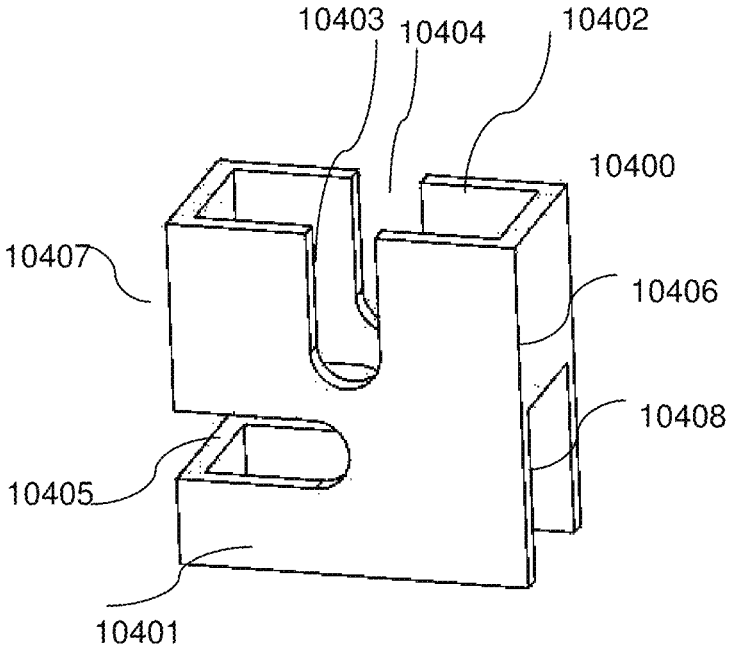
Figure 105:
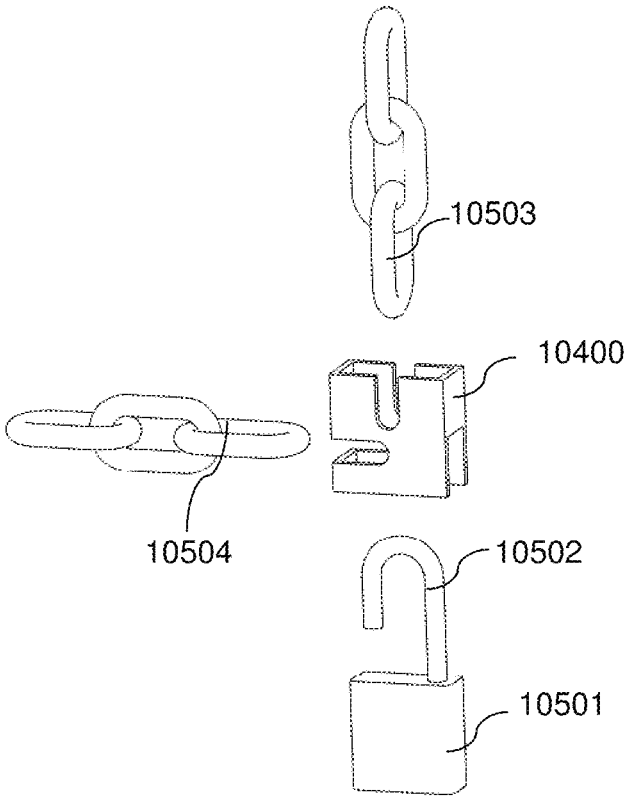
Figure 106:
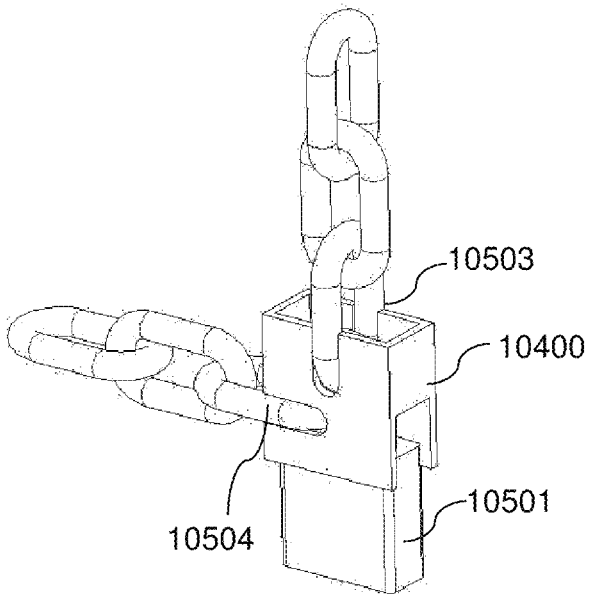

FIGS. 99-103 depict a perspective view of yet another embodiment of a security link;

FIGS. 104-106 depict a perspective view of yet another embodiment of a security link; and FIGS. 107-119 depict a perspective view of different embodiments of a security link.

DETAILED DESCRIPTION

The following describes the preferred embodiments of the multiple function lock in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

It will become evident to one skilled in the art that several objectives and advantages of this invention follow from the novel aspects of the present invention by which the traditional security functions are achieved using multiple security elements in combination.

Throughout this disclosure, the term shackle shall be construed broadly to include the portion of a lock which extends from the body and which is typically moveable to engage with securing members such as hasps, chain, cable or the like.

FIG. 1 depicts a perspective view of a conventional cylindrical, hidden shackle pad lock, commonly referred to as a hockey puck lock 100. The hockey puck style lock 100 includes an outer casing 111 which is shaped in a manner similar to that of a hockey puck, thus giving the lock its name.

Shown in FIG. 2 is a bottom perspective view of a conventional hockey puck lock 100. The drawing figure shows shackle 102 and anti-torque step 104. The step 104 is typically part of the standard form factor of a conventional hockey puck lock 100, and is a built-up shoulder area formed as part of outer casing 111. Other embodiments may have a flat bottom. However, if provided, the step 104 may cooperate with associated appurtenances to prevent the hockey puck lock 100 from rotating. This reduces the ability of a malfeasant from placing a torque or twisting force on the shackle 102 in an attempt to compromise the shackle and thus the security of the lock 100. Even with the step 104 in place, the bottom of the conventional hockey puck lock 100 is still generally vulnerable to attack, particularly where the shackle 102 is exposed.

The hockey puck lock 100 utilized in the present invention may be operated in the conventional manner. For example, the shackle 102 may be manipulated by a keyed cylinder 105, as is known in the industry.

FIG. 3 depicts a partially exploded perspective view of a link **106*a* in accordance with certain aspects of the present invention along with a hockey puck lock 100 and chain 103. In accordance with the aspects of the invention depicted in FIG. 3, a link 106*a* may be compatible with flexible or non-flexible securing devices, such as either chain 103 or cable having end loops. Chain 103 is shown in FIG. 3. For ease of reference, chain 103** will generally be referred to throughout the various aspects of this disclosure. However, it is to be understood that other securing devices may also be utilized, flexible or not.

The link **106*a* may include a base 107 having a pair of extension members, here shown as protruding ears 109. The protruding ears are preferably C-shaped, with openings 113. In other embodiments, the extension members may be U-shaped or J-shaped. The base 107 and ears 109 of the link 106*a* may be configured such that a chain 103 may be placed over and around the ears 109, through opening 113, such that the ears prevent the chain from being pulled from the link. This arrangement is shown in FIG. 3**.

After being placed in such an arrangement, the chain 103 may be followed by a conventional hockey puck lock 100, such that the hockey puck lock 100 blocks the chain from being removed from the ears 109 through the opening 113 without prior removal of the hockey puck lock, such as shown in FIG. 4. It will be appreciated that the ears 109 are configured such that the space between the free end 119 of the ears is relatively close to the outer casing 111 of lock 100, or at least close enough that chain 103 may not fit therebetween. In other embodiments, the ears 109 may include pins or posts 115 which may either be installed permanently to secure the chain 103, or may be removable. Typically, only one pin 115 will be permanently installed and the opposite ear 109 will be provided without a pin, such that chain 103 may be attached and detached from the pinless ear. Even if the pins or posts 115 are installed permanently, the hockey puck lock 100 serves to provide an additional level of protection for the link system. The ears 109 may also include embedded magnets 125 to help retain ferrous metal securing devices, such as chain 103, during installation thereof.

Referring back to FIG. 3, it will be appreciated that when installed upon the link **106*a*, the shackle 102 (FIG. 2) of the hockey puck lock 100 engages a through channel 101 extending through the pin or post 114 protruding from the link 106*a***, to secure the hockey puck lock to the link in the conventional manner.

Features of the link **106*a* in accordance with this embodiment may include a raised lip 108 extending from the base 107 to prevent a prying or wedging attack when the conventional hockey puck lock 100 is in place. The lip 108 may be notched with a cutout 117 to allow access to the keyed cylinder 105 of the hockey puck lock 100. Mounting holes 112 may be provided in the bottom of the link 106*a* to allow mounting of the link 106*a* to a surface using carriage bolts or the like. A center mounting hole 112 may be provided to allow the link 106***a* to be mounted to a surface while also permitting the link to be rotated. The link 106*a* may also be welded to a surface or used un-mounted, so as to be freely transported.

The free end 119 of the ears 109 may be contoured to minimize the gap between the free end of the ears and the lock body 100 when the lock is in place, such as shown in FIG. 4. As previously discussed, the ears 109 may also include a feature, such as a simple post or pin 114, which allows one or both ends of the chain or cable to be retained permanently.

In addition, the link 106*a* may include an anti-rotation step 135 within the raised lip 108. The anti-rotation step 135 may be configured to mate with the step 104 of hockey puck lock 100, such that the lock may not be rotated when installed.

The link 106*a* may be fabricated by machining, casting, welding, molding, forging, etc. Materials utilized may be suitable ferrous or non-ferrous metallic alloys or suitable non-metallic materials, such as plastics. Preferably, the link 106*a* is formed from material which is sufficiently durable to withstand forced attack, while also being capable of long-term external exposure.

It will be appreciated that when the chain 103 is pulled, such as during a forced attack or other tension inducing activity, the loads, or forces applied, to the chain will be transferred through the link 106*a*, and particularly the ears 109. The loads will not be transferred to the shackle 102 of the hockey puck lock 100 as would occur if the hockey puck lock was used without the inventive link 106*a*. This feature enables security levels greater than would be capable if the shackle 102 was required to withstand the load, and is utilized in further embodiments of the invention, as will be discussed. In this regard, the strength of the link 106*a* and ears 109 may be much greater than that of the lock 100, while still being very cost-effective and simple to manufacture.

FIG. 5 depicts a perspective view of a link 106*b* in accordance with further aspects of the present invention with a chain 103 attached, but without a hockey puck lock 100 in place. The link 106*b* depicted in FIG. 5 includes posts 116 formed from portions of the raised lip 108 of the base 107 rather than ears 109. The posts 116 permit the end or ends of a chain 103 to be assembled onto the link 106*b* by being placed over the posts 116 and into a recess 123. The posts 116 include a stepped portion 121 which is above the level of the recess 123. A hockey puck lock 100 may be placed upon the stepped portion 121 when installed. In this regard, securing of the shackle 102 of the hockey puck lock 100 through the through channel 101 of post 114 places the casing 111 of the hockey puck lock over the chain 103, to secure the chain to the link 106*b*. Unless the hockey puck lock 100 is removed, the chain 103 cannot be released from the link 106*b*.

Although not shown in association with this particular aspect of the invention, it is noted that the recess 123 permits use of a feature that may retain one or both ends of the chain 103 when the hockey puck lock 100 is not in place. Such a feature, not shown, may be a simple-screw threaded into the link 106*b* adjacent to the recess 123 such that the head of the screw may be driven against chain 103 to block the chain from being removed from the recess 123. Other mechanisms, such as rotating blocking gates, or embedded magnets may also be utilized.

It is believed that the link 106*b* shown in FIG. 5 is easier and more cost effective to manufacture than the link 106*a* shown in FIGS. 3 and 4. It is also believed that the link 106*b* shown in FIG. 5 may be more secure than the previous link 106*a* because the ears 109 of the previous link 106*a* may be vulnerable to attack, particularly through prying away of the ears. It is much more difficult to forcibly attack the posts 116 of the link 106*b* shown in FIG. 5, as there is less area for a malfeasant to attack. Even if a malfeasant were capable of prying a post 116 away from its generally vertical orientation, the chain 103 would not readily lift from the post, as the hockey puck lock 100 would still retain the chain. Rather, the entire hockey puck lock 100 would have to be removed or the post 116 severely compromised.

In accordance with yet another aspect of the present invention, as shown in FIG. 6, a link 106*c* may build on the teachings of the previous link 106*b*. In this regard, the link 106*c* may include a recess (here identified as arched recess 118) and a post 116. This portion of the link 106*c* may secure one end of a cable 127 that includes a looped end 129*a* forming a shape much like a chain's end. Of course, this arrangement may also secure other mechanisms such as simple chain.

The link 106*c* may also be compatible at its other side with a straight portion 131 of cable 127. In this regard, the link 106*c* may include a straight channel 120 in which the straight portion 131 of the cable 127 may lie. The straight channel 120 may be sized to just accept the diameter of the cable 127, such that the looped end 129*b* opposite the post 116 and looped end 129*a* may not pass therethrough. It will be appreciated that other features other than a looped end 129*b* may also be utilized to prevent the cable from being slid through the straight channel 131. For example, the end of the cable 127 may be built-up to a larger diameter than the remainder of the cable, or may include a feature such as a ball at its end.

When the hockey puck lock 100 is not in place, the cable 127 may be nested in the straight channel 120 shown. When the hockey puck lock 100 is in place, the cable 127 is restrained and secured, but may still be able to be slid partially in and out of the link 106*c*, along straight channel 120. The hockey puck lock may simply prevent the cable 127 from being lifted off the link 106*c*.

However, a ratchet device 122 may be provided within the link 106*c* such that once the cable 127 is nested in the straight channel 120, the cable may be cinched up to remove unwanted slack. The cable 127 may be cinched up before or after the hockey puck lock 100 is in place. The ratchet device 122 may be designed such that the cable 127 may be nested into the straight channel 120 from either the direction permitted by the ratcheting device, or from a direction above the link, perpendicular to the channel 120. However, once the hockey puck lock 100 is in place, the ratchet device 122 may only permit cable movement in one direction. In this regard, the ratchet device 122 may include teeth and may be spring loaded to facilitate only one way motion of the cable 127. The ratcheting device 122 may also, include a ratchet-override feature to permit the cable to be moved in a direction otherwise prevented by the ratchet device. Such ratcheting devices are well known in the industry.

Because coated cable 127 is typically preferred, it is generally preferred that the ratchet device 122 be arranged such that it does not mar the coating of the cable upon normal use.

As with the previous links shown and described, the shackle 102 of the hockey puck lock 100 may engage through channel 101 extending through a post 114 protruding from the link 106*c*.

FIG. 7 depicts a top view of a link 106*d* in accordance with additional aspects of the present invention. As with link 106*c*, link 106*d* is primarily intended for use with a cable. A looped end of the cable (not shown) may be nested into the arched channel 118 as previous discussed with reference to link 106*c*. When the hockey puck lock is not in place, the cable (not shown) may be pushed into the irregular channel 124 shown. This irregular channel 124 is shaped to prevent the cable from being able to move along the long axis of the channel. This may be achieved by friction fit of the cable within the channel 124. Therefore, when the hockey puck lock 100 is in place, the cable is fully constrained and secured. Again, coated cable is preferred. As with the previous links, link 106*d* may be configured with a post 114 and through channel 101 upon which a hockey puck lock 100 may attach.

Another variation of the link 106*d* is to configure a second irregular channel in place of the arched channel 118. This variation would allow the use of cable which is un-looped at both ends, thus expanding the potential uses for the device. Additionally, a link may be provided with two ratcheting devices and channels such as those shown in FIG. 6, so un-looped cable may be used at both ends. Generally, it will be appreciated that many of the features of the various links disclosed herein may be utilized in any one particular link, such that the features may be "mixed-and-matched."

In accordance with additional aspects of the invention, a link may be configured for use with intermodal containers, trucks, rail cars, etc. It is common and well known in the industry that such containers may have a door locking arrangement that utilizes vertical lockrods connected to a lever. The vertical rods may be lifted out of their seat and rotated such that latching elements at the end of the rods are disengaged and released from their mating elements on the door frame. The typical lever arrangement is a well known weak point that is vulnerable to attack. A conventional arrangement of vertical lockrod, lever and latches is shown in FIG. 15, and is described more fully below.

As shown in FIG. 8, link 106*e*, may be designed to fit a wide range of lockrod configurations. Variations in vertical lockrod configurations include, center to center spacing, gap between the vertical lockrod and the door face, and rod diameter. Link 106*e* is comprised of three primary elements: namely, a first hook 126 to hook around one vertical lockrod, an attachment element 128, and a second hook 130 that hooks around the other vertical lockrod. First hook 126 is preferably formed as a single structure with attachment element 128.

The link 106*e* has an array of features that allow adjustability over the typical ranges of lockrods. For example, the hooks 126, 130 are of a thickness (t) that permit them to be used where there is a narrow gap between the rods and the door face. The link 106*e* is also designed to accommodate the typical range of lockrod diameters by incorporating an oversized width (w).

The attachment element 128 is designed to receive a standard hockey puck lock to secure the hooks 126, 130 in place. Also as shown, hook 130 includes a series of apertures 132 arranged adjacent to one another along the length of the hook 130. Depending on the center to center distance of the vertical rods in which the link 106*e* is to be placed, the appropriate aperture 132 may be placed over the post 114 protruding from the attachment element 128, such that the hooks 126, 130 will be retained by the hockey puck lock 100 when installed and the overall length (L) of the link 106*e* will be appropriate for the application.

In addition, the link 106*e* shown in FIG. 8 may also be utilized with chain 103 or the like. For example, the hooks 126, 130 may be hooked around the chain and the link 106*e* locked. The hooks 126, 130 may be made long enough that so long as the chain is left taut, the chain may not be removed from the hooks. Other uses for the link 106*e* may include fence gates, such as chain link fence gates, where the hooks may be used to secure the gate from opening by attaching to the vertical fence gate supports.

In accordance with further aspects of the present invention, a link adaptor 134 may be provided for use with a link. FIG. 9 depicts a perspective view of a link system incorporating the link adapter 134 together with a link 106*b*, of the type described previously, and a conventional padlock 136. The link adapter 134 allows the conventional U-shackle padlock 136 or other padlock styles beyond that of the hockey puck locks 100 to be used with the various links of the present invention.

In general, the link adaptor 134 comprises a circular plate 138 with an aperture 140 therethrough. The plate 138 includes a step 139, which acts to prevent rotation of the link adaptor 134 in a similar manner as the step 104 of a conventional hockey puck lock 100. The plate 138 is configured to fit over the link 106*b*, such that the aperture 140 may fit over the post 114. The link adaptor 134, therefore, fixes the chain or cable in place, depending on the embodiment of the link 106*b*, in a similar manner as previously described with respect to the hockey puck type locks. In this regard, the plate 138 may be fairly thick, such as where the link includes ears, or thinner where posts are utilized. Once the link adaptor 134 is placed over the link 106*b*, a conventional padlock 136 may then be utilized to secure the link adaptor in place by being threaded through the through channel 101 of post 114, as shown in FIG. 10.

FIG. 11 depicts a perspective view of a link in accordance with yet another aspect of the present invention. As previously discussed, links are elements which allow chain or looped cable (or other securing means) to be secured using conventional padlock devices, while providing a mechanism other than a conventional lock which may sustain forces placed on the system during forced attack. Links are designed to accept common chain, cable, and lock dimensions.

Link 106*f* maintains the utility of the previous links, but in a simpler manner. In accordance with the present invention, a link 106*f*, as shown in FIG. 11, may comprise a body 141 having two through holes, referred to here as apertures 142, 144, adapted to accommodate padlocks of different sizes and configurations, such as straight shackle padlocks, circular shackle padlocks, or U-shackle padlocks. The body 141 of link 106*f* may also comprise a pair of arms 146, 148 which are adapted to thread through standard chain, looped end of cable, or the like, as will be discussed.

Link 106*f* may be machined, stamped, forged, cast, molded, etc. Materials utilized for the link 106*f* may be suitable ferrous or non-ferrous alloys or other suitable material, such as plastics. In addition, the link 106*f* may be coated for protection, such as with a plastic coating from protection from outdoor elements.

FIG. 12 depicts a link 106*f* in operation connecting two separate ends 103*a* of chain 103 along with a conventional padlock 136 installed for use. As shown, the link 106*f* comprises a pair of arms 146, 148 around which the respective chain ends 103*a* may be placed. The arms 146, 148 are spaced apart such that a suitable padlock 136 may then be inserted between the arms 146, 148 and chain ends 103*a*, to prevent the ends from being removed from the link 106*f*. In this regard, although it is preferred that the chain ends 103*a* abut the body of the lock 136, it will be appreciated that they need not, and it is merely sufficient that the chain end 103*a* cannot fit between the body of the lock 136 and the respective arm 146, 148. The lock shackle may then be threaded through one of the two apertures 142, 144, depending on the size of the lock, to hold the lock in place. As shown in FIGS. 14 and 15, locks of various configurations, including straight shackle 136*b* and circular shackle 136*c*, may also be utilized. In addition, it will be appreciated that the link 106*f* may include only one aperture, or more than two apertures.

As discussed with regard to other aspects of the invention, the load transferred through the chain 103 will be borne by the link 106*f*, and not by the conventional padlock 136. This novel teaching adds security to any system locked in such a manner, as the tensile strength of the link 106*f* can be made much stronger than that of the pullout strength of a conventional lock 136. Or, in the alternative, a lock 136 with a lesser pullout strength, and thus a likely less expensive lock, may be utilized with a link 106*f* to provide security levels not before capable with the simple and inexpensive lock.

In accordance with further aspects of the invention, a locking device may be incorporated for use with vertical lockrods, latch handles, and hockey puck locks, of a typical intermodal container, trailer, or the like, as discussed with respect to the aspects of the invention shown in FIG. 8 and as discussed herein. FIG. 15 depicts a conventional arrangement of a vertical lockrod 200, handle 202, and hasp mechanism 204, commonly used on intermodal containers and barn door style doors found on truck trailers, where the handle is connected to the lockrod by a hinge 203. Use of these conventional systems is well known in the industry. It is also well known that common attack points for forced entry are the rivets 205 holding the hasp mechanism 204 to the door and the rivets 207 of the hinge 205.

FIG. 16 depicts a perspective view of a security link system in accordance with further aspects of the present invention. Included in this embodiment is a strap 206 hooked around a vertical lockrod 200 and an embodiment of a security link 208*a* slipped onto the latch handle 202. The strap hook 210 is configured to allow the strap 206 to be placed onto the lockrod 200 while being capable of being swung or otherwise rotated to a position where it may engage with the security link 208*a*. The security link 208*a* has a passage 212 that permits the security link to slide along the latch handle 202 to retain adjustability along the long axis of the handle. The strap 206 may include a cutout 209 that allows portions of the hasp mechanism 204 to protrude and be used with seals and or padlocks as is conventional practice today. After the strap 206 is hooked around the vertical lockrod 200, it may be swung inward toward the container to engage or nest with the security link 208*a*, which includes portions that extend through apertures 214*a*, 214*b*, and 214*c*, extending through the strap. As will be discussed, it will be appreciated that the strap may be configured in non-planar sections to closely align with the handle, such that the lock is offset toward the door.

FIG. 17 depicts a rear view of the strap 206 showing hook element 210 in greater detail. As shown, the hook 210 may be configured to be sized smaller than the remainder of the strap 206, such that the hook will not interfere with the hinge 203, when the strap is rotated.

FIG. 18 depicts a perspective view of the strap 206 fully engaged/nested into the hasp mechanism 204 and the security link 208*a*.

FIG. 19 depicts a perspective view of the system shown in FIG. 16, along with a hockey puck lock 100 in place. As previously indicated, this is the locked condition of the system. If desired, a conventional padlock may also be utilized on the hasp 204.

FIG. 20 depicts a front view of the system shown in FIG. 16.

FIG. 21 depicts a rear perspective view of strap 216 in accordance with a further aspect of the present invention, wherein the strap includes two hook tabs 218*a*, 218*b*, bracketing the hinge 203. Strap 216 otherwise may be operable in the same manner as strap 206, discussed previously.

FIG. 22 depicts a top view of the strap assembly shown in FIG. 21, with a hockey puck lock installed. It will be noted that in the previous aspects of the invention, the straps have provisions such that the hasp 204 is permitted to penetrate through the strap, such that it may be used. Even so, it is preferred that the rivets 205 securing the hasp to the door remain covered. In this manner, the rivets are then difficult for the malfeasant to attack. Similarly, it is preferred that the rivet 207 forming a portion of the hinge 203 also be protected. In accordance with further aspects of the present invention, as shown in FIG. 23, additional safety features may be incorporated.

FIG. 23 depicts a perspective view of a further aspect of a strap in accordance with the present invention. In this aspect, a strap 220 does not have a cutout for the hasp assembly 204. The hasp assembly 204 is therefore completely covered and protected when the strap 220 is closed and the conventional hockey puck lock 100 is in place. In this regard, the strap may include additional extensions 221 (shown in dashed form for clarity) which may completely cover the hasp 204.

FIG. 24 depicts a strap 250 in accordance with a further aspect of the present invention. In this aspect, the strap 250 may be constructed with less material, to save cost and weight. The strap 250 may be similar to the previous straps discussed, including the provision of strap hook 210. As shown in FIG. 24, strap hook 210 may be secured around the vertical support 200 of a conventional intermodal container type lock mechanism. The strap may then be swung inward, toward the door, into the position shown in FIG. 25. It is there more clearly shown that the strap 250 may include a tapered section 252 culminating at a distal end 254 with a squared section 256. The squared section may include extensions 258 to partially encircle the handle 202.

Also shown in FIG. 25 is a link 208*b*. Link 208*b* is similar to link 208*a*, except link 208*b* includes a deeper base section 260 with an aperture 262. The aperture 262 is sized and configured to accept the distal end of the strap 250 and the handle 202, as shown in FIG. 26.

Also shown in FIG. 25, it will be appreciated that the strap 250 includes notches 264 in its tapered section 252. The notches, as will be discussed, help to prevent the hockey puck lock 100 and link 208*b* from being slid off the handle 202, when the hockey puck lock is installed.

In this regard, the link 208*b* may be provided with a moveable plate 266. The plate 266 may include the post 114 on one side that the hockey puck lock 100 attaches to, and pins 268 (FIG. 27) on the other. The pins 268 associate with the notches 264 to prevent the link 208*b* from being slid off the handle when the hockey puck lock is installed. FIG. 26 depicts a perspective view of a link 208*b* installed on the strap 250. FIG. 27 depicts a cross section of this arrangement. As shown in FIG. 27, springs 270 may serve to push plate 266 up toward the open end 272 of link 208*b*. In this position, it is shown that the pins 268 are clear of the notches 264, such that the link 208*b* may freely slide along the squared section 256 of the strap 250. Once in this position, the hockey puck lock 100 may be lowered, compressing springs 270, and pushing pins 268 into notches 264.

To maintain the hockey puck lock 100 in this lowered position, the plate 266 may include a post 274 extending adjacent to the post 114 associated with the link 208*b*, and permitted to penetrate the plate. The post 274 may include an aperture 276 which aligns with through channel 101 when the hockey puck lock 100 is pressed into the link 208*b*, such as shown in FIG. 28. The shackle of the hockey puck lock 100 may then be threaded through the through channel 101 of post 114 as well as the aperture 276 of post 274. FIG. 29 depicts a link 208*b* with strap 250 in the fully installed position.

Further embodiments of the links previously discussed may also incorporate provisions to secure the hockey puck lock within the link body even when the lock is unlocked. In this regard, the further embodiments contemplate features adapted to retain the hockey puck lock within the link when in the unlocked position. These retention components may be in the form of roll pins, threaded fasteners, a retention ring, or other barrier or retaining member. Although retained, the hockey puck lock is permitted to move up and down within the link such that the retained components, whether chain, cable, or similar items, may be unsecured from the link.

FIG. 30 depicts a perspective view of a link 106*g* which includes features to retain either shackle or hockey puck style locks, after the locks are unlocked. For clarity, FIG. 30 is shown without any lock. However, it will be appreciated that, for example, a hockey puck lock may be placed within the raised lip 108 of the link 106*g* below the level of a lock retention component or components 150, such that the hockey puck lock is free to shift between the base 107 of the link 106*g* and the lock retention components 150. In the present embodiment, the lock retention components 150 are simple pins, which are attached to and protrude from the raised lip 108 into the cavity of the link 106*g* above where the hockey puck lock (not shown) would normally reside. It will be appreciated that the height of the raised lip 108 and placement of the lock retention components 150 are such that the hockey puck lock can be lifted a sufficient distance to permit the chain 103 to fit between the bottom of the hockey puck lock and the post 116, such that the chain 103 may be removed form the link 106*g*.

As previously discussed, links may include retaining mechanisms to hold the chain 103 in place. For example, link 106*g* includes a pair of set screws 152 for securing the chain 103. Accordingly, the portion of the chain 103 held by the set screws 152 will be retained within the link 106*g*, even when the hockey puck lock is unlocked and lifted toward the lock retention components 150. In the meantime, the other end of the chain 103 will be permitted to fit between the bottom of the hockey puck lock and the post 116.

Link 106*g* is shown with an anti-rotation step 135, but link 106*g* could accommodate stepped and flat bottom hockey puck locks.

FIG. 31 depicts a link 106*g* of the type shown in FIG. 30, with a hockey puck lock installed. Note that there is space between the upper surface of the hockey puck lock and the lock retention members 150 for the lock to shift when in the unlocked position.

FIG. 32 depicts an exploded cut-away perspective view of another embodiment of a link 106*h*. This embodiment expands the use and applications for hockey puck style padlocks by incorporating a plate member 266 between the hockey puck lock and the base 107. The plate member 266 may include extension pins 268 which retain a shackle 278 when the hockey puck lock 100 is in the locked position. The shackle 278 may have a cylindrical cross-section as shown or square cross-section, or other shaped cross-section.

The shackle 278 is shown as a rigid shackle, with engagement elements shown as notches 280 adapted to accept the pins 268 when the plate 266 is dropped down against the base 107. The shackle 278 enters the link through apertures 277 extending through the base 107. When the shackle 278 is inserted the requisite amount, the pins 268 of the plate 266 drop to fit within the appropriate notches 280 of the shackle 278 to secure the shackle 278.

In other aspects of the invention, the shackle 278 may be configured to include a pair of rigid sections with notches 280 connected by a second section, which may be flexible as in a wire or chain. In this case, the rigid sections could fit within the link 106*h* through apertures 277 while the flexible section could secure the object desired to be secured.

When the plate 266 is lowered into the cavity of the link 106*h*, the pins 268 extend into the notches 280 of the shackle 278. The pins may thereafter enter shafts 269 formed in the base 107 of the link 106*h*, such that the plate 266 may lower fully against the base 107. Although shown as extending completely through the base 107 of the link 106*h*, it will be appreciated that the shafts 269 may extend only partially and not completely extend through the base. In this regard, additional protection against forced attack, such as by drilling of the pins 268, will be provided, as the exact location of the pins 268 may be difficult to ascertain if hidden. It will also be appreciated that the plate 266 includes an aperture 284 through which the post 114 may fit.

When in the unlocked state, the shackle 102 of the hockey puck lock 100 may be disengaged from the post 114 allowing the hockey puck lock to lift. This movement could be spring assisted, for example with springs 270. The springs may fit within spring recesses 282 formed within the base 107 of the link 106*h*. The springs 270 may therefore function to lift the plate 266 and the hockey puck lock 100, once the lock is unlocked. When the plate 266 lifts, the pins 268 lift and clear the notches 280 of the shackle 278, allowing the shackle 278 to move in an un-locked manner.

Additional features may include provisions to retain the hockey puck lock when in the unlocked state, in the form of lock retention components 150, as previously discussed. One such lock retention component 150 may be a retaining ring 286. A retaining ring 286 is shown in FIG. 32. Lock retention may also be achieved using roll pins, threaded fasteners, surface irregularities, or other means. If the lock retention provisions are removable, such as with the use of set screws, the user of the system may replace the lock when in the unlocked position, when and if required.

FIG. 33 depicts the link 106*h* and related components in a locked condition, such that the hockey puck lock 100 is lowered in the link cavity, the plate 266 is lowered against the base 107, the pins 268 are fitted through the notches 280 of the shackle 278 and within the shafts 269, the springs 270 are compressed into the spring cavities 282, and the shackle 278 is fully retained.

FIG. 34 depicts yet another embodiment of a link 106*i*, in accordance with certain aspects of the present invention. In this embodiment, which is similar to the link 106*h* embodiment, the link 106*i* includes a mechanism to impair movement of the shackle 278 when the lock is unlocked. The mechanism includes a channel 287 formed within the base 107 of the link 106*i*, the channel spanning between the openings for the two legs of the shackle 278. The channel 286 includes a pair of displaceable elements, such as ball bearings 288, forced apart by a spring 290. The ball bearings 288 are sized to fit within the notches 280 of the shackle 278. In particular, the ball bearings 288 fit within the notch 280 of the shackle 278 adjacent to the particular notches 280 directly beneath the pins 266 at the given moment. The spring 290 separates the ball bearings 288 and forces each into a respective notch 280. When the lock 100 is unlocked and raised, the ball bearings 288 and spring 290 serve to prevent the shackle 278 from easy removal from the link 106*i*. Nevertheless, it is preferred that the spring 290 be sized and configured to permit compression upon attempted removal of the shackle 278, such that the ball bearings 288 will ratchet within each successive pair of notches 280 as the shackle 278 is withdrawn or inserted into the link 106*i*, to impair movement thereof. It will be appreciated that the spring 290 mechanism shown in FIG. 34 with respect to link 106*i* may also be utilized with link 106*h* shown in FIG. 32, or other links, so long as there is sufficient space allotted in the base 107.

FIG. 35 depicts a partially cut-away view of a link 106 with hockey puck lock 100 in the unlocked position. It is clearly shown in this view that the hockey puck lock 100 and plate 266 are displaced upwardly from the base 107 of the link 106. FIG. 36 depicts a partially cut-away view of a link 106 with hockey puck lock 100 in the locked position, with the hockey puck lock 100 and plate 266 dropped down against the base 107 of the link 106.

In accordance with other aspects of the present invention, the shackle 278 may have one leg shorter than the other, such that the shorter leg may be released from the hockey puck lock and swung into an unlocked and open position. One particular form of such a shackle 278 is shown in FIGS. 37 and 38.

In FIGS. 37 and 38, it is clear that the first end 292 of the shackle 278 is shorter than the second end 294. In such case, when the first end 292 is freed and the second end 294 retained within the link 106, the first end 292 may rotate such that items intended to be secured may be more easily attached to the shackle 278.

In addition, it will be noted that the second end 294 of the shackle 278 includes a restrictive element in the form of a ball 296. This ball prevents the second end 294 of the shackle 278 from being removed from the link 106. Other restrictive elements may also be provided, so long as they are larger than the aperture in the base 107 of the link 106 through which the shackle 278 moves. The restrictive elements may also be removable. For example, the restrictive element may be internally threaded so as to be threaded upon a threaded portion of the second end 294 of a shackle 278.

FIG. 37 depicts the lock in an open position while FIG. 38 depicts the lock in a locked position, such that the first end 292 of the shackle 278 is secured within the link 106.

FIG. 39 depicts a perspective view of the shackle 278 of FIGS. 37 and 38, alone. FIG. 40 depicts a standard shackle 278, with both the first and second legs 292, 294 of equal length. FIG. 41 depicts another shackle 278 that may be utilized with the present invention. In this configuration, the shackle includes a very short first end 292, which may in fact be too short to enter the link 106. Nevertheless, the shackle 278 may find utility in certain applications, for example when securing taut chain. The first end of this shackle 278 depicted in FIG. 41 is also curved to form a hook 279, while the second end 294 is configured in the more conventional, straight configuration. Although not including notches 280, it will be appreciated that the adjacent channels 281 of the second leg 294 depicted in FIG. 41 serve the same purpose, and may be used interchangeably with notches 280. One feature of the adjacent channels is that the shackle 278 may freely rotate, even when the hockey puck lock 100 is locked.

As similar shackle 278 is shown in perspective in FIG. 42. In this embodiment, the shackle 278 includes a wide-based hook 279 attached to its first end 292. It will be appreciated that this wide-based hook 279 is particularly adapted to be attached to vertical rods of container locks, as discussed previously and as will be further discussed. It will also be appreciated that each of the shackles may be configured to various lengths, such that each include a various number of notches 280 or channels 281, depending on the desired configuration. Obviously, the more notches 280 or channels 281, the more combinations of locking arrangements available. However, although the shackles 278 may be configured from hardened materials, the notches 280 and channels 281 may be targeted attack points, and are thus advantageously kept to a minimum in high security applications. Particularly, in certain applications, it is important that the notches 280 and channels 281 be limited to only the number that can fit within the link 106, such that none are exposed when the lock is locked.

FIG. 43 depicts a link comprising features in accordance with further aspects of the present invention. As shown in FIG. 43, the link **106*j* includes a novel shackle retention system. Within the base 107 of link 106*j*, the link 106*j* includes a channel 251 spanning between the apertures 277 through which the ends of the shackle 278 enter. The channel includes a pair of blocks 253 each having an element 255 adapted to mate with either a notch 280 or channel 281, as the case may be, on one end and a cammed surface 257 on the other end. The cammed surfaces 257 each face each other and are positioned to cooperate with the cammed surfaces 259 of a displacer 261, attached to the bottom of the plate 266. As the lock 100 is moved down toward the base 107 of the link 106*j*, the displacer 261 drops and its cammed surfaces 259 abut the cammed surfaces 257 of the blocks 253, to drive the elements 255 into the notch 280 or channel 281, as the case may be. A spring 263 may also be provided to pull the blocks together, such that the elements 255 are moved out of engagement with the notch 280 or channel 281, when the displacer 261 is lifted. FIG. 44 depicts the link 106*j* with lock 100 in the unlocked position, such that the displacer 261 is lifted and the blocks 253 are generally brought together by action of the spring 263**.

Another feature contemplated for the link inventions is an inclined surface on the outer diameter that would minimize the impact of a hammer blow. Hammer blows are a common method of attack for locks and lock attachments. If the link was conical shaped, rather than cylindrical as shown, a hammer blow may be deflected to limit its impact. Such conical shaped links may be provided in accordance with certain aspects of the present invention.

FIG. 45 depicts a link in accordance with yet another aspect of the present invention. In accordance with this aspect, the link **106*k* may include provisions for use with a flat shackle 278, such as a single aperture 277 within which the shackle may enter. The aperture 277 is appreciably configured to accept the flat shackle 278. In addition, the link may include a hook portion 265 affixed to the base 107. The hook portion 265 may be opposed by a shackle hook 267 forming a portion of the shackle 278, such that the two hook portions 267, 269 face each other and may be utilized to capture items, particularly vertical rods of a container locking mechanism. The shackle may include notches 280 for sizing the distance between the hook portions 267, 269, the notches being adapted to capture pins (not shown) connected to a plate (not shown), which drops into locking association with the shackle 278 when the lock 100** is locked, as previously discussed.

FIG. 46 depicts a similar link **106*l*. As with link 106*k*, link 106*l* includes a hook portion 265 in fixed relation with the link 106*l*. Meanwhile, the shackle 278 includes a shackle hook 267 which is opposed with the hook portion 265 of the link 106*l*. The shackle hook 267 may move relative to the link 106*l*, such that the distance between the two hooks 265, 267** may be adjusted.

In either of the links **106*k*, 106*l*, the hook portion 265 may be formed integrally with the link 106*k*, 106*l***, or may be welded or otherwise attached thereto. It is preferred that the attachment method, and materials utilized, be appropriate for the strength level intended.

Moving along to other aspects of the invention, FIG. 47 primarily depicts a conventional arrangement of a vertical lockrod 200, handle 202, and hasp mechanism 204, commonly used on intermodal containers and barn door style doors found on truck trailers, where the handle is connected to the lockrod by a hinge 203, as previously discussed with respect to at least FIG. 15. Use of these conventional systems is well known in the industry. It is also well known that common attack points for forced entry are the rivets 205 holding the hasp mechanism 204 to the door and the rivets 207 of the hinge 205.

In accordance with the present invention, a bracket 222 may be attached to a container door 201, for example by rivets 224. The bracket may include a shelf portion 226 with an aperture 228. This bracket may be provided in addition to the conventional hasp mechanism 204.

A link 106*m* may be adapted to fit over the bracket 222 to secure the handle 202 in the locked position. Such a link is shown in perspective view in FIG. 48. As shown in FIG. 48, the link 106*m* may include an extension member 152 extending from the raised lip 108. The extension member 152 includes an aperture 154, which is sized and shaped to accept the handle 202. Further, the extension member 152 is sized and shaped to permit the shackle 102 (FIG. 2) of a hockey puck lock 100 to fit within the aperture 228 of the bracket 222 when the handle 202 is within the aperture 154 of the extension member 152. As shown in FIG. 49, a rear perspective view of the link 106*m*, the base 107 may be configured with a groove 156 within which portions of the bracket 222 (portions other than the shelf portion 226) may reside to ensure that the link 106*m* is flush against the door 201 when locked. The shelf portion 226 of the bracket 222 will therefore fit within the link 106*m* and hockey puck lock 100 such that the shackle 152 of the hockey puck lock 100 can fit through the aperture 228 of the bracket 222. It will be appreciated that in this configuration, the handle 202 cannot be rotated to open the door 201. In addition, it will be appreciated that the function of the conventional hasp mechanism 204 is fully retained and not interfered with.

The aperture 154 of the extension member 152 is preferably over-sized compared to the handle 202 such that the link 106*m* may rotate when the handle 202 is placed through the aperture 152. FIG. 50 depicts a first step in the process of locking the link 106*m* on a door 201. In this figure, it is shown that the handle 202 is in the locked position and the hasp 204 is closed. Although the hasp 204 does not include a lock or seal, it could if desired by user.

Even when in this locked position, the link 106*m* may be utilized to further secure the door 201. The link 106*m* may be slid over the handle 202 by inserting the handle 202 into the aperture 154. It will be appreciated that the link 106*m* must be tilted forward slightly such that the base 107 clears the shelf portion 226 of the bracket 222. Once the link 106*m* is properly aligned over the bracket 222, the link 106*m* may be rotated back toward the door 201, and into the position shown in FIG. 51. In this position, the lock 100 may be locked to further secure the handle 202.

Further aspects of the invention are adapted to secure container doors of the type having a pair of locking mechanisms of the type shown in FIG. 15, one on each adjacent door. For example, FIG. 52 depicts conventional container doors 201 locked by vertical lockrods 200. As is conventionally known, the locking mechanisms include a pair of handles 202, hasp mechanisms 204, and hinges 203 connecting the handles to the respective lockrods.

In previous embodiments of the invention, links and straps may be utilized, alone or in combination, to secure one or both container doors of the type shown in FIG. 52. In some conventional systems, one of the doors must be opened prior to the other being opened. In such systems, only one of the previously disclosed links and/or straps need be applied, although they may be applied, as required, to both doors for added security. In other systems, the doors may operate independently from each other. In such cases, a pair of links and/or straps should be provided to fully secure the doors.

In addition, and as will be discussed, straps may be provided with or without links, depending on the particular arrangement of the strap as required by the application, desired security level, and the like.

In most of the previous embodiments, the link and straps have focused on securing the handle such that the handle cannot move relative to the vertical lockrod once secured by the link or strap. In other embodiments, the links have been provided with elements to permit attachment between two vertical lockrods. The following embodiments build on the teachings of providing a strap between two vertical lockrods, to secure the container doors.

FIG. 53 depicts an exploded perspective view of a strap 300*a* configured to lock a pair of adjacent lockrods 200. The strap includes a base section 302 and a cover section 304. The base section includes a finger portion 306 having three fingers, two of the fingers 308, 310 are curved and the third finger 312 is straight. The curved fingers 308, 310 are adapted to mate with the vertical lockrod 200 of a conventional door lock. In this regard, the curvature of the curved fingers 308, 310 should be such that the fingers neatly secure the vertical lockrod. The straight finger 312, meanwhile, is located between the curved fingers 308, 310 and is adapted to cover the hinge 203 associated with the lockrod 200. It will be appreciated that the curved fingers 308, 310 are separated a sufficient distance to bracket hinge 203, such that base member 302 may rotate about the vertical lockrod 200 once installed.

The base member also includes a main portion 314 adjacent to the finger portion 306. The main portion 314 includes a protruding hasp 316 having an aperture 318. As will be discussed, the hasp 316 and aperture 318 are configured to accept a variety of lock shackles.

It will be appreciated that the main portion 314 may be offset from the finger portion 306, such that the base portion 314 is substantially between a plane formed through the vertical lockrods 200 and the adjacent doors 201. Preferably, the base section 314 is configured to be very close to the doors 201, such that an attack by prying between the doors 201 and the base section 314 may be eliminated. In addition, the offset serves to locate the lock closer to the doors and within the protective envelope of the vertical lockrods, such that accidental damage to the lock can be avoided.

The offset distance will of course depend on the particular arrangement of the lockrods 200 and doors 201, but is typically on the order of 1 to 2 inches.

Like the base 302, the cover 304 includes a finger portion 320 and a main portion 322. The base portion 322 includes an aperture 324 sized and configured to permit passage of the hasp 316 when the base portion 322 of the cover 304 is placed over the base portion 314 of the base 302. The main portion 322 of the cover 304 may also include rounded portions 326 to partially extend over the base portion 314 of the base 302.

The finger portion 320 of the cover includes two curved fingers 328, 330 separated by an open area 332. The curved fingers 328, 330 are adapted to fit partially around a lockrod 200, to secure the cover 304 to the lockrod 200. The open area 332 is typically mounted over the hinge 203, and permits the cover 320 to rotate around the lockrod 200 without interference from the hinge 203.

In a similar manner to the base 302, the main portion 322 of the cover 304 is offset from the finger portion 320, to move the main portion 322 closer to the doors 201.

FIG. 54 depicts a perspective view of a strap 300*a* in a fully assembled condition, in place securing a pair of vertical lockrods 200. For clarity, the hinges 203 are not shown. As shown, the cover 304 may be placed over the base 302 such that the hasp 316 of the base 302 protrudes from the aperture 324 of the cover 304. It will be appreciated that the distance between the vertical lockrods 200, and thus the overall dimensions of the strap 300*a*, are fixed, such that the strap 300*a* associated with this particular aspect of the invention is limited to use with lockrods 200 spanning a particular distance apart. Other embodiments of straps include means for adjusting the span distance, such that the strap may be utilized with a variety lockrod configurations. Once the strap 300*a* is positioned as shown in FIG. 54, a lock or seal may be inserted through the aperture 318 of the hasp.

To place the strap 300*a* in the locked position shown in FIG. 54, one may first lock the doors 201 in the conventional manner. One may then place the fingers 308, 310 of the base 302 around one of the vertical lockrods 200, such that the main portion 314 of the base 302 is adjacent to the door with its hasp 316 facing outward. The fingers 328, 330 of the cover 304 may then located on the other vertical lockrod 200 with the main portion 322 of the cover 304 away from the face of the doors 201. The main portion 322 of the cover 304 may then be swung inward toward the doors 201 such that the hasp 316 of the base 302 penetrates the aperture 324 of the main portion 322 of the cover 304. A suitable lock or seal may then be utilized to lock the strap 300*a* in place.

In another strap embodiment, a strap 300*b* may be configured similarly the strap 300*a*, but may include a third finger 334 located within the open area 332. As shown in FIG. 55, the third finger 334 may be formed from an extension of the main portion 314 of the base 302. This third finger 334 may be adapted to cover the hinge 203 associated with the vertical lockrod 200 to which it is attached.

Preferably, the base 302 includes a short finger portion 336 associated with the finger 334 such that the two elements form a J configuration, as shown in FIG. 55. In order to install the base 302 on the lockrods 200, one then preferably places the finger portion 306 of the base 302 against a lockrod 200, and slides the base 302 in the direction of arrow A until the fingers 308, 310 of the finger portion, and 334 of the main portion 314, contact the respective lock rods. Thereafter, a cover, such as cover 304, may be placed over the base 302 in the manner previously described, to arrive at the fully assembled strap shown in FIG. 56. Note that the finger 334 fits neatly within the open area 332 of the cover 304.

One method of attacking a vertical lockrod system of the type discussed herein is to wrap a tensioning element around the two adjacent rods and tension a member to draw the rods together. An example of this technique is where the attacker uses chain wrapped around the bars, where the chain is brought into a taut condition and then pulled more and more until the bars deflect, or bend. In order to combat this method of attack, the base 302 of the strap 300*a* may be configured with a stop-block 338. The stop-block may extend down from the finger portion 306 toward the tips of the fingers 308, 310, as if being held in the palm of a hand. It will be appreciated that the combination of the stop-block member 338, and the J-shaped configuration of the finger 334 and the short finger portion 336 prevent the lockrods from being bent toward each other, as the bars 200 will hit the stop-block 338 and J-shaped finger portion upon bending. It is preferred that the stop-block member 338 be positioned such that the lockrod 200 may still easily fit between the stop-block 338 and the limits of the fingers 308, 310.

In order to make the strap adjustable, such that it may fit lockrods separated by different distances, the base of the strap may be made adjustable. One such adjustment mechanism is shown in FIG. 57. As shown in FIG. 57, the adjustment mechanism may replace the base 302 with a first base 340 and a second base 342, with the second base 342 adapted to fit within the first base 340, as will be discussed.

The first base 340 may include a finger portion 306 which is substantially similar to the finger portion 306 of base 302, inclusive of the fingers 308, 310, 312. However, in the main portion 314, the first base 340 may include a size adjustment mechanism 344. The size adjustment mechanism 344 embodied comprises a channel 346 bound at an upper limit by a straight segment 348 and at a lower limit by a grooved segment 350. The grooved segment 350 may be created by a repeating series of tab members 352 forming peaks 354 and valleys 356.

The second base 342 includes a finger portion 358 having a finger 334 and short finger portion 336 substantially similar to those of strap 300*a*. Opposite the finger portion 358, the second base 342 includes an adjustment portion 360 sized and configured to fit within the channel 346. The adjustment portion 360 includes a hasp 316 with an aperture 318 in the conventional manner. However, the hasp 316 also includes a base forming a grooved segment 362 configured to mate with the grooved segment 350 of the first base 340. The grooved segment 362 of the hasp 316 includes a pair of tabbed members 364 with two peaks 366 and a single valley 367 therebetween.

Once the second base 360 is fitted within the channel 346 of the first base 340, the peaks 366 of the hasp 316 may be fitted within the valleys 356 of grooved segment 350 of the first base 340, to size the first base and second base 340, 342. It will be appreciated that when appropriately sized, the first base 340 and second base 342 essentially form the base 302 of the previous embodiment. A cover 304 may then be fitted over the first base 340 and second base 342 to finish the strap (referenced as 300*c* although not shown). As the location of the aperture 324 of the cover 304 is fixed in relation to the location of the hasp 316 of the second base 342, the aperture 324 may be consistently located, as the hasp 316 does not move in relation to the aperture 324 (only the first base 340 moves).

As discussed, adjustable straps may be utilized to fit lockrods of varying dimensions. For example, typical lockrods may typically span between 10 and 15 inches apart. It is preferred that the adjustable straps be manufactured to accommodate this span. Such adjustable straps may find utility in the general marketplace, where lockrod dimensions between different containers are variable. Alternatively, there are many fleet owners that may have containers with lockrods that are consistently sized. Rather than being burdened with the expense and added sophistication of an adjustable strap, the fleet owner may simply utilize a non-adjustable strap sized and configured for the particular specification of the fleet.

FIG. 58 depicts a strap 300*d* in accordance with further aspects of the present invention. The strap 300*d* shown in FIG. 58 is substantially similar to strap 300*b* referenced with respect to FIG. 57, with the addition of a link 400, of the types previously discussed. The link 400 is adapted to secure a hockey puck style lock primarily, but may include features such as openings 402 in its raised lip 108, which enable additional styles of locks to be utilized. It will be appreciated that the link 400 adds extra measures of security not realized in straps 300*a*, 300*b*, 300*c*, which all have exposed hasps 316.

While FIG. 59 depicts an adjustable strap 300*e*, the grooved segments being beneath the first base 340 and therefore hidden from view in the perspective shown, the strap 300*e* depicted in perspective view in FIG. 59 is of a nonadjustable strap 300*e*. Strap 300*e* shares many of the features of strap 300*a* shown in FIGS. 53 and 54, with the addition of a link 400 attached to the cover 304 for added protection against attack.

FIG. 60 depicts a top view of the link 300*e* of FIG. 59. In this view, the offset "O" is clearly shown. Again, by offsetting the strap elements, the device locates the lock closer to the doors than is possible without the offset "O." This protects the lock against accidental damage by ensuring that it is somewhat protected by the bars, but also helps to prevent levered attacks against the strap by levering a bar between the strap and the doors. It will be appreciated that the various links and straps may be provided with or without this offset.

FIG. 61 depicts a perspective view of a link 300*e* of the type shown in FIG. 59 assembled upon the locking assembly of FIG. 52 in accordance with certain aspects of the present invention, together with an unassembled hockey puck lock 100. FIG. 62 depicts a perspective view of the link 300*e* and locking assembly of FIG. 61, with the hockey puck lock 100 in the locked position. FIG. 63 depicts a perspective view of the link 300*e* and locking assembly of FIG. 61 with a padlock 136 in a locked position in lieu of a hockey puck lock. It will be appreciated that the link 300*e* may be adapted for use with other styles of locks or seals, including straight shackle padlocks and circular shackle padlocks. It will also be appreciated that the orientation of the link 300*e*, or other links herein described, may be rotated 180 degrees from that shown in FIG. 63. However, the orientation shown in FIG. 63 is the preferred orientation because the bracket associated with the right-hand door (as viewed) is commonly an attacked point, and the orientation shown provides added protection to that bracket.

FIG. 64 depicts an exploded perspective view of a non-adjustable strap 300*f* sharing many of the features of strap 300*a* shown in FIG. 53, with the addition of a protective shroud 368 associated with the cover 304.

With respect to the base 302, it will be appreciated that the base 302 of strap 300*f* shown in FIG. 64 may be identical to the base 302 of strap 300*a* shown in FIG. 53, including the finger portion 306, main portion 314, and hasp 316.

The cover 304 may also be substantially similar, including the finger portion 320 and main portion 322. However, the cover 304 of strap 300*f* includes a protective shroud 368. The protective shroud 368 is adapted to be attached to the cover 304 such as by welding, or may be formed integral therewith. The protective shroud 368 includes a generally closed top 370 with an open bottom 372. The generally closed top 370 may include an aperture 374. A first side of the protective shroud 368 may end-abruptly with an end cap 375 such that the protective shroud 368 forms a box with a depth approximately equal to the offset of the strap 300*f*. A second side of the protective shroud 368 may taper toward the finger portion 320 of the cover 304.

As shown in FIG. 65, when fully assembled, a lock, such as padlock 136 may be inserted into the open bottom 372 and fitted over the hasp 316 to lock the strap 300*f*. It will be appreciated that in order to fit the padlock 136, it is important that the protective shroud 368 include a sufficient internal area for manipulation of the lock body and shackle. Such manipulation is aided by the aperture 374 in the closed top 370, through which a user may view the happenings and through which the shackle of the padlock 136 may fit if necessary or desired to assist with positioning. In addition, the aperture 374 may be sized such that the shackle of the padlock may penetrate the aperture 374 to allow easier fitment over the hasp 316. For example, the lock may be inserted through the open bottom 372 and partially through the aperture 374. The lock may then be shifted to the side such that the open shackle is aligned with the aperture 318 of the shaft, and then dropped down such that the open shackle penetrates the aperture 318.

As shown in FIG. 66, a perspective view of a strap 300*g* sharing many of the features of strap 300*f* of FIG. 64, the protective shroud may include internal guide channels 376 extending from the open bottom 372 toward the closed top 370 to guide a lock, such as a hockey puck lock 100, into position. If so provided, the lock 100 may be guided by the edges 378 of the guide channels 376.

In order to install such a lock 100, one would first position the base 302 appropriately upon a first lockrod. One would then position the cover 304 appropriately on a second lockrod, but would not engage the cover 304 with the base 302. Rather, one would insert the lock 100 into the guide channels 376 until the lock was properly positioned in its final position, such that the shackle of the lock is over the aperture 324 (shown in FIG. 64). The cover 304 may then be engaged upon the base 302 by rotating the cover 304 into position. Such action will force the hasp 316 through the aperture 324 and into the body of the lock 100, whereupon the lock may be locked. In other embodiments, it will be appreciated that the lock 100 may be permanently affixed to the cover 304, such that it cannot be removed. Nevertheless, when the lock is unlocked, the cover would be permitted to swing away from the base to unlock the strap system.

The links 106 generally shown and discussed in relation to the present invention have been round. However, it will be appreciated that the link 106 may also be rectangular or any other shape with a circular internal cavity for accepting the hockey puck lock.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The following describes the preferred embodiments of further novel security links in accordance with different aspects of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

It will become evident to one skilled in the art that several objectives and advantages of this invention follow from the novel aspects of the present invention by which the traditional security functions are achieved using multiple security elements in combination.

Throughout this disclosure, the term shackle shall be construed broadly to include the portion of a lock which extends from the body and which is typically moveable to engage with securing members such as hasps, chain, cable or the like.

FIG. 1 depicts a perspective view of a conventional cylindrical, hidden shackle pad lock, commonly referred to as a hockey puck lock 100. The hockey puck style lock 100 includes an outer casing 111 which is shaped in a manner similar to that of a hockey puck, thus giving the lock its name.

Shown in FIG. 2 is a bottom perspective view of a conventional hockey puck lock 100. The drawing figure shows shackle 102 and anti-torque step 104. The step 104 is typically part of the standard form factor of a conventional hockey puck lock 100, and is a built-up shoulder area formed as part of outer casing 111. Other embodiments may have a flat bottom. However, if provided, the step 104 may cooperate with associated appurtenances to prevent the hockey puck lock 100 from rotating. This reduces the ability of a malfeasant from placing a torque or twisting force on the shackle 102 in an attempt to compromise the shackle and thus the security of the lock 100. Even with the step 104 in place, the bottom of the conventional hockey puck lock 100 is still generally vulnerable to attack, particularly where the shackle 102 is exposed.

The hockey puck lock 100 utilized in the present invention may be operated in the conventional manner. For example, the shackle 102 may be manipulated by a keyed cylinder 105, as is known in the industry. A shackle in a lock may also be manipulated by other types of locking mechanisms, including but not limited to combination locks, combination locks that are operated by a robotic key such as disclosed by the inventors in U.S. patent application Ser. No. 11/186,698 filed on Jul. 21, 2005 which is incorporated herein by reference in its entirety, and electronic locks, or any other locking mechanism that can lock and/or unlock a shackle in a padlock.

Figure 68:
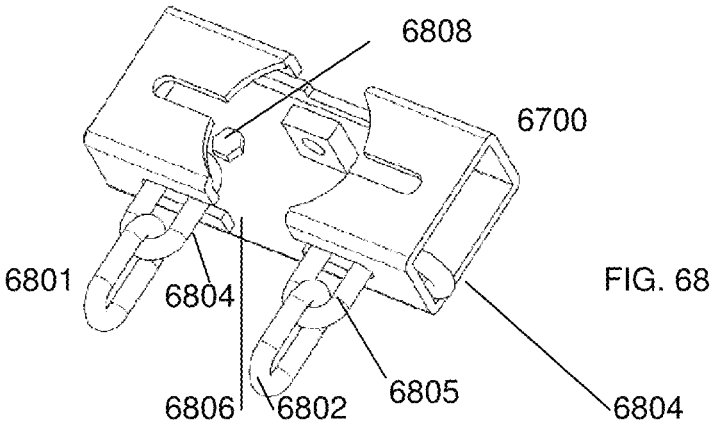

FIGS. 67-77 depict a perspective view of a link 6700 in accordance with certain aspects of the present invention. In one embodiment the link 6700 may be used in combination with a hockey puck lock 100 and a chain. Such a chain may be a single chain with endings 6801 and 6802 as shown in FIG. 68. One may use the link 6700 also with 2 or more chains. The chain endings 6801 and 6802 is such a case may belong to different chains.

A link such as link 6700 in FIG. 67 provides a linking member for securing a securing member such as a chain or a cable by use of a tubular structure, which includes the means to engage chain or cable and a lock arranged to prevent the disengagement of the secured elements. The specific design of form and fit may be configured to accommodate the padlock appropriate to the application.

FIGS. 67-75 depict one or more embodiments of a link 6700 intended to engage multiple chain or cable elements using the multiple slots that are provided. One embodiment is designed for use with the generic, "Hockey Puck" padlock. The link may be used free floating or fastened to a structure as required by the application. The versatility of the concept permits a variety of options with respect to fastening to structures or the selection of padlock configuration to be used. The terms "hockey puck lock", "hockey puck padlock" and "hidden shackle padlock" are used herein interchangeably. It is noted that rectangular hidden shackle padlocks also exist, and security links using these rectangular locks are fully contemplated. Examples of rectangular types of hidden shackle locks are the Chubb 1K57 series and the Chaz BC2-10 series and Hi-Shear rectangular hidden shackle locks.

The form and fit of the internal engaging hasp elements may be easily changed to be compatible with padlocks of other configurations, or with the inclusion of the appropriate adaptor to accommodate "U", rotary, or straight shackle padlocks. One such adaptor and use of a standard padlock is illustrated in FIGS. 73-75. One may call such an adaptor a security link adaptor.

In accordance with the aspects of the invention depicted in for instance FIG. 67, a link such as a link 6700 may be compatible with flexible or non-flexible securing devices, such as either a chain or a cable having end loops, or any securing device which is enabled to fit through a slot, such as a slot 6701 in FIG. 67, but which has at least one element that cannot not pass through said slot.

FIG. 67 further shows a link 6700 of tubular shape with visible slots 6701, 6702, 6703, 6704 and 6705. The link also has an opening defined by the edges marked as 6706 that substantially tracks the shape of a blocking element, such as a hockey puck. A blocking element when placed in the link through the opening marked by edges 6706 and limiting the space between the link and the blocking device that will block access to and from the slots such as the slots 6701, 6702, 6703, 6704 and 6705 for a securing member that has a size larger than the space between the blocking element and the link 6700. A blocking element preferably is locked to the link 6700. For that purpose the link 6700 may have a hasp or post 6709 with a hole or an aperture 6708 that can receive a shackle or a locking element from a blocking element.

For instance, the shape of the opening in link 6700 defined by edges 6706 may be enabled to receive the hockey puck of FIG. 2. The hockey puck may be locked in place by locking the shackle 102 of the hockey puck through the hole or aperture 6708 of hasp or post 6709. One may provide the link 6700 with a step corresponding to a step 104, which will restrict the potential rotation of the hockey puck in the link.

The shape of the applied hockey puck or other blocking element should be such that it can enter the link 6700 through the opening defined by edges 6706. This aspect of the present invention is shown in perspective diagram in FIG. 69. The link 6700 has received through the opening defined by edges 6706 the blocking element or hockey puck 6907. Also shown is a link 6802 of a security device that is a chain. In one orientation, a link may fit through a slot such as 6703 or 6705. However, there is not enough room between the hockey puck 6907 and the link 6700 to move the chain link through.

Securing members are placed in a slot in such a way that a part of the securing member inside the link is larger in a dimension than a dimension of a slot. When access to a slot is blocked by a blocking element the securing member such as a chain can be captured by the link and the blocking element.

The element of a securing device may be a link or an element in a chain. FIG. 68 shows the link 6700 in a perspective drawing. Also shown are chains links 6801, 6802, 6803 6804 and 6805. Chain link 6804 is moved into the slot 6806 when no blocking element is placed in the link through the opening defined by edges 6706. The chain link 6804 should have a connected link that is oriented in an angle with link 6804. For example chain link 6805 and 6803 show this aspect, whereby it is impossible to align the chain links 6803 and 6805 in one plane. A connected chain link such as 6803 becomes thus a stopping element of the security device that includes chain link 6805. It is impossible to move 6803 through a slot to remove the chain or the security device from the slot. The only way for 6805 or 6804 to enter or leave a slot is through an opening that is large enough to let the connected chain link such as 6803 pass.

In order to have the chain link 6805 leave its slot, one has to slide 6805 to the middle of the link where there is sufficient room to pass the chain link 6803. The opening defined by edges 6706 in the link is clearly large enough to let the chain link 6803 pass. It should be clear that when a blocking element 6907 is placed in the opening defined by edges 6706, any chain links that are place in a slot such as links 6803 and 6805 are captured by the link 6700 and the blocking device 6907. This is shown in a perspective drawing in FIG. 69.

In order to allow easy entry and removal of a chain link with a stopping link to and from the link 6700 one may provide an enlarged opening in the link 6700. Such an enlarged opening is shown in FIG. 67 as opening 6707.

The illustrative examples of the link as depicted in FIGS. 67-73 show slots enabled to receive a securing member in the front top and bottom surfaces of the link 6700. One may also provide one or more slots in the back surface with a receiving opening. Furthermore, the drawings show a chain and chain links as securing member. One may also use other securing members that have a stop that can be secured behind a slot from removal from the slot by using a blocking element 6907 such as a hockey puck in the link and that can be removed from a slot when there is no blocking element inside the link 6700. Such an element may be a cable with a cable stop such as a crimped on or welded stop. It may also be a cable which has an end loop, which may be a spliced loop, and wherein the loop acts as a stopping element. In all of these cases a securing member such as a cable or a chain may slide into a slot in the link by entering the slot through an opening that can be blocked by a blocking element. The securing member preferably has a stop that cannot move through the slot and that is positioned inside the link side of the slot when the securing member is secured by the security link.

The hasp 6709 with aperture or hole 6708 as shown in FIG. 67 in link 6700 has a certain orientation corresponding to the expected orientation of the blocking element, such as the hockey puck. It is contemplated that the blocking element such as a hockey puck may be applied to the link 6700 in a different orientation. For instance, one may apply the hockey puck in an orientation that is rotated over 90 degrees to the right, compared to what one may consider its horizontal orientation. In a further embodiment one may position the hasp 6709 in a different location inside the area that is defined by edges 6706 in the link 6700. For instance, while the hasp is now located in the 12 o'clock position in a horizontal orientation it may also be located in the 9 o'clock position in a vertical orientation or in the 6 o'clock location in a horizontal orientation. One should make sure that a lock of the hockey puck or of a blocking element is accessible in a selected position and orientation.

The hasp 6709 may be part of the base structure and integral to the base structure. It may be fastened with fasteners or welded. The hasp may also be a non-integral and separable element, such as an eye-bolt, staple, chain link, cable loop or the like that can hold or secure a shackle to the link.

The illustrative examples in the drawings show a link with a single hasp. It should be clear that more than one hasp may be used, as long as the one or more hasps can receive the shackle of a lock or the existence of multiple hasps does not interfere with locking a blocking element to the link.

In a further embodiment, the shape of the blocking element may not be circular. A hockey puck is of course a circular shape blocking element. However, rectangular shape hidden shackle padlocks are also available commercially. And one may create its own shape of hidden shackle padlock. If one applies a blocking element with a shape that is not circular, one should make sure that the link has an opening for the blocking element to enter the link that substantially follows the shape of the blocking element. The edges in a link that define such an opening, like the edges 6706 define the circular opening in link 6700, should allow sufficient room for the blocking element to enter the link, but close enough to the shape of the blocking element so that it does not provide room for a securing member such as a chain or a cable to be removed from a slot while the blocking element is engaged with the link.

The link 6700 in FIG. 67 is shown as a tube or a partial tube with a rectangular cross section. In a further embodiment, one may create a link that has a non-rectangular cross section. For instance one may use a tube like link that has a circular or an oval cross section. In a further embodiment one may use a tube or tube-like link that has a cross section that is a polygon. One should make sure that a blocking element that is engaged with a link of any cross-sectional shape blocks a slot from releasing a securing member that is secured in the slot.

In the drawings that show illustrative examples of a security link, only one slot per surface is shown. It should be clear that a surface may have more than one slot to receive a securing member. A surface may have 2 or more receiving slots. The slots may be of dissimilar size to receive securing members such as a chain or cable that have different sizes. The link 6700 as shown in FIG. 67 has 6 slots. It may also have fewer slots, or it may have more slots. Slots may be parallel to each other. Slots may also be oriented under an angle with each other.

Figure 69:
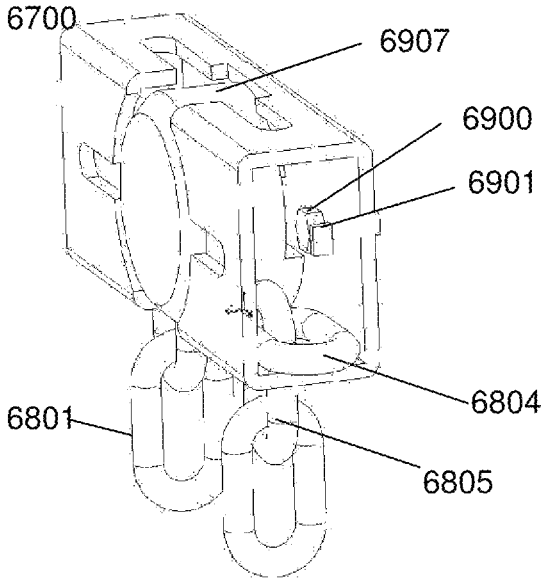
Figure 70:
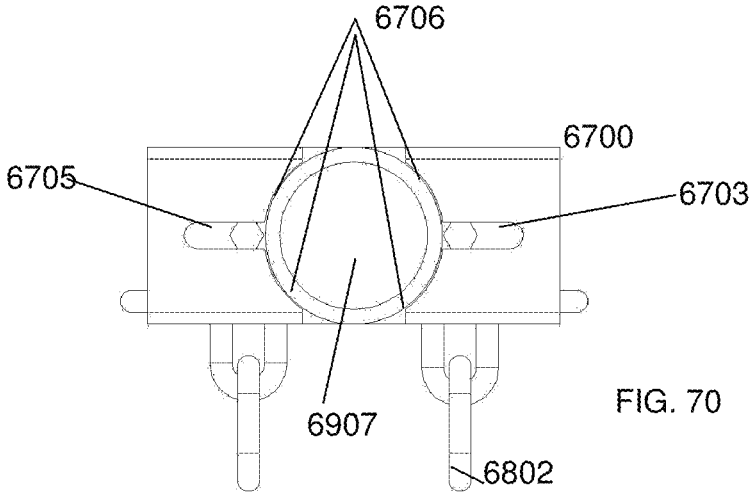
Figure 71:
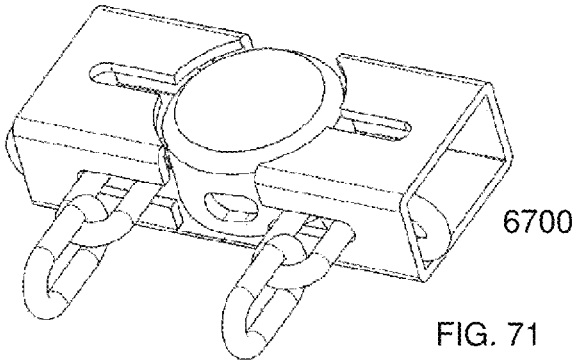

In a further embodiment one may use two slots to secure a loop of a securing member such as a cable or a chain link. For instance, one may slide a loop of a cable into slots 6701 and 6705 and secure the loop by placing and securing a blocking element such as hockey puck 6907 as shown in FIG. 69 into the opening in link 6700 that is defined by the edges 6706. In a further embodiment, one may also create additional slots in one or more surfaces to accommodate the size of a loop in a cable or the size of a chain link.

In the perspective drawing FIG. 68 of the security link 6700 a fastener 6808 is identified to mount the security link 6700 against a plate or an object or a pole or any other object to which the security link may be fastened. A fastener may be a bolt with a bolt head; it may also be a screw; it may also be a nut which may be fastened on a bolt. A malfeasant may attempt to remove a security link that is secured with a blocking element such as a hockey puck lock from an object to which it is fastened by unfastening the fastener. In one embodiment one may position a hole for a fastener in the security link in such a way that it can only be accessed when no blocking element such as a hockey puck lock is in the security link. In a further embodiment one may create a hole for a fastener in a step of the back of the security link. One may create the hole in such a way that a fastener 6808 can be fastened or removed with a tool such as a box-end wrench or a socket wrench only when there is no blocking element. When the fastener is fastened it may be below the flush surface of the back surface of the security link or a step on the back of the security link. When a blocking element like the hockey puck lock is in place in the security link, there is no access to the fastener.

In a further embodiment one may place, for instance by welding or by other means a tab at the side of a fastener. This is illustrated in FIG. 69. A tab 6901 is positioned to the side of fastener 6900. This prevents access to mounting hardware with for instance a box or crescent wrench, pliers or similar tools from the open side of the security link.

Figure 72:
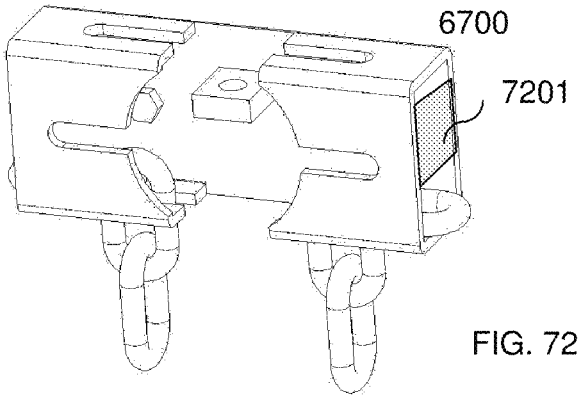

In a further embodiment one may block access to the inside of the security link from the outside when the security link is secured with a blocking element by providing a side block. Such a side block 7201 is shown in FIG. 72. One may close the side completely in one embodiment. However it may be beneficial to not close the side completely. For instance to allow excess cable or chain to be threaded through the side. One may also prefer to allow water and moisture to not accumulate in the security link. In a further embodiment one may partially close the side of a security link with one or more barriers.

In yet a further embodiment one may apply the security link 6700 of FIG. 67 with a blocking element that is not a hockey puck lock. This is shown in FIG. 73 with a blocking element 7300 that fits in the opening of security link 6700 that is defined by the edges 6706 as shown in FIG. 67. The blocking element 7300 has at least a wall 7301 and a wall 7302 that can block the slots in the security link such as slots 6701, 6702, 6703, 6704 and 6705 as shown in FIG. 67 and thus secures a securing member such as a chain or a cable that has been put in such a slot, when the blocking element 7300 is secured in the opening defined by edges 6706. The blocking element has a back wall 7306. It also has at least one hole in the back such as hole 7305 that corresponds with the position and size of the hasp 6708. This allows the blocking element 7300 to be tightly secured in the opening of the securing member. When the security link has 2 or more hasps, then additional holes can be made in the blocking element to match the position of the additional hasps.

The blocking element also has two openings 7303 and 7304 in the wall 7301/7302. The holes 7303 and 7304 can accommodate part of a lock that is secured through the hasp 6708 with the blocking element 7300 in place.

FIG. 74 shows in perspective diagram a link 6700 with a blocking element 7300 that is not a hockey puck lock in place in the security link. The blocking element has walls that can block access to and from the slots in the surface of the security link, thus securing a securing member such as a chain or a cable.

FIG. 75 shows in perspective drawing how the blocking element 7300 is secured in the security link 6700 by a lock 7500 with a u-shackle 7501 through the hole in the hasp.

The aspects of the security link as applied to a security link with a hockey puck lock also apply to the security link that is secured with a blocking element 7300, not being a hockey puck lock.

In a further embodiment one may apply different locks to secure the blocking element 7300 in the security link. For instance one may use a straight shackle padlock 7600 as is shown in FIG. 76.

FIG. 77 is another perspective drawing of a security link with a hockey puck lock secured in the security link and two chains secured in the security link through two slots in the bottom of the security link.

In a further embodiment one may provide the security link 6700 as part of a kit. Such a kit may include for instance a link and fasteners to attach the link to an object. A kit may also include brackets, such as threaded brackets to attach a link to an object, whereby the object may be a pole or a wall. Such a kit may also contain a security link and a metal plate and fasteners to attach a security link to for instance a wall of an object. A kit may also contain a security link and a lock. A kit may also contain a security link and a blocking element not being a hockey puck lock and a shackle lock. A kit may also contain a security link and a securing member such as a chain or a cable that can be secured in the security link. A kit may also contain a security link and packaging to display the security link for sales purposes. A kit may also contain an instruction manual or other instruction material, to instruct a user how to apply and/or how to install the security link. A kit may also contain a security link and any combination of elements mentioned above or other elements that may be beneficial for a user to apply the security link.

FIG. 78 shows in diagram a kit 7800 in accordance with an aspect of the present invention. FIG. 78 has packaging 7806. Such packaging may be a plastic clamshell packaging that is made of for instance clear thermoformed plastic, for instance along the shapes of one or more components in the kit. The kit further contains a security link 7801. The kit may contain a hockey puck lock 7805. It may also contain a set of fasteners 7802 or associated hardware to fit the security link on an object. The kit 7800 may also contain a manual or instructions 7803. The kit may also contain one or more securing members such as a chain 7804. The packaging may contain a hole 7807 to allow to hang the kit on a hook for display. FIG. 78 merely provides an illustrative example of a kit. It is to be understood that a security link kit contains a security link and may include any of the earlier mentioned components to complete it as a kit.

FIG. 79 shows another embodiment of a security link. This is a security link 7900 with a body 7910 that has two arms 7901 and 7902. The arms are positioned in a plane at an angle to the body, which is shown in FIG. 79 to be a plane that is perpendicular or about perpendicular to the body. The two arms are also positioned in such a way that they form an opening 7904 that is substantially but not completely surrounded by the arms. In fact, between the arms, when drawing a line in the plane of the arms one should have an opening 7903. The opening 7904 should be of sufficient size to receive the body of a lock such as a shackle lock and a link or a loop of one or more securing members such as a chain or a cable can be captured inside the opening 7904.

The opening 7903 should be large enough so that an arm 7901 and 7902 can receive a loop of a cable or a link of a chain. This is illustrated in FIG. 80 wherein a link 8001 is received by arm 7901 and a link 8002 is received by arm 7902.

The link 7900 also has a hasp 7905 with a hole 7906. The hole is enabled to receive a shackle of a lock. This is illustrated in FIG. 81. A lock 8100 is positioned in the opening 7904 with shackle 8101 received by the hole 7906 of hasp 7905. The opening 7904 and the hole 7903 are dimensioned in such a manner that they enable the reception of the lock and the securing members; they are also dimensioned in such a way that when the lock is fixed inside opening 7904 with the shackle secured in the hasp that securing members that are captured by the arms 7901 and 7902 cannot be removed from the arms, without removing the lock first.

FIG. 79 also shows a plate 7907 which has holes matching the position of fasteners 7908 and 7909. When the plate 7907 is positioned against the body or wall of the link 7910 as shown in FIG. 80, the heads of the fasteners are not accessible with a tool when a lock 8100 is secured through the hasp as shown in FIG. 81. The link may be attached to an object such as a pole 8000 as illustrated in FIG. 80 for instance with a bracket 8003. Malfeasants will have difficulty removing the secured link 7900 from such an object if one is not able to remove the fasteners.

The plane through the arms 7901 and 7902 may be perpendicular to the body or wall 7910 of the link 7900. It should be clear that in a further embodiment the plane may also have an angle that is not perpendicular to the body or wall. A restriction to this embodiment is that a lack may be entered into opening 7904 and that the shackle of the lock can be secured through the hole of the hasp.

FIG. 82 illustrates a variation of the security link as shown in FIG. 79. Herein a security link 8200 has a body or wall 8210 with two arms 8201 and 8202 in a plane perpendicular or close to perpendicular to 8210. The arms define an opening 8203 and an opening 8204. The requirements for these openings are the same as the requirements for the security link of FIG. 79. The link of FIG. 82 should be able to receive a chain link or a loop of a cable around an arm. FIG. 83 illustrates the security link with chain links 8301 and 8302 captured by arms 8201 and 8202 respectively.

The security link should also be able to receive the body of a lock inside the opening 8204. Witch the body secured inside the opening 8204 it should prevent securing members secured by the arms from being removed without first removing the body of the lock from opening 8204.

The lock will be secured by a hasp 8206 with an opening 8205 which is not a hole surrounded by the hasp. In fact, the hasp should have an opening 8205 that is wide enough to receive a shackle of a lock. The lock should have a shackle with a size that is such that when the shackle is captured by the hasp and the shackle is locked in the body of the lock then the shackle cannot clear the height of the hasp, as it will be blocked by the body of the lock. A security link 8200 securing chain links 8301 and 8302 by a rotary shackle padlock 8400 is illustrated in FIG. 84. The shackle 8501 of the padlock can be rotated into the locked position, thus securing padlock 8400 in the opening of the security link and thus preventing the chain links 8301 and 8302 from disengaging from the arms 8201 and 8202 respectively.

While the security link of FIG. 82 is shown with an open hasp or a hasp with an opening that is not completely surrounded by the hasp, it should be clear that in a further embodiment one may also have a hole in the hasp that is surrounded by material such as hasp 7905 in FIG. 79. One should make sure that the hole is large enough to receive the shackle of the rotary shackle padlock or of any lock that may be used.

A further embodiment of a security link is illustrated in FIG. 85. This link looks similar to the link as shown in FIG. 82. However, in the link of FIG. 85 the arms 8201 and 8202 of the link of FIG. 82 have been extended as to form one uninterrupted part. This is shown in FIG. 85 wherein a body 8510 has a wall 8503 that may be flat or substantially flat in a plane that is perpendicular or about perpendicular to the body 8510. The material of the security link may be of metal, though other materials that can withstand a force may also be used. Because the arms are now connected, the part 8503 now has an opening or hole 8504 that is surrounded by material of the wall 8503. The security link has no separate arms that can capture a loop or a chain link. The means to capture a securing member such as a chain or an end of a cable are now provided by the shape of the opening 8504. This is similar to the way that the security link of FIG. 67 secures securing members.

FIG. 85 shows how two sides of opening 8504 are formed to become slots 8501 and 8502. The security link of FIG. 85 also has a hasp 8505 with an opening 8506 that is enabled to receive a shackle of a lock such as a padlock. This is further illustrated in FIG. 86 wherein security link 8500 in slot 8501 has received chain link 8603. For a chain link to be moved into a slot 8501 it has to be entered through the opening 8504 of the security link. The chain can only be removed from the slot without deforming by sliding it out of the slot and removing the chain through opening 8504. It should be clear that the chain link 8603 cannot be moved in or out of the slot in any other fashion because it connected link such as 8604 acts as a stopping element that does not fit through the slot. By closing off access to and from the slot from opening 8504 in the security link one can secure a chain in the security link. The same reasoning applies to chain links 8605 and 8606.

FIG. 87 illustrates the security link 8500 with two chain endings secured in their respective slots by a rotary shackle padlock 8700. While the illustrated example of FIG. 87 is provided with a chain, it is to be understood that any securing member, which may include a cable may be used. Such a securing member, which can slide into a slot of the security link, should be provided with a stopping element that prevents the securing member to be moved through the slot, but allows it to be removed from the slot by sliding it into opening 8504.

The security links 8200 and 8500 look alike, with as a difference that the arms of 8200 are combined in 8500 so that no opening 8203 exists. Security links 8200 and 8500 may be manufactured in different ways. The structural differences between 8200 and 8500 also change the operations of the respective security links. In one way the structural strength of security link 8500 may be greater than the strength against an attack of security link 8200.

Figure 88:
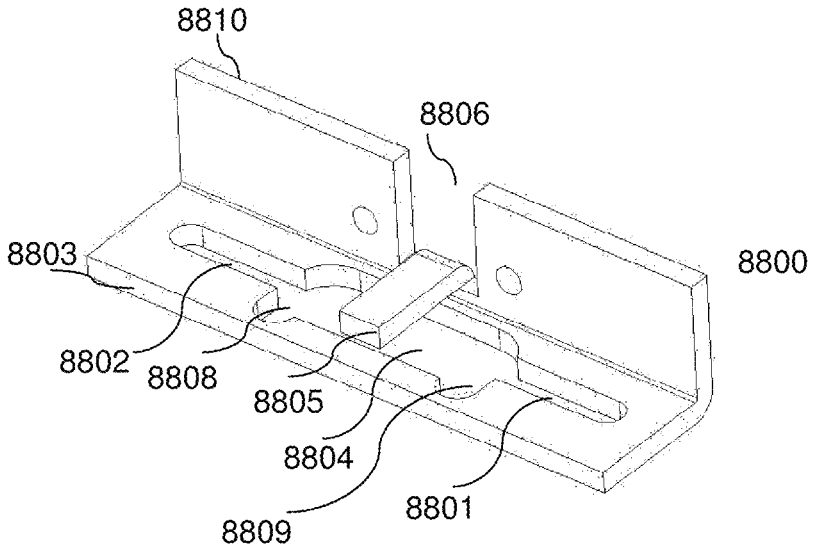

A further embodiment of a security link is illustrated in FIG. 88. The security link may be considered a variation of the security link as for instance illustrated in FIG. 85. The link again has a body 8810 which may be considered to be a wall, with another wall 8803 attached to 8810 in a plane perpendicular or close to perpendicular to 8810. While the two walls can be individually identified, they may be manufactured from for instance one piece of material, such as a piece of metal that is bent into the shape of for instance FIG. 88. Wall 8803 may also be manufactured separately from 8810 and may be attached to 8810 for instance by welding or by other means of attachment. A difference between security link 8800 and the security link of FIG. 8500 is that 8800 has no hasp with a hole.

In the embodiment of FIG. 88 the hasp is a bar 8805 that serves as a hold to secure a shackle of a lock such as a padlock, such as a rotary shackle padlock. The bar in the secured state of the security link will be secured by the shackle and the body of for instance a padlock. There are different ways to create bar 8805. One way is to cut out bar 8805 from wall 8810, thus leaving an opening 8806 in wall 8810. In one embodiment a bar is formed by cutting and bending. In a further embodiment a bar is made separately and for instance welded to the security link. In a further embodiment the bar may be reinforced to resist heavy attacks to the security link. The dimension of the hasp/bar and the opening for the lock are such that the hasp/bar cannot be bent through the opening. Also one or both ends of the hasp/bar could be welded to the horizontal wall 8803 for added strength. The opening for the lock could be dimensioned such that the lock cannot be forced upwards.

The embodiment of FIG. 88 has a similar opening 8804 and slots 8801 and 8802 as opening 8504 and slots 8501 and 8502 as in FIG. 85 and with a similar function. However, FIG. 85 has a large enough opening 8504 to allow moving a chain link through. In the security link of FIG. 88 depending on the position of bar 8805, there may not be sufficient room in opening 8804 to manipulate a second chain link connected to a first chain link that serves as a stopping element into one of the slots. The bar 8805 may effectively limit room for manipulation. To address the issue of limited room for manipulation of a chain link in the opening 8804 additional openings 8808 and 8809 may be created. These openings allow threading of a chain link in a position perpendicular to a slot 8801 or 8802 and position the connecting chain link in the correct position to slide into the appropriate slot.

Figure 89:
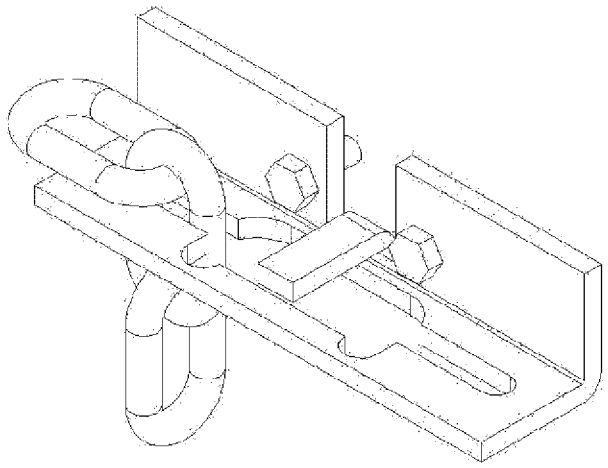
Figure 90:
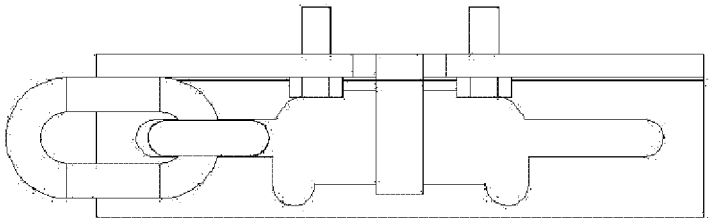
Figure 91:
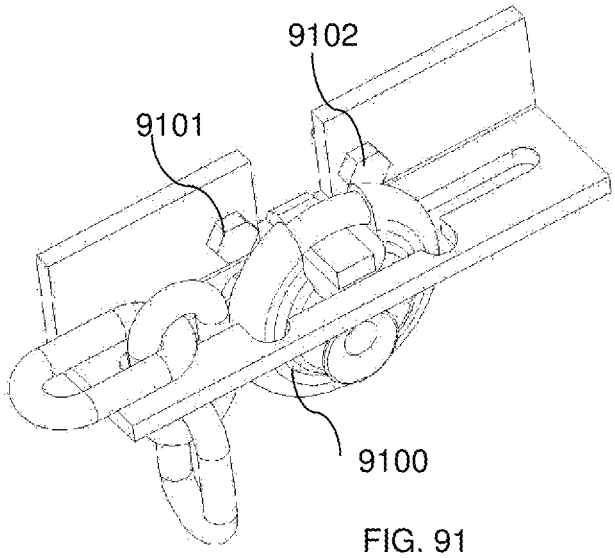

An advantage of the security link of FIG. 88 over another security link may be an inexpensive method of manufacturing. It could be formed sheet metal or modified stock angle. FIG. 89 shows the security link of FIG. 88 with a chain inserted in a perspective drawing. FIG. 90 shows in a view from above the security link of FIG. 88 with a chain inserted. FIG. 91 shows the security link of FIG. 88 with a chain secured in the security link by a rotary shackle lock 9100. The name rotary shackle lock or padlock is used and indicate a similar lock as the well-known ring shackle, or circular shackle, padlocks that may generically be referred to as disc padlocks. FIG. 91 also shows an additional embodiment, wherein one can protect initial access to mounting fasteners 9101 and 9102 by placing mounting holes for these fasteners in such a way that they are covered by the lock 9100 when the padlock is secured in the security link.

FIG. 92 illustrates an embodiment of a security link 9200. Security link 9200 is very similar to security link 8800 of FIG.

88. It has a wall 9210 and a wall 9203 substantially perpendicular to wall 9210. A difference of 9200 with 8800 is that the hasp/bar 9205 is 9200 is an inherent and integral part of the wall 9203. The security link 9200 has the at least one slot 9201 and another slot 9202 to receive a securing member such as a chain or chain link. It also has the notches or additional holes as shown as 8808 and 8809 in 8800 for providing room to manipulate the chain links. Furthermore, rather than one opening 8804 in 9200 two openings 9204 and 9206 are created in wall 9203 to receive a shackle and/or a padlock and to sometimes provide room to receive or release a securing member such as a chain or a cable with a stopping element. It should be clear that the bridge 9205 between openings 9204 and 9206 that will serve as a hasp/bar separates what would be single openings into two openings.

FIG. 93 illustrates the use of security link 9200 with a rotary shackle padlock 9300 to secure a chain link 9301 that has a stopping chain link 9302.

FIG. 94 shows another way to apply the security link 9200, by mounting it "upside-down" compared to FIG. 94. This makes mounting hardware less accessible to a malfeasant. The upside-down mounting has no substantial effect on securing a securing member such as a chain. It can be seen in FIG. 94 that padlock 9300 can be secured adequately in the position as shown in FIG. 94.

FIG. 95 provides a further embodiment of a security link 9500. It has the same features as the wall 9203 of FIG. 92, but 9600 does not have the wall 9210. It can be manufactured from a single flat piece of material such as metal. It can be provided with mounting holes that allow it to be mounted to an object.

In a further embodiment, one may provide the features of the security link as shown in FIG. 95 and FIG. 96 to any object that is enabled to receive such features. Link features may be included with other structures such as cargo rack braces, ladder rails, fence posts et al. The features to accommodate the lock and chain of FIG. 96 may be machined, punched, water or laser cut or by using other appropriate fabrication methods. It is shown in FIGS. 95 and 96 that one may adapt the shape of receiving openings to expected use. For instance opening 9501 in security link 9500 in FIG. 95 is different from opening 9601 in security link 9600 in FIG. 96. For instance the features of a security link may be provided in a casting mold for an object. The object that is created with such a cast is thus a security link.

In FIGS. 97 and 98 two different embodiments 9700 and 9800 of a security link are illustrated. It will be shown next that these security links have a common mode of operation. In both FIGS. 97 and 98 the presence of a hasp or a bar is not shown to keep the figures as uncluttered as possible. The presence of a bar or a hasp may be assumed. The security link 9700 of FIG. 97 has a body or wall 9703 in which a first opening 9701 and a second opening 9702 is shown. The openings are connected and actually form one opening. In a further embodiment a bar may be present that creates two openings. For illustrative purposes the description is focused on the left side of the security link with opening 9701. A similar description may be provided for the right side of the security link. A securing member such as a chain may be aligned or oriented and entered through the opening 9702 for instance in the direction as provided by arrow 9704. The securing member may remain aligned with an orientation 9704 and entered into opening 9701 in a direction substantially different from the direction provided by 9704. This direction may be direction provided by arrow 9705. A body of a lock or padlock with a shackle may be entered into opening 9702 and secured to the security link and prevent the securing member from leaving opening 9701.

FIG. 98 illustrates security link 9800 with body 9803 and openings 9801 and 9802 in body or wall 9803. The link 9800 also has an opening 9807. The link 9800 can be operated in the same way as link 9700. A securing member such as a chain may be aligned or oriented and entered through the opening 9802 for instance in the direction as provided by arrow 9804. The securing member may remain aligned with an orientation 9804 and entered into opening 9801 in a direction substantially different from the direction provided by 9804. This direction may be direction provided by arrow 9805. A body of a lock or padlock with a shackle may be entered into opening 9802 and secured to the security link and prevent the securing member from leaving opening 9801. The securing member, for instance when it is a chain or a cable with an end stop, may also be entered aligned with a direction perpendicular to the body 9803 and aligned or orientated along arrow 9804 along a path provided by arrow 9806 whereby the securing member is moved through opening 9807 into 9802 into 9801. The securing member can be secured into opening 9801 by securing a lock such as a padlock in the opening 9802.

When secured by a lock, the securing member cannot be removed from the security link through the opening 9801, either because of the position of a connecting chain link or because of a stopping element in a cable. In case of the securing member being a cable, the removing of the cable from the security link by pulling the complete cable through the opening is assumed to be made impossible, for instance by securing the other end of the cable.

The securing member can also not be removed through opening 9802, because that opening is occupied and thus blocked by the padlock. The same applies for trying to remove a securing member through opening 9807. Accordingly, both security devices 9700 and 9800 can secure a securing member having a stopping component. When a securing member is a chain, a stopping element is a chain link. When a securing member is a cable, a stopping element is provided in or on the cable. Such a stopping element could be an object that is attached to the table, for instance by crimping, welding, soldering, splicing or any other appropriate method to attach an object that does not fit through opening 9801. One may also modify a cable end, for instance by splicing the cable onto itself or by creating a knot or by twisting a folded cable end, or by any other appropriate method. The operational condition for the end of a securing member to be applied in the above mode as dictated by security link 9700 is to have such dimensions and/or geometrical properties so that the end cannot be moved through opening 9701 or 9801. The only way to remove the securing member is to first move it into opening 9802.

The security link 9800 is similar to the link shown in FIG. 79. In this configuration the securing member should have at least one component that forms a loop that can be hooked over an arm 9808. The arm 9808 is formed by the body 9803, the opening 9802, the opening 9801, and the opening 9807 in the body 9803. In this case the opening 9801 and 9802 can be distinguished from each other by their shapes. This distinguishing of openings appears not to be possible in the security link 7900 with opening 7904 in FIG. 79. However, even when there appears to be one opening such as opening 7904, one may define a first opening by a dimension of the lock that may be entered into opening 7904. Such a dimension that defines the first opening may be a cross-section of the lock. The difference between the opening 7904 and the cross-section of the lock, or the remaining opening then defines partly the second opening. FIG. 81 shows the security link 7900 with a lock 8100. The opening that remains after entering the lock helps define the dimension of the second opening of which in FIG. 81 there are two, to capture two chain links. Each of the second openings should be sufficient to accommodate a secured chain link.

Figure 99:
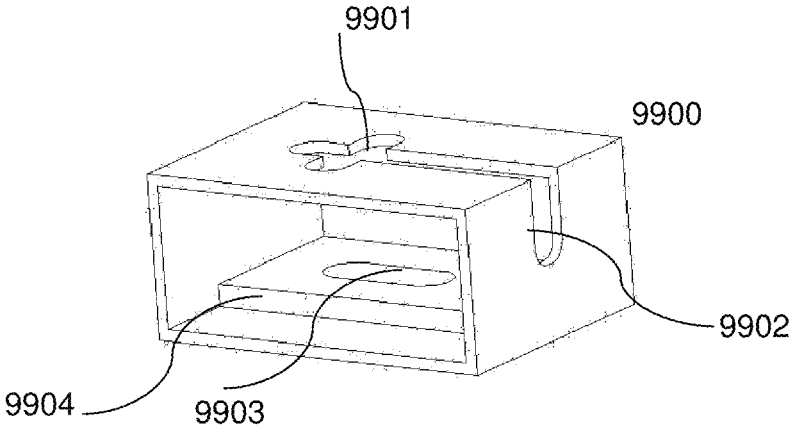

FIG. 99 illustrates a security link in accordance with a further aspect of the present invention. The security link 9900 has a tube like structure, which may be rectangular, round or oval in cross-section. The security link as shown in FIG. 99 has a rectangular cross-section. The working of this security link is as follows: a lock with hidden shackle, such as the hockey puck lock, captures with its shackle a securing member such as a chain link, through a slot, so that the securing member cannot be removed and the lock is secured in the security link as it is now attached to the chain link that cannot be moved through a slot. At least one other securing member may also be positioned in the security link and is blocked by the lock that is now largely not movable, in a position where it cannot leave the link.

Figure 100:
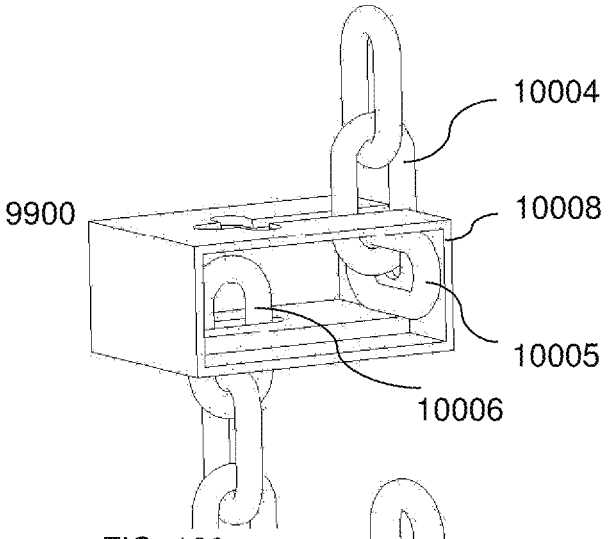

The security link 9900 has in a surface a slot 9901 through the surface perpendicular to a slot through the surface 9902, so that the intersection of 9901 and 9902 can receive at least 2 links of a chain as is shown in FIG. 100. The bottom of 9900 has a slot 9903 that can receive a part of a chain link that has a connected chain link. The slot 9903 cannot receive the whole chain link, as there is no room for the connecting chain link to enter a slot. The security link 9900 may have a raised inside bottom level or a step 9904, which is enabled to match a step in for instance a hockey puck lock or another type of hidden shackle lock.

The working of the security link that is illustrated in FIG. 99 is further illustrated in FIG. 100. A chain link 10005 is received by the intersection of slot 9901 and 9902 until 10005 is clear from the surface of 9900 and chain link 10004 that is connected to 10005 is slid through the slot 9902. It should be clear that when 10004 is no longer at the intersection of 9901 and 9902 it can not be removed from the security link, because connected chain link 10005 acts as a stopping element that cannot be pulled through slot 9902. However, one still may slide 9904 back to the intersection of 9901 and 9902 to remove 10004 and 10005 from the security link. To secure 10004 in the security link, it must be prevented from reaching the intersection of 9901 and 9902. This can be achieved by putting an object inside the security link that prevents chain link 10004 when located near or at the wall 10008 of security link from being moved to the intersection of 9901 and 9902.

Figure 101:
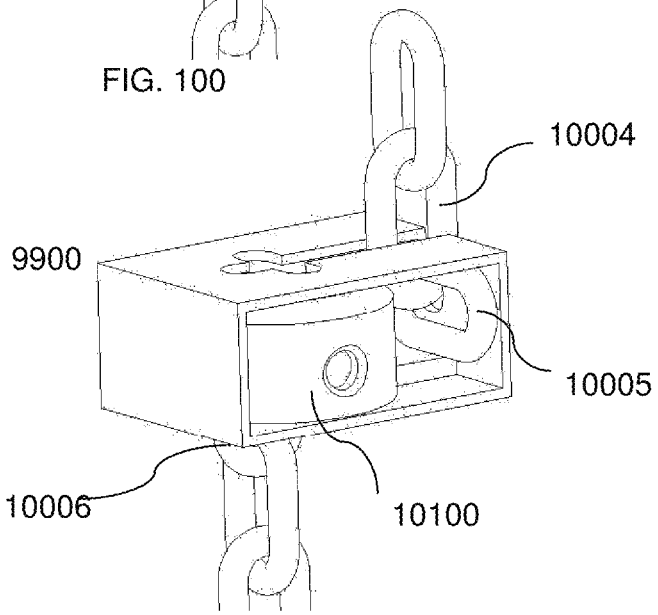
Figure 102:
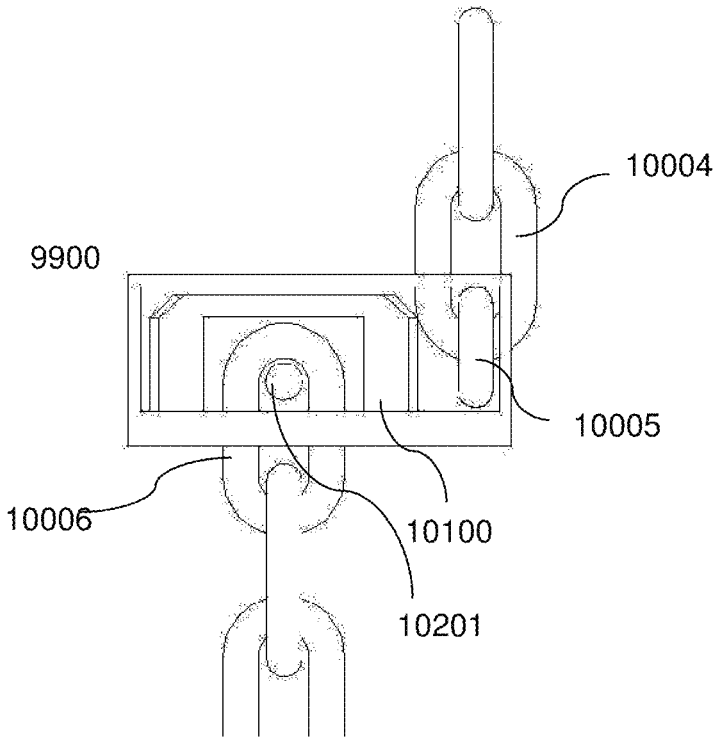
Figure 103:
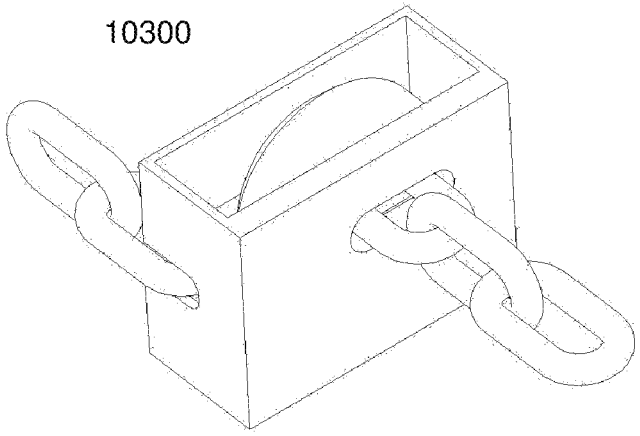

Such an object may be a lock that fills the inside of the security link and will cover and prevent access to the intersection of 9901 and 9902. Such a lock may be a hidden shackle padlock such as a hockey puck lock that can be secured by shackling an object to its shackle. In FIG. 100 it is shown that a chain link 10006 is (partially) moved through slot or opening 9903 so that it can be captured by the shackle of the lock. This is illustrated in FIG. 101 wherein it is shown in perspective drawing that a hockey puck lock 10100 is moved into the security link 9900 and is secured to chain link 10006. Chain link 10006 is now captured by the lock and the body of the security link as it can no longer move through the slot 9903. This is shown in a cross sectional drawing in FIG. 102. It shows how shackle 10201 of lock 10100 has captured chain link 10006. It also shows how chain link 10005 and with that 10004 is now captured between the body of the security link 9900 and the body of the lock 10100. FIG. 103 shows another perspective drawing of the security link 9900 with chain links captured and secured by the hockey puck lock.

The security link 9900 is shown as having one slot 9902 with slot intersection 9901 and 9902. It should be clear that one may expand the security link to secure additional securing members. For instance one may extend the slot 9902 to the side opposite of wall 10008. When the width of the security link is extended it may be able to receive and secure a securing member near the wall opposite to wall 10008. One may also create additional slots. One may also close one of the open sides of the security link and provide a corresponding slot for a securing member.

The securing members that illustrate the security link of FIG. 99 are chain links. It should be clear that securing members that can fulfill the functions of the chain links may also be applied to use the security link. For instance, the chain link 10006 may also be a cable with an eye or a loop that is able to receive the shackle of the lock. Chain with chain links 10004 and 10005 may also be a cable with a stopping element that can pass through an intersection of 9901 and 9902, but cannot be moved through slot 9902.

FIG. 104 illustrates an embodiment of a simple, free floating linking member embodiment intended to engage chain or cable using a conventional "U" Shackle padlock. One advantage of this embodiment is to shield the vulnerable shackle from attack. The linking member 10400 has a body that is a tube or tube-like. Its cross section may be rectangular, circular or oval. The tube like structure is enabled to receive a padlock with a shackle and to secure at least two securing members such as a chain or a cable, or any other securing member that can be secured by this linking member.

FIG. 104 shows the linking member as having a rectangular cross-section. It is to be understood that other cross-sections are fully contemplated. One may distinguish a front surface 10401 of 10400 and a back surface 10402. It also has a left surface 10407, which cannot be fully shown in the perspective drawing and a right surface 10406. The purpose of the linking member is to protect the shackle from an attack and to be partially or completely hidden in the linking member. The shackle in the embodiment will capture components of a chain or a cable. To allow the shackle to capture the components in a locked position and to be covered by the linking member, the linking member should be provided with holes or openings or slots to accommodate the securing members. For instance securing member 10400 is provided with slots 10403 and 10404 to accept a securing member. These slots are preferably parallel and in corresponding locations in surface 10401 and 10402. They should be dimensioned in such a way that they can accommodate a securing member. However, there should be just limited space between the securing member and the body of the linking member to allow a malfeasant the minimum amount of space to enter the linking member with a tool. A similar opening 10405 through left surface 10407 and front surface 10401 and back surface 10402 is provided to accommodate a second securing member or a second part of a securing member. An opening 10408 in right side 10406 may be provided to accommodate a lock with a body larger than the linking member 10400.

FIG. 105 illustrates the different components to a secured lock with securing members: the linking member 10400 a first chain (or a first part of a chain) 10503, a second chain (or a second part of a chain) 10504, a lock 10501 with a shackle 10502.

FIG. 106 shows the secured lock, securing the chains of FIG. 105 and illustrating the protection of shackle 10502 by securing member 10400.

Figure 107:
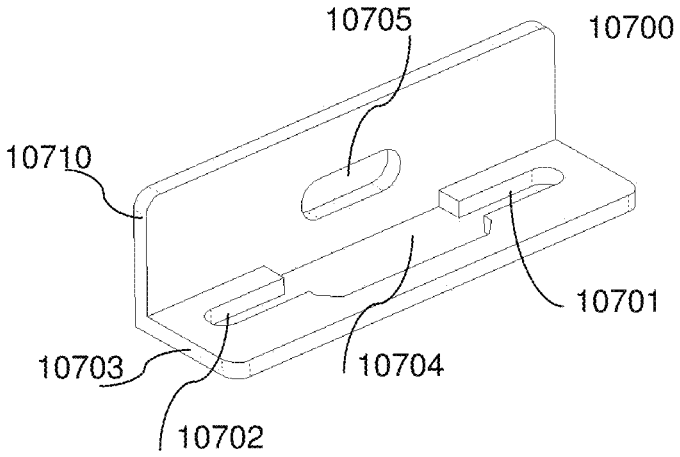

Another embodiment of a security link 10700 is provided in FIG. 107. This security link is somewhat similar to the security link of FIG. 85, however without having a hasp. The hasp 8505 in FIG. 85 is replaced by an opening 10705 in FIG. 107. The security link 10700 comprises a body with a back plane 10710 and perpendicular or close to perpendicular a plane 10703. The planes 10703 and 10710 may be created from one piece of material that is bent or folded. It may also be created from two separate pieces of material that are combined, for instance by welding. It is noted that the term back plane is related to the orientation of the drawing and does not limit any orientation of the security link in actual use.

The plane 10703 has two slots, slot 10701 and slot 10702 that are able to receive a securing member. The dimensions and structure of a securing member is again as above such that it may slide into a slot 10701 or 10702 from a larger opening 10704. Once entered into such a slot a securing member can only leave the slot by sliding it out of the slot into the opening 10704. If access from a slot to the opening 10704 is blocked, for instance by the body of a lock or another blocking element, the securing member in a slot is blocked from leaving the slot. As explained above, a securing member may be a chain link. By the structure of connecting chain links the chain cannot be moved through the slot beyond a single link. The securing member may also be a cable or a wire or the like, provided with at least one stopping element as was explained above. In a further embodiment at least the securing member that will enter the opening 10705 may be a cable or a wire with a looped ending.

The opening 10705 should be dimensioned as to let through a securing member that can be captured by a shackle of a lock such as a hidden shackle lock. The opening 10704 should be dimensioned in such a way that it can receive the body of a lock, such as the hockey puck lock or any other hidden shackle lock.

For illustrative purposes the opening 10705 is drawn in a symmetrical position related to the slots. In a further embodiment one may create an opening 10705 that is not in the above symmetrical position, or that is wide enough in relation to opening 10704 to position a receiving end of a securing member in an asymmetrical position in relation to slots 10701 or 10702. By putting 10705 in an appropriate vertical position in plane 10710 with relation to plane 10703 and also dimensioning 10704 appropriately one may then use a standard type shackle padlock with a shackle to capture a securing element and with a body to enter opening 10704 to block access from slots 10701 and 10702.

Figure 108:
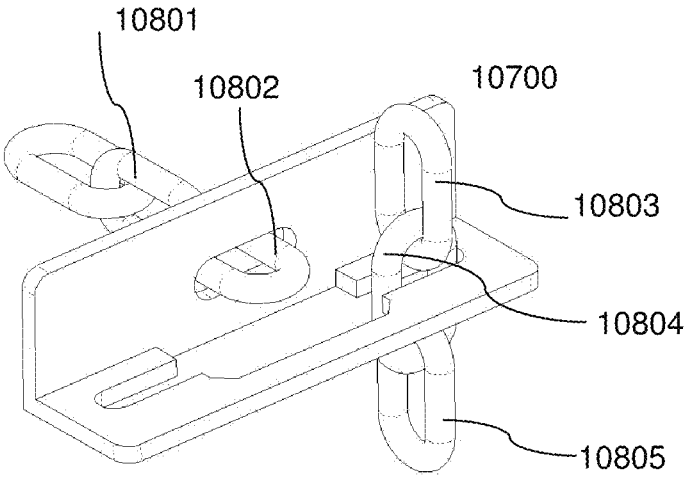

FIG. 108 shows in perspective drawing the security link 10700 of FIG. 107 with one securing member entered in slot 10701 and one securing member entered into opening 10705. For illustrative purposes chains with chain links are shown in FIG. 108. It is to be understood that other securing members that have been described above may also be applied. FIG. 108 shows a chain link 10802 entered through opening 10705. A connected chain link 10801 prevents the chain being pulled through the opening 10705. Also shown, is a chain comprising chain links 10803, 10804 and 10805. Chain link 10804 is entered into slot 10701 through opening 10704. If a blocking body is entered into opening 10704 and blocking access to slot 10701, then this blocking body and chain links 10803 and 10805 will prevent the chain from leaving the slot.

In a further embodiment one may create an additional opening in plane 10703 like the opening 8203 in the security link 8200 in FIG. 82. This may enable the securing of a part of a chain that is not one of its endings. Such an opening allows a chain to enter the opening 10704 from the side of plane 10703 rather than from beneath or above.

Figure 109:
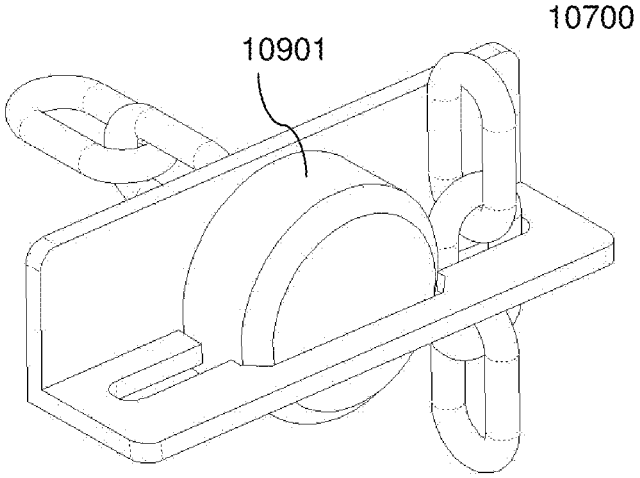

FIG. 109 shows in perspective drawing the security link 10700 of FIG. 107 with the securing members as shown in FIG. 108 secured with a hidden shackle lock 10901 capturing chain link 10802 by the shackle of lock 10901 and blocking chain link 10804 in slot 10701.

It is noted that application of a stepped hockey puck lock 10901 may prevent the lock from being rotated in the locked position in the security link.

Figure 110:
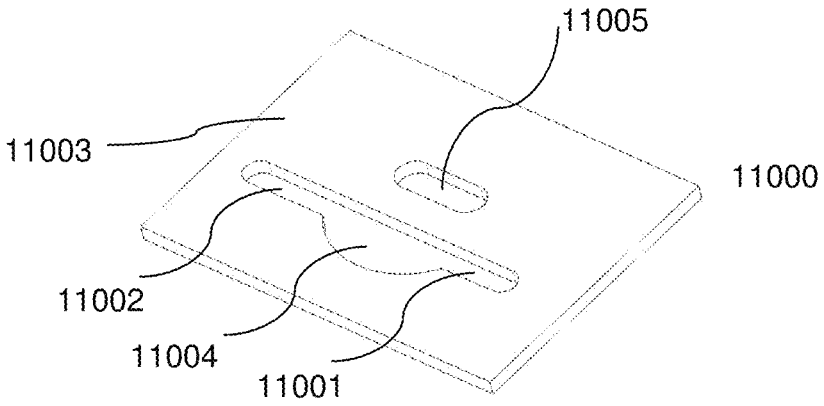
Figure 111:
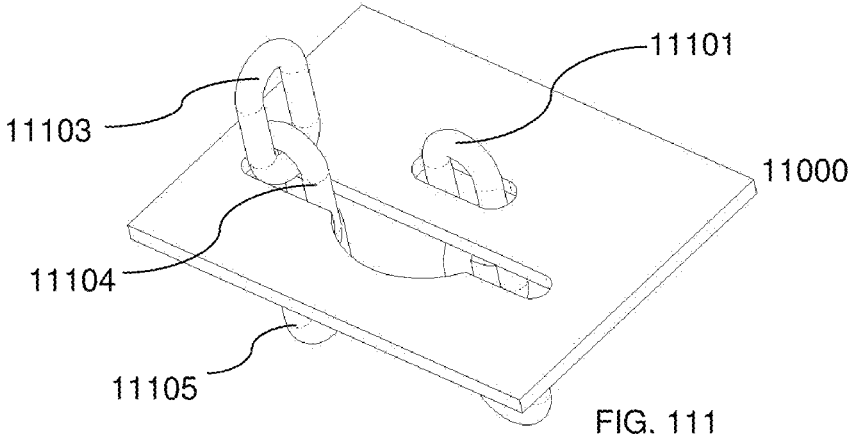

Yet another embodiment of a security link 11000 is shown in FIG. 110. One may consider this embodiment as an open version of the security link 10700. Security link 11000 is one plane or one sheet of material 11003 with openings 11004 and 11005 and slots 11001 and 11002. Slots 11001 and 11002 are enabled to receive securing members such as chain links via the opening 11004. Opening 11005 can receive a securing member element such as a chain link or a loop of a wire or cable that can be captured by the shackle of a hidden shackle padlock. This is shown in FIG. 111, wherein security link 11000 has chain link 11101 through opening 11005. Also shown is chain link 11104 in slot 11002 and chain links 11103 and 1115 preventing the chain from moving through the slot 11002. The chain link 11104 can only leave slot 11002 via opening 11004.

Figure 112:
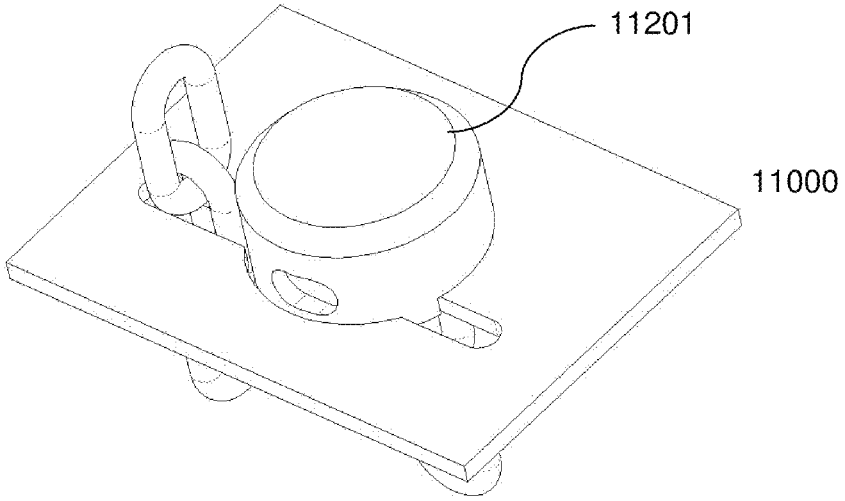

Opening 11004 may be blocked by a hidden shackle padlock 11201 as is shown in FIG. 112. The lock is held in place by capturing shackle 11101. The lock may be prevented from movement or rotation by using a stepped hidden shackle padlock and by dimensioning opening 11004 in such a way that the material of sheet 11003 that defines opening 11004 closely follows the shape of the lock 11201, causing the stepped part of the lock to enter the opening 11004.

Figure 113:
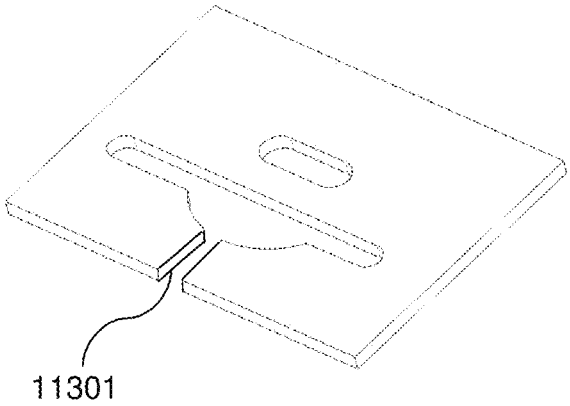

One may create in a further embodiment as shown in FIG. 113 an additional opening 11301 that allows a chain or a cable or wire or any other securing element that can enter the opening 11301 to be secured by the security link.

Figure 114:
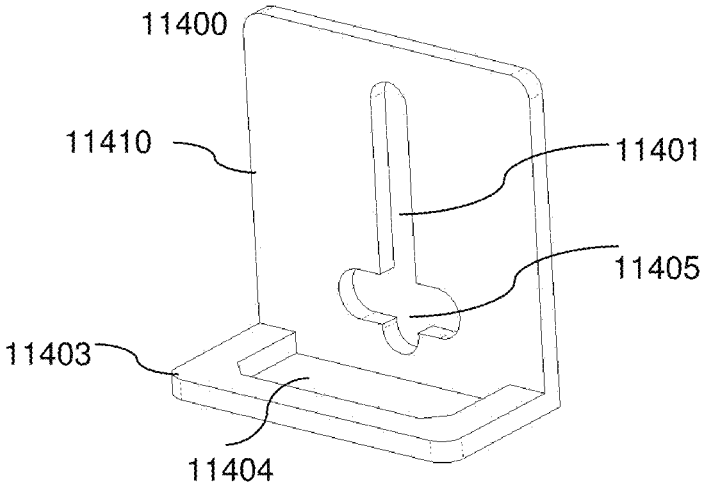
Figure 115:
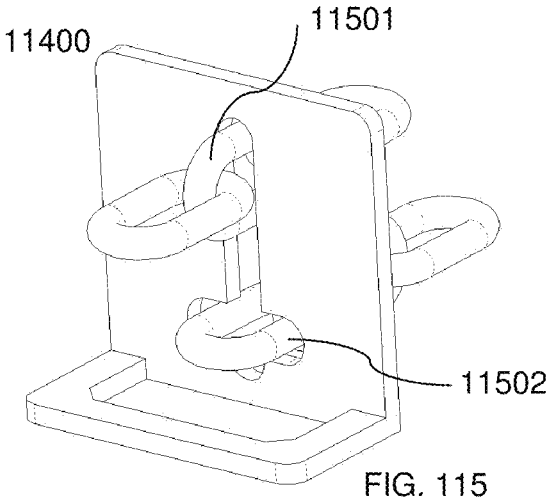
Figure 116:
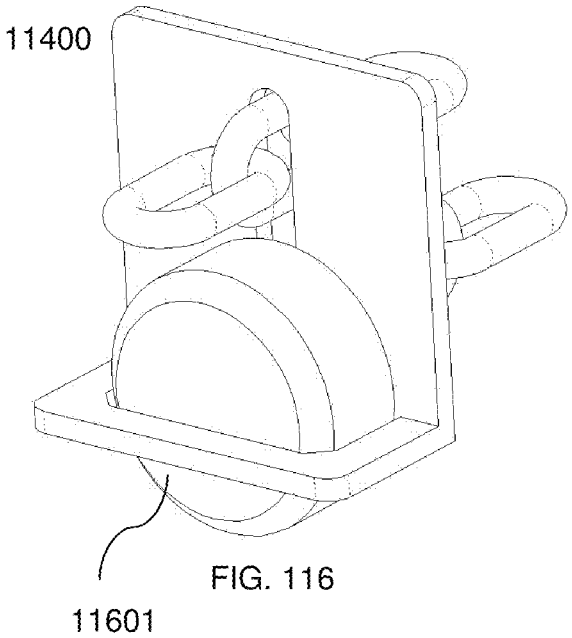

Another embodiment of a security link is provided in FIG. 114. This link 11400 is enabled to secure one or more securing members by using a hidden shackle padlock. The security link 11400 comprises a sheet of material as a backplane 11410. Perpendicular or close to perpendicular is a sheet or plane of material 11403 wherein the material of 11403 defines an opening 11404 that is able to receive the body of the padlock. The opening may further be defined by the material of the backplane 11410. The backplane 11410 has a cruciform slot that comprises a slot 11401 and a substantially perpendicular slot 11405. The cross point of the slots 11401 and 11405 is enabled to receive a chain link 11501 as is shown in FIG. 115. Once entered into the cross point the chain link 11501 can be slid into the slot 11401. A second chain link 11502 may be entered through slot 11405 to be captured by the shackle of a hidden shackle padlock of which the body is entered in opening 11404. As shown in FIG. 116 the hidden shackle padlock 11601 in opening 11404 and capturing chain link 11502 is secured in security link 11400 and also secured the chain with chain link 11501.

Figure 117:
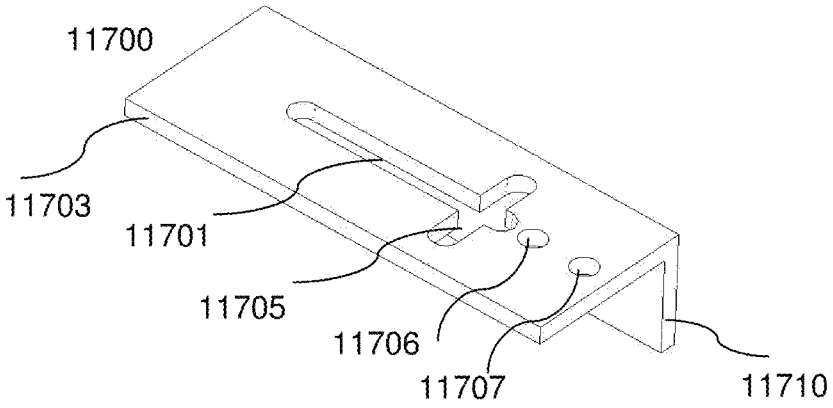
Figure 118:
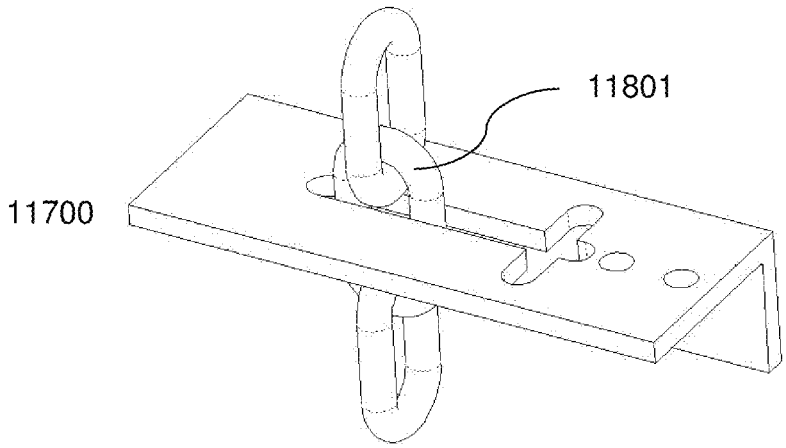
Figure 119:
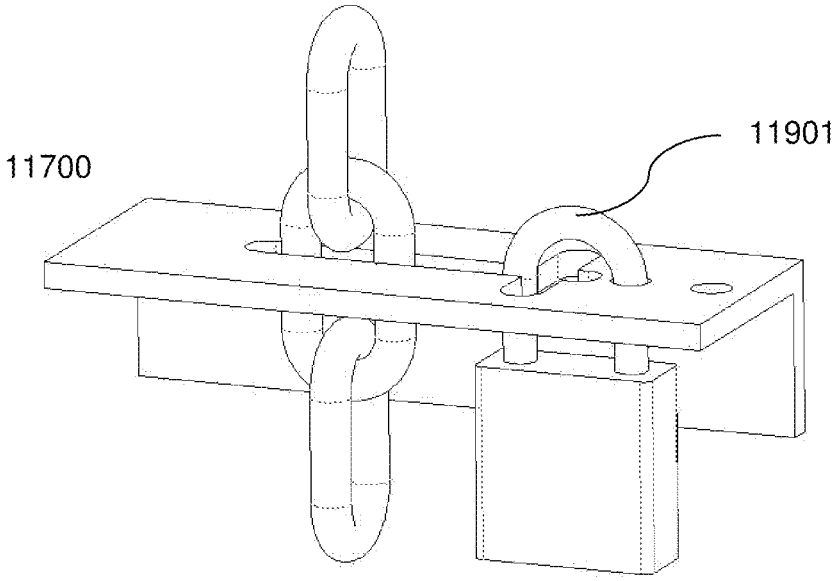

Yet another embodiment of a security link is shown in FIG. 117. This security link may be secured and locked with a u-shackle padlock. The security link 11700 comprises a body being a sheet 11703. It may have a plane perpendicular or close to perpendicular 11710 to 11703. The plane 11710 may be applied to fasten the security link on an object. Plane 11703 has the cruciform slot as in security link 11400, with a slot 11701 and perpendicular to this a slot 11705, so that the cross point of both slots can receive a chain link of a chain so that a second chain link of the chain can be captured and slid into slot 11701. This is shown as chain link 11801 in FIG. 118. The plane 11703 of 11700 also has at least one opening 11706 positioned in such a way that opening 11706 and the opening defined by slots 11701 and 11705 can receive the shackle 11901 of a u-shackle padlock as shown in FIG. 119. The shackle may act as a blocking element to chain link 11801 from leaving the slot 11701 or 11705. Also an additional opening 11707 is shown. An additional may be provided to accommodate securing the security link with a padlock with a large shackle. Additional holes or openings may be provided to accommodate padlocks with different size shackles. One may also provide at least two openings to park the shackle without blocking the slots. FIG. 119 shows that the security link is secured by a shackle of a padlock rather than by its body. In a further embodiment one may capture one chain link by the shackle of a padlock to secure the securing members by the security link.

In security link 11700 in FIG. 117 the parts 11703 and 11710 are called planes. The term plane is understood to mean a substantially flat piece of material, such as metal, plastic, ceramics or any other material that can be used to create a security link.

For illustrative purposes the body of a security link may be shown as substantially flat. It is to be understood that concave or convex planes or other curved planes may be used without affecting the working of the embodiments as explained herein.

A kit was provided in diagram in FIG. 78 related to the security link of for instance FIG. 67. As a further aspect of the present invention a kit is provided for all the security links provided herein as an aspect of the present invention. Such a kit includes at least one of the security links provided herein and at least one of the group consisting of: packaging, securing member such as a chain or a cable, a lock, a user manual, an instruction manual, and mounting hardware.

It should be clear that the security links provided herein can be used to secure different objects, ranging for instance in size, climate wherein they are located and potential threat that they may experience. Different conditions may influence the size, the dimensions and materials of the security links and its aspects. It may also influence the dimensions and materials of the securing members. For instance, if one only requires protecting against accidental release of one or more fairly light objects, one may apply a security link that is made of hard plastic and sturdy lines with a knot at the end. When large and valuable objects are secured with a security link that has to withstand a severe attack by a malfeasant, one may use a security link of hardened steel, dimensioned in a way that is can secure larger types of chain links and using one of the larger size hockey puck locks. The use of any material that can be used to create a security link, includes but not limited to: metal including steel, plastic or other polymers and monomers, ceramics, wood, carton, pressed paper or any other useful material. For applications of securing consumer articles such as computers or portable objects such as skis or snowboards one may apply light materials for links and/or for the securing elements. For instance one may create a link from a light steel alloy and use small gauge steel wire or Kevlar® based wire and/or link.

The security link as illustrated for instance in FIG. 67 may be used for example with a generic stepped bottom "Hockey Puck" style padlock, such as the American Lock 2000 series or Master Lock 6270 series or any of the more than 20 similar embodiments of this popular hidden shackle configuration found in the market today. The securing member may be chain up to ⅜" or cable such as the Master Lock 72 series.

It is contemplated that a smaller size hockey puck type hidden shackle padlock with a matching security link as shown in FIG. 67 may be used. For instance one may use such smaller type security links and padlocks for securing for instance a bicycle to a structure. One may for instance provide a security link kit that has a security link and a hockey puck padlock. The hockey puck padlock may be fairly small in size for instance it may have a diameter of 2 inches. This allows an easier to carry padlock, and still provides a secure and hidden shackle that can withstand a severe attack.

Such a kit may also contain a chain or a cable that can be used in the security link. One may mount a security link to an object such as a bicycle or any object that may be mobile and that requires to be secured to a structure with a securing member such as a chain or a cable. One may also mount a security link on a structure and also provide one or more chains or cables mounted on the structure. A user of a mobile object such as a bicycle that needs to be secured would only require having a padlock corresponding to the security link. One or more chains may be wrapped for instance around a frame and/or through a wheel of the mobile object and have its endings secured by the padlock in the security link. When a hockey puck padlock is small enough carrying it would not be a burden for a user. One may also provide a structure on the mobile object that can store the padlock, for instance a security link or a structure with a hasp to park the hockey puck padlock.

One may also provide cables attached to a structure and a security link with a hockey puck attached to the mobile object. While in the above example the security link of FIG. 67 is used to illustrate the use of a security link on a mobile object, the use of the other security links provided herein to secure a mobile object to a structure is also fully contemplated.

The security link as shown in FIG. 73 with adaptor 7300 is to provide the means for the security link to accept generic "U", rotary, or straight shackle padlocks of the appropriate size and configuration for use in place of the original "Hockey Puck" style padlock.

The security link as illustrated for instance in FIG. 79 may be used with generic "U" shackle padlocks such as the American Lock series 700 or Master Lock series 930 or similar embodiments of this popular style. The securing member may for instance be a chain up to ⅜" or cable such as the Master Lock 72 series. The applications for this type of security link are almost unlimited. Simple structures made of tubing or pipe is ideal for attachment with "U" bolts. They may be mounted to for instance bicycles, or roof racks. They may be fastened to concrete, or other substantial structures, as the application may require.

One application of a security link may be to weld for instance a security link to a manhole cover and secure the cover with chains.

The security link as illustrated for instance in FIG. 82 may be used with generic rotary shackle padlocks such as the Kryptonite 850434, or Master Lock 40 series padlocks with 82 series chains, or 72 series cable, or similar element as the application may require. The security link of FIGS. 88 and 92 may also apply these locks.

The security link of FIG. 99 may be used with a generic stepped bottom "Hockey Puck" style padlock, such as the American Lock 2000 series or Master Lock 6270 series or any of the more than 20 similar embodiments of this popular hidden shackle configuration found in the market today. The security element may be chain up to ⅜" or cable such as the Master Lock 72 series.

The security link of FIG. 104 may be used with a generic "U" shackle padlock such as the American Lock A5200 series in popular use. This may be used with chain or cable security elements of appropriate size for the application.

It is to be understood that the locks and securing members provided herein are for illustrative purposes only. One may adapt a security link to be used with a certain lock and/or with a certain securing member. This may involve changing a size and/or a position and/or a shape of an opening in the security link; it may involve changing a shape of a security link; it may also involve changing a position and/or a shape of a hasp. One may also adapt a lock or create a new lock to correspond to use with a certain security link. One may also create a new lock and a matching security link. All these changes are contemplated without modifying the fundamental approach in securing a securing member by a lock with a shackle in a security link, with the body of the lock by blocking removal of a secured securing member from the security link by the body of the lock, without the shackle capturing the securing member. For instance, one may create a security link such as in FIG. 67 with two hasps, enables to secure a hockey puck padlock having two hidden shackles. These and other modifications that fall within the approach herein provided to security links are fully contemplated.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A security link for securing a component of a securing member, comprising:

a body with a surface having a first opening and a second opening that are connected; and a blocking element that is not a shackle of a lock and that is separate from the body, wherein:

the first opening is adapted not to pass the component of the securing member; and the second opening is adapted to allow passing of the component of the securing member and to receive the blocking element for blocking access by the securing member from the first opening to the second opening when the component of the securing member is in the first opening.

2. The security link as claimed in claim 1, wherein the securing member can be removed from the first opening into the second opening when the blocking member is not in the second opening.

3. The security link as claimed in claim 1, further comprising a hasp being able to receive a shackle of a lock to secure the blocking element in the second opening of the security link.

4. The security link as claimed in claim 1, wherein the component of the securing member is not directly captured by a shackle of a lock.

5. The security link as claimed in claim 1, wherein the blocking element is a hidden shackle padlock.

6. The security link as claimed in claim 1, wherein the blocking element is a security link adaptor.

7. The security link of claim 1, wherein the component of the securing member has to be moved through the second opening before it can enter the first opening.

8. The security link of claim 1, wherein a dimension of the second opening is based on a dimension of a lock.

9. The security link of claim 1, wherein the securing member is a chain.

10. The security link of claim 1, further comprising one or more additional openings, each of the additional one or more openings being connected to the second opening and adapted to receive, but not to pass, another component of the securing member or of another securing member.

11. The security link of claim 1, further comprising:

a third opening, connecting with the second opening forming an arm by the body of the security link and the first, the second and the third opening, wherein the arm is enabled to receive the component, wherein the component forms a loop, and wherein the blocking element blocks access by the securing member from the third opening to the second opening.

12. The security link of claim 1, wherein the security link is part of a kit including also at least one element of the group consisting of the elements of:

packaging;

mounting hardware;

a securing member;

a lock; and a security link adaptor.

13. A security link for securing a securing member with a lock, the lock having a body and a shackle, comprising:

a tubular body with a surface, the surface including a first and a second opening, the first and second opening being connected, wherein:

the first opening is adapted to receive a blocking body into the first opening to block the securing member from being removed from the second opening;

the securing member can be removed from the second opening when the blocking body is not in the first opening;

the securing member is not directly captured by a shackle of a lock; and the blocking body is not secured to the tubular body.

14. The security link of claim 13, further comprising a hasp being able to be captured by the shackle of the lock to secure the blocking body in the first opening.

15. The security link of claim 13, wherein the blocking body is a hidden shackle padlock.

16. The security link of claim 13, wherein the securing member is a chain.

17. The security link of claim 13, further comprising one or more additional openings through the body of the security link, each of the one or more additional openings being connected to the second opening and able to secure a component of a securing member when the blocking element is secured in the first opening.

18. The security link of claim 13, wherein the blocking body is a security link adaptor that can be secured in the first opening by the lock.

19. The security link of claim 18, wherein the lock is a padlock.

20. The security link of claim 13, wherein the security link is part of a kit that also includes at least one element of the group consisting of:

packaging;

a blocking member;

mounting hardware;

a security member;

the lock; and a security link adaptor.

* * * * *